US012072134B2

(12) United States Patent
Stevenson et al.

(10) Patent No.: US 12,072,134 B2
(45) Date of Patent: Aug. 27, 2024

(54) SYSTEMS AND METHODS FOR CREATING CLEAR ICE

(71) Applicant: Abstract Ice, Inc., Novato, CA (US)

(72) Inventors: Todd Stevenson, Novato, CA (US); Bryce Peterson, Hayward, CA (US); Michael Schaller, Louisville, CO (US); David Perez, Menlo Park, CA (US)

(73) Assignee: Abstract Ice, Inc., Novato, CA (US)

( * ) Notice: Subject to any disclaimer, the term of this patent is extended or adjusted under 35 U.S.C. 154(b) by 195 days.

(21) Appl. No.: 17/774,665

(22) PCT Filed: Nov. 5, 2020

(86) PCT No.: PCT/US2020/059014
§ 371 (c)(1),
(2) Date: May 5, 2022

(87) PCT Pub. No.: WO2021/092108
PCT Pub. Date: May 14, 2021

(65) Prior Publication Data

US 2022/0397326 A1 Dec. 15, 2022

Related U.S. Application Data

(60) Provisional application No. 62/931,467, filed on Nov. 6, 2019.

(51) Int. Cl.
*F25C 1/20* (2006.01)

(52) U.S. Cl.
CPC ..... *F25C 1/20* (2013.01); *F25C 2301/00* (2013.01); *F25C 2600/04* (2013.01)

(58) Field of Classification Search
CPC .... F25C 1/20; F25C 2301/00; F25C 2600/04; F25C 2700/12; F25C 1/18; F25C 1/22–1/25
See application file for complete search history.

(56) References Cited

U.S. PATENT DOCUMENTS 230,318 A 7/1880 Miller
1,380,933 A 6/1921 Smith
(Continued)

FOREIGN PATENT DOCUMENTS

CN 101077094 B 11/2011
CN 106135628 A 11/2016
(Continued)

OTHER PUBLICATIONS

International Search Report and Written Opinion for PCT/US2021/060039 dated Mar. 22, 2022, 8 pages.
(Continued)

*Primary Examiner* — Cassey D Bauer
(74) *Attorney, Agent, or Firm* — Aurora Consulting LLC; Kristen J. Hansen; Ashley Sloat

(57) ABSTRACT

Described herein are methods for making clear ice. In one embodiment, a method for making clear ice includes providing a mold of any of the embodiments described herein, optionally inserting a skewer through the mold, the skewer being coupled to an item; circulating, using fluid inlet and outlet valves, a fluid in a mold cavity defined by the mold; varying overtime one or both of: a temperature of the cooling apparatus or a fluid flow rate, through the fluid inlet valve, as a percentage of max flow; and optionally retracting the skewer when the ice formation encases at least a portion of the item. In some embodiments, the method optionally includes a period of flow reversal, such that the fluid inlet valve becomes the fluid outlet valve and the fluid outlet valve becomes the fluid inlet valve. In some embodiments, the method optionally includes releasing the ice from the mold.

26 Claims, 49 Drawing Sheets

(56) References Cited

U.S. PATENT DOCUMENTS

| | | | |
|---|---|---|---|
| 2,036,706 | A | 4/1936 | Ward |
| 2,221,847 | A | 11/1940 | Rodgers |
| 2,334,941 | A | 11/1943 | Linden |
| 2,677,249 | A | 5/1954 | Mason |
| 2,717,504 | A | 9/1955 | Knerr |
| 3,173,175 | A | 3/1965 | Lemelson |
| 3,226,944 | A | 1/1966 | Connors |
| 3,796,063 | A | 3/1974 | Wulke et al. |
| 3,812,686 | A | 5/1974 | Tester |
| 3,911,146 | A | 10/1975 | Hara et al. |
| 3,940,232 | A | 2/1976 | Stock |
| 3,952,539 | A | 4/1976 | Hanson et al. |
| 3,984,996 | A | 10/1976 | Bright |
| 4,112,921 | A | 9/1978 | MacCracken |
| 4,164,343 | A | 8/1979 | Graebner |
| 4,189,928 | A | 2/1980 | Cerny |
| 4,335,155 | A | 6/1982 | Blake et al. |
| 4,455,843 | A | 6/1984 | Quarles |
| 4,498,595 | A | 2/1985 | Wilson |
| 4,550,575 | A | 11/1985 | DeGaynor |
| 4,590,774 | A | 5/1986 | Povajnuk |
| 4,601,174 | A | 7/1986 | Wilson |
| 4,620,422 | A | 11/1986 | Hosokawa et al. |
| 4,776,566 | A | 10/1988 | Girdley |
| 4,833,894 | A | 5/1989 | Chesnut |
| 4,834,340 | A | 5/1989 | Girdley |
| 4,852,359 | A | 8/1989 | Manzotti |
| 4,954,151 | A | 9/1990 | Chang et al. |
| 4,966,015 | A | 10/1990 | Wessa |
| 4,990,169 | A | 2/1991 | Broadbent |
| 5,032,157 | A | 7/1991 | Ruff |
| 5,054,547 | A | 10/1991 | Shipley |
| 5,069,044 | A | 12/1991 | Holum et al. |
| 5,076,069 | A | 12/1991 | Brown |
| 5,127,236 | A | 7/1992 | Blanquet |
| 5,167,132 | A | 12/1992 | Meier |
| 5,187,948 | A | 2/1993 | Frohbieter |
| 5,254,355 | A | 10/1993 | Smith et al. |
| 5,419,285 | A | 5/1995 | Gurevich et al. |
| 5,431,027 | A | 7/1995 | Carpenter |
| 5,555,747 | A | 9/1996 | Conlon |
| 5,618,463 | A | 4/1997 | Rindler et al. |
| 5,948,456 | A | 9/1999 | Jones et al. |
| 5,970,735 | A | 10/1999 | Hobelsberger |
| 6,089,035 | A | 7/2000 | Mildengren |
| 6,105,385 | A | 8/2000 | Kato et al. |
| 6,233,962 | B1 | 5/2001 | Scherer et al. |
| 6,284,294 | B1 | 9/2001 | French et al. |
| 6,357,720 | B1 | 3/2002 | Shapiro et al. |
| 6,536,224 | B2 | 3/2003 | Frank et al. |
| 6,705,090 | B2 | 3/2004 | Billman et al. |
| 6,778,677 | B2 | 8/2004 | Coffin et al. |
| 6,857,277 | B2 | 2/2005 | Somura |
| 6,935,124 | B2 | 8/2005 | Takahashi et al. |
| 7,021,081 | B2 | 4/2006 | Becker |
| 7,082,782 | B2 | 8/2006 | Schlosser et al. |
| 7,210,298 | B2 | 5/2007 | Lin |
| 7,318,323 | B2 | 1/2008 | Tatsui et al. |
| 7,340,913 | B2 | 3/2008 | Miller et al. |
| 7,444,829 | B2 | 11/2008 | Mori et al. |
| 7,448,863 | B2 | 11/2008 | Yang |
| 7,540,161 | B2 | 6/2009 | Broadbent et al. |
| 7,703,299 | B2 | 4/2010 | Schlosser et al. |
| 7,832,219 | B2 | 11/2010 | Baranowski et al. |
| 8,042,344 | B2 | 10/2011 | Morimoto et al. |
| 8,783,046 | B2 | 7/2014 | Doyle et al. |
| 8,882,489 | B1 | 11/2014 | Coomer |
| 9,080,800 | B2 | 7/2015 | Culley |
| 9,163,867 | B2 | 10/2015 | Culley |
| 9,200,823 | B2 | 12/2015 | Boarman et al. |
| 9,273,891 | B2 | 3/2016 | Boarman et al. |
| 9,310,116 | B2 | 4/2016 | Culley et al. |
| 9,459,034 | B2 | 10/2016 | Boarman et al. |
| 9,470,448 | B2 | 10/2016 | Culley et al. |
| 9,476,629 | B2 | 10/2016 | Boarman |
| 9,518,770 | B2 | 12/2016 | Boarman et al. |
| 9,568,228 | B2 | 2/2017 | Joung et al. |
| 9,581,372 | B2 | 2/2017 | Lee et al. |
| 9,651,290 | B2 | 5/2017 | Boarman et al. |
| 9,677,808 | B2 | 6/2017 | Culley et al. |
| 9,696,079 | B2 | 7/2017 | Boarman et al. |
| 9,733,003 | B2 | 8/2017 | Hoti |
| 9,784,492 | B2 | 10/2017 | Little et al. |
| 9,803,908 | B2 | 10/2017 | Amo |
| 9,874,387 | B2 | 1/2018 | Jobb |
| 9,890,986 | B2 | 2/2018 | Boarman |
| 9,989,292 | B2 | 6/2018 | Culley |
| 9,995,519 | B2 | 6/2018 | Boarman et al. |
| 9,995,520 | B2 | 6/2018 | Toma |
| 9,995,521 | B2 | 6/2018 | Mogilevsky |
| 10,006,688 | B2 | 6/2018 | Zuccolo et al. |
| 10,047,996 | B2 | 8/2018 | Boarman et al. |
| 10,066,861 | B2 | 9/2018 | Gooden et al. |
| 10,151,519 | B2 | 12/2018 | Little et al. |
| 10,184,710 | B2 | 1/2019 | Goerz |
| 10,539,354 | B2 | 1/2020 | Shi et al. |
| 10,544,974 | B2 | 1/2020 | Goldfarbmuren et al. |
| 10,605,511 | B2 | 3/2020 | Bertolini et al. |
| 10,605,534 | B2 | 3/2020 | Persson |
| 10,724,779 | B2 | 7/2020 | Flores |
| 10,746,452 | B2 | 8/2020 | Chen et al. |
| 10,746,453 | B2 | 8/2020 | Tarr et al. |
| 10,760,843 | B2 | 9/2020 | Schoonen |
| 10,788,250 | B2 | 9/2020 | Junge et al. |
| 10,801,768 | B2 | 10/2020 | Junge et al. |
| 11,408,659 | B2 | 8/2022 | Notaney et al. |
| 2001/0027654 | A1 | 10/2001 | Shapiro et al. |
| 2003/0129282 | A1 | 7/2003 | Solorio et al. |
| 2004/0025527 | A1 | 2/2004 | Takahashi et al. |
| 2004/0099004 | A1 | 5/2004 | Somura |
| 2004/0206250 | A1 | 10/2004 | Kondou et al. |
| 2004/0258805 | A1 | 12/2004 | Halevy et al. |
| 2006/0286254 | A1 | 12/2006 | Weisberg |
| 2006/0288726 | A1 | 12/2006 | Mori et al. |
| 2007/0048429 | A1 | 3/2007 | Griffiths et al. |
| 2008/0075820 | A1 | 3/2008 | Fernandez |
| 2008/0092574 | A1 | 4/2008 | Doberstein |
| 2009/0152438 | A1 | 6/2009 | Chu |
| 2009/0208611 | A1 | 8/2009 | Williams |
| 2011/0300264 | A1 | 12/2011 | Neta et al. |
| 2012/0192584 | A1 | 8/2012 | Fiaschi |
| 2012/0277906 | A1 | 11/2012 | Fassberg et al. |
| 2012/0324915 | A1 | 12/2012 | Bortoletto et al. |
| 2012/0324916 | A1 | 12/2012 | Bortoletto et al. |
| 2013/0061626 | A1 | 3/2013 | Son et al. |
| 2013/0221031 | A1 | 8/2013 | Guido |
| 2013/0232992 | A1 | 9/2013 | Bisceglie |
| 2013/0340462 | A1 | 12/2013 | Bush et al. |
| 2014/0151928 | A1 | 6/2014 | Zhen et al. |
| 2014/0165598 | A1 | 6/2014 | Boarman et al. |
| 2014/0165602 | A1 | 6/2014 | Boarman |
| 2014/0165618 | A1 | 6/2014 | Culley et al. |
| 2014/0165619 | A1 | 6/2014 | Culley |
| 2014/0165620 | A1 | 6/2014 | Culley |
| 2014/0216072 | A1 | 8/2014 | Matsumoto |
| 2015/0021458 | A1 | 1/2015 | Zorovich et al. |
| 2015/0027142 | A1 | 1/2015 | Little et al. |
| 2015/0040587 | A1 | 2/2015 | Zisholtz et al. |
| 2015/0107275 | A1 | 4/2015 | Papalia |
| 2016/0131406 | A1 | 5/2016 | Schoonen |
| 2016/0201966 | A1 | 7/2016 | Nelson |
| 2017/0038112 | A1 | 2/2017 | Papalia |
| 2017/0042181 | A1 | 2/2017 | Fiaschi |
| 2017/0082338 | A1 | 3/2017 | Wobrock et al. |
| 2017/0122637 | A1 | 5/2017 | Mor |
| 2018/0017303 | A1 | 1/2018 | Hsu |
| 2018/0252454 | A1 | 9/2018 | Christensen et al. |
| 2018/0306479 | A1 | 10/2018 | Vazquez |
| 2019/0011158 | A1 | 1/2019 | Sul et al. |
| 2019/0093933 | A1 | 3/2019 | Little et al. |
| 2020/0025426 | A1 | 1/2020 | Wilkins et al. |
| 2020/0041186 | A1 | 2/2020 | Junge et al. |

(56) References Cited

U.S. PATENT DOCUMENTS

| | | | |
|---|---|---|---|
| 2020/0158402 | A1 | 5/2020 | Kim et al. |
| 2021/0333032 | A1 | 10/2021 | Harrell |
| 2022/0243971 | A1 | 8/2022 | Harrell |

FOREIGN PATENT DOCUMENTS

| | | | |
|---|---|---|---|
| CN | 106949685 | A | 7/2017 |
| CN | 208606446 | U | 3/2019 |
| CN | 208804924 | U | 4/2019 |
| CN | 114234508 | A | 3/2022 |
| DE | 000003909316 | A1 | 9/1990 |
| DE | 202004002823 | U1 | 4/2004 |
| EP | 0364686 | A1 | 4/1990 |
| FR | 2330977 | A1 | 6/1977 |
| JP | 01006664 | S | 1/1989 |
| JP | 03067973 | | 3/1991 |
| JP | 03170759 | | 7/1991 |
| JP | 2883315 | B2 | 4/1999 |
| JP | 3340185 | B2 | 11/2002 |
| JP | 2003279208 | A | 10/2003 |
| JP | 20160054654 | | 4/2016 |
| JP | 20150154764 | | 10/2019 |
| KR | 200317463 | Y1 | 6/2003 |
| KR | 20120064026 | A | 6/2012 |
| KR | 20120111710 | A | 10/2012 |
| KR | 101225651 | B1 | 1/2013 |
| KR | 20170052100 | A | 5/2017 |
| WO | 1990011481 | A2 | 10/1990 |
| WO | 2008061179 | A3 | 10/2008 |
| WO | 2014174314 | A2 | 10/2014 |
| WO | 2014178710 | A1 | 11/2014 |
| WO | 2017216294 | A1 | 12/2017 |
| WO | 2021092108 | A1 | 5/2021 |
| WO | PCTUS2159988 | | 11/2021 |

OTHER PUBLICATIONS

International Search Report and Written Opinion from the International Searching Authority for PCT/US2021/059988 dated Mar. 16, 2022.

International Search Report for PCT/US2020/059014 dated Feb. 2, 2021, 3 pages.

Written Opinion from the International Searching Authority for PCT/US2020/059014 dated Feb. 2, 2021, 10 pages.

Constant Varied

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -2 | |
| 2 | 8 | 8 | | | 100 | -2.1 | |
| 3 | 6 | 14 | | | 100 | -2.2 | |
| 4 | 6 | 20 | | | 100 | -2.3 | |
| 5 | 5 | 25 | | | 100 | -2.4 | |
| 6 | 5 | 30 | | | 100 | -2.5 | |
| 7 | 5 | 35 | | | 100 | -2.6 | |
| 8 | 5 | 40 | | | 100 | -2.7 | |
| 9 | 5 | 45 | | | 100 | -2.8 | |
| 10 | 5 | 50 | | | 100 | -2.9 | |
| 11 | 5 | 55 | | | 100 | -3 | |
| 12 | 5 | 60 | | | 100 | -3.1 | |
| 13 | 5 | 65 | | | 100 | -3.2 | |
| 14 | 5 | 70 | | | 100 | -3.3 | |
| 15 | 5 | 75 | | | 100 | -3.4 | |
| 16 | 5 | 80 | | | 100 | -3.5 | |
| 17 | 5 | 85 | | | 100 | -3.6 | |
| 18 | 5 | 90 | | | 100 | -3.7 | 0 |
| 19 | 5 | 95 | | | 100 | -3.8 | |
| 20 | 5 | 100 | | | 100 | -3.9 | |
| 21 | 5 | 105 | | | 100 | -4 | |
| 22 | 5 | 110 | | | 100 | -4.1 | |
| 23 | 5 | 115 | | | 100 | -4.2 | |
| 24 | 5 | 120 | | | 100 | -4.3 | |
| 25 | 5 | 125 | | | 100 | -4.4 | |
| 26 | 5 | 130 | | | 100 | -4.5 | |
| 27 | 5 | 135 | | | 100 | -4.6 | |
| 28 | 5 | 140 | | | 100 | -4.7 | |
| 29 | 5 | 145 | | | 100 | -4.8 | |
| 30 | 5 | 150 | | | 100 | -4.9 | |
| 31 | 5 | 155 | | | 100 | -5 | |
| 32 | 5 | 160 | | | 100 | -5.1 | |
| 33 | 5 | 165 | | | 100 | -5.2 | |
| 34 | 5 | 170 | | | 100 | -5.3 | |
| 35 | 5 | 175 | | | 100 | -5.4 | |
| 36 | 5 | 180 | | | 100 | -5.5 | |
| 37 | 5 | 185 | | | 100 | -5.6 | |
| 38 | 5 | 190 | | | 100 | -5.7 | |
| 39 | 5 | 195 | | | 100 | -5.8 | |
| 40 | 5 | 200 | | | 100 | -5.9 | |
| 41 | 5 | 205 | | | 100 | -6 | |
| 42 | 5 | 210 | | | 100 | -6.1 | |
| 43 | 5 | 215 | | | 100 | -6.2 | |
| 44 | 5 | 220 | | | 100 | -6.3 | |
| 45 | 5 | 225 | | | 100 | -6.4 | |
| 46 | 5 | 230 | | | 100 | -6.5 | |
| 47 | 5 | 235 | | | 100 | -6.6 | |
| 48 | 5 | 240 | | | 100 | -6.7 | |

FIG. 21A

Varied Constant

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -7 | |
| 2 | 8 | 8 | | | 98 | -7 | |
| 3 | 6 | 14 | | | 96 | -7 | |
| 4 | 6 | 20 | | | 94 | -7 | |
| 5 | 5 | 25 | | | 92 | -7 | |
| 6 | 5 | 30 | | | 90 | -7 | |
| 7 | 5 | 35 | | | 88 | -7 | |
| 8 | 5 | 40 | | | 86 | -7 | |
| 9 | 5 | 45 | | | 84 | -7 | |
| 10 | 5 | 50 | | | 82 | -7 | |
| 11 | 5 | 55 | | | 80 | -7 | |
| 12 | 5 | 60 | | | 78 | -7 | |
| 13 | 5 | 65 | | | 76 | -7 | |
| 14 | 5 | 70 | | | 74 | -7 | |
| 15 | 5 | 75 | | | 72 | -7 | |
| 16 | 5 | 80 | | | 70 | -7 | |
| 17 | 5 | 85 | | | 68 | -7 | |
| 18 | 5 | 90 | | | 66 | -7 | |
| 19 | 5 | 95 | | | 64 | -7 | |
| 20 | 5 | 100 | | | 62 | -7 | |
| 21 | 5 | 105 | | | 60 | -7 | |
| 22 | 5 | 110 | | | 58 | -7 | |
| 23 | 5 | 115 | | | 56 | -7 | |
| 24 | 5 | 120 | | | 54 | -7 | 0 |
| 25 | 5 | 125 | | | 52 | -7 | |
| 26 | 5 | 130 | | | 50 | -7 | |
| 27 | 5 | 135 | | | 48 | -7 | |
| 28 | 5 | 140 | | | 46 | -7 | |
| 29 | 5 | 145 | | | 44 | -7 | |
| 30 | 5 | 150 | | | 42 | -7 | |
| 31 | 5 | 155 | | | 40 | -7 | |
| 32 | 5 | 160 | | | 38 | -7 | |
| 33 | 5 | 165 | | | 36 | -7 | |
| 34 | 5 | 170 | | | 34 | -7 | |
| 35 | 5 | 175 | | | 32 | -7 | |
| 36 | 5 | 180 | | | 30 | -7 | |
| 37 | 5 | 185 | | | 28 | -7 | |
| 38 | 5 | 190 | | | 26 | -7 | |
| 39 | 5 | 195 | | | 24 | -7 | |
| 40 | 5 | 200 | | | 22 | -7 | |
| 41 | 5 | 205 | | | 20 | -7 | |
| 42 | 5 | 210 | | | 18 | -7 | |
| 43 | 5 | 215 | | | 16 | -7 | |
| 44 | 5 | 220 | | | 14 | -7 | |
| 45 | 5 | 225 | | | 12 | -7 | |
| 46 | 5 | 230 | | | 10 | -7 | |
| 47 | 5 | 235 | | | 8 | -7 | |
| 48 | 5 | 240 | | | 6 | -7 | |

FIG. 22A

Varied Varied

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -2 | |
| 2 | 8 | 8 | | | 98 | -2.1 | |
| 3 | 6 | 14 | | | 96 | -2.2 | |
| 4 | 6 | 20 | | | 94 | -2.3 | |
| 5 | 5 | 25 | | | 92 | -2.4 | |
| 6 | 5 | 30 | | | 90 | -2.5 | |
| 7 | 5 | 35 | | | 88 | -2.6 | |
| 8 | 5 | 40 | | | 86 | -2.7 | |
| 9 | 5 | 45 | | | 84 | -2.8 | |
| 10 | 5 | 50 | | | 82 | -2.9 | |
| 11 | 5 | 55 | | | 80 | -3 | |
| 12 | 5 | 60 | | | 78 | -3.1 | |
| 13 | 5 | 65 | | | 76 | -3.2 | |
| 14 | 5 | 70 | | | 74 | -3.3 | |
| 15 | 5 | 75 | | | 72 | -3.4 | |
| 16 | 5 | 80 | | | 70 | -3.5 | |
| 17 | 5 | 85 | | | 68 | -3.6 | |
| 18 | 5 | 90 | | | 66 | -3.7 | |
| 19 | 5 | 95 | | | 64 | -3.8 | |
| 20 | 5 | 100 | | | 62 | -3.9 | |
| 21 | 5 | 105 | | | 60 | -4 | |
| 22 | 5 | 110 | | | 58 | -4.1 | |
| 23 | 5 | 115 | | | 56 | -4.2 | |
| 24 | 5 | 120 | | | 54 | -4.3 | 0 |
| 25 | 5 | 125 | | | 52 | -4.4 | |
| 26 | 5 | 130 | | | 50 | -4.5 | |
| 27 | 5 | 135 | | | 48 | -4.6 | |
| 28 | 5 | 140 | | | 46 | -4.7 | |
| 29 | 5 | 145 | | | 44 | -4.8 | |
| 30 | 5 | 150 | | | 42 | -4.9 | |
| 31 | 5 | 155 | | | 40 | -5 | |
| 32 | 5 | 160 | | | 38 | -5.1 | |
| 33 | 5 | 165 | | | 36 | -5.2 | |
| 34 | 5 | 170 | | | 34 | -5.3 | |
| 35 | 5 | 175 | | | 32 | -5.4 | |
| 36 | 5 | 180 | | | 30 | -5.5 | |
| 37 | 5 | 185 | | | 28 | -5.6 | |
| 38 | 5 | 190 | | | 26 | -5.7 | |
| 39 | 5 | 195 | | | 24 | -5.8 | |
| 40 | 5 | 200 | | | 22 | -5.9 | |
| 41 | 5 | 205 | | | 20 | -6 | |
| 42 | 5 | 210 | | | 18 | -6.1 | |
| 43 | 5 | 215 | | | 16 | -6.2 | |
| 44 | 5 | 220 | | | 14 | -6.3 | |
| 45 | 5 | 225 | | | 12 | -6.4 | |
| 46 | 5 | 230 | | | 10 | -6.5 | |
| 47 | 5 | 235 | | | 8 | -6.6 | |
| 48 | 5 | 240 | | | 6 | -6.7 | |

FIG. 23A

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -10 | Initial cool down |
| 2 | 8 | 8 | | | 98 | -2 | |
| 3 | 6 | 14 | | | 96 | -2.2 | |
| 4 | 6 | 20 | | | 94 | -2.4 | |
| 5 | 5 | 25 | | | 92 | -2.6 | |
| 6 | 5 | 30 | | | 90 | -2.8 | |
| 7 | 5 | 35 | | | 88 | -3 | |
| 8 | 5 | 40 | | | 86 | -3.2 | |
| 9 | 5 | 45 | | | 84 | -3.4 | |
| 10 | 5 | 50 | | | 82 | -3.6 | |
| 11 | 5 | 55 | | | 80 | -3.8 | |
| 12 | 5 | 60 | | | 78 | -4 | |
| 13 | 5 | 65 | | | 76 | -4.2 | |
| 14 | 5 | 70 | | | 74 | -4.4 | |
| 15 | 5 | 75 | | | 72 | -4.6 | |
| 16 | 5 | 80 | | | 70 | -4.8 | |
| 17 | 5 | 85 | | | 68 | -5 | |
| 18 | 5 | 90 | | | 66 | -5.2 | |
| 19 | 5 | 95 | | | 64 | -5.4 | |
| 20 | 5 | 100 | | | 62 | -5.6 | |
| 21 | 5 | 105 | | | 60 | -5.8 | |
| 22 | 5 | 110 | | | 58 | -6 | |
| 23 | 5 | 115 | | | 56 | -6.2 | |
| 24 | 5 | 120 | | | 54 | -6.4 | 0 |
| 25 | 5 | 125 | | | 52 | -6.6 | |
| 26 | 5 | 130 | | | 50 | -6.8 | |
| 27 | 5 | 135 | | | 48 | -7 | |
| 28 | 5 | 140 | | | 46 | -7 | |
| 29 | 5 | 145 | | | 44 | -7 | |
| 30 | 5 | 150 | | | 42 | -7 | |
| 31 | 5 | 155 | | | 40 | -7 | |
| 32 | 5 | 160 | | | 38 | -7 | |
| 33 | 5 | 165 | | | 36 | -7 | |
| 34 | 5 | 170 | | | 34 | -7 | |
| 35 | 5 | 175 | | | 32 | -7 | |
| 36 | 5 | 180 | | | 30 | -7 | |
| 37 | 5 | 185 | | | 28 | -7 | End plateau |
| 38 | 5 | 190 | | | 26 | -7 | |
| 39 | 5 | 195 | | | 24 | -7 | |
| 40 | 5 | 200 | | | 22 | -7 | |
| 41 | 5 | 205 | | | 20 | -7 | |
| 42 | 5 | 210 | | | 18 | -7 | |
| 43 | 5 | 215 | | | 16 | -7 | |
| 44 | 5 | 220 | | | 14 | -7 | |
| 45 | 5 | 225 | | | 12 | -7 | |
| 46 | 5 | 230 | | | 10 | -7 | |
| 47 | 5 | 235 | | | 8 | -7 | |

FIG. 24A

| Step # | Time Step (min) | Total Time (min) | Flow Outer (%) | Flow Inner (%) | Flow (%) | Temp (°C) | Inclusion Utensil Retraction | |
|---|---|---|---|---|---|---|---|---|
| 1 | 0 | 0 | | | 100 | -10 | | Initial cool down |
| 2 | 8 | 8 | | | 98 | -2 | | |
| 3 | 6 | 14 | | | 96 | -2.2 | | |
| 4 | 6 | 20 | | | 94 | -2.4 | | |
| 5 | 5 | 25 | | | 92 | -2.6 | | |
| 6 | 5 | 30 | | | 90 | -2.8 | | |
| 7 | 5 | 35 | | | 88 | -3 | | |
| 8 | 5 | 40 | | | 86 | -3.2 | | |
| 9 | 5 | 45 | | | 84 | -3.4 | | |
| 10 | 5 | 50 | | | 82 | -3.6 | | |
| 11 | 5 | 55 | | | 80 | -3.8 | | |
| 12 | 5 | 60 | | | 78 | -4 | | |
| 13 | 5 | 65 | | | 76 | -4.2 | | |
| 14 | 5 | 70 | | | 74 | -4.4 | | |
| 15 | 5 | 75 | | | 72 | -4.6 | | |
| 16 | 5 | 80 | | | 70 | -4.8 | | |
| 17 | 5 | 85 | | | 68 | -5 | | |
| 18 | 5 | 90 | | | 66 | -5.2 | | |
| 19 | 5 | 95 | | | 64 | -5.4 | | |
| 20 | 5 | 100 | | | 62 | -5.6 | | |
| 21 | 5 | 105 | | | 60 | -5.8 | | |
| 22 | 5 | 110 | | | 58 | -6 | | |
| 23 | 5 | 115 | | | 56 | -6.2 | | |
| 24 | 5 | 120 | | | 54 | -6.4 | 0 | |
| 25 | 5 | 125 | | | 52 | -6.6 | | |
| 26 | 5 | 130 | | | 50 | -6.8 | | |
| 27 | 5 | 135 | | | 48 | -7 | | |
| 28 | 5 | 140 | | | 46 | -7 | | |
| 29 | 5 | 145 | | | 44 | -7 | | |
| 30 | 5 | 150 | | | 42 | -7 | | |
| 31 | 5 | 155 | | | 40 | -7 | | |
| 32 | 5 | 160 | | | 38 | -7 | | |
| 33 | 5 | 165 | | | 36 | -7 | | |
| 34 | 5 | 170 | | | 34 | -7 | | |
| 35 | 5 | 175 | | | 32 | -7 | | End plateau |
| 36 | 5 | 180 | | | 30 | -7 | | |
| 37 | 5 | 185 | | | 28 | -7 | | |
| 38 | 5 | 190 | | | 26 | -7 | | |
| 39 | 5 | 195 | | | 24 | -7 | | |
| 40 | 5 | 200 | | | 22 | -7 | | |
| 41 | 5 | 205 | | | 20 | -7 | | |
| 42 | 5 | 210 | | | 18 | -7 | | |
| 43 | 5 | 215 | | | 16 | -7 | | |
| 44 | 5 | 220 | | | 0 | 0 | | |
| 45 | 5 | 225 | | | 0 | 0 | | |
| 46 | 5 | 230 | | | 0 | 10 | | Annealing |
| 47 | 5 | 235 | | | 0 | 10 | | |
| 48 | 5 | 240 | | | 0 | 10 | | |

FIG. 25A

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -10 | Initial cool down |
| 2 | 8 | 8 | | | 98 | -2 | |
| 3 | 6 | 14 | | | 96 | -2.2 | |
| 4 | 6 | 20 | | | 94 | -2.4 | |
| 5 | 5 | 25 | | | 92 | -2.6 | |
| 6 | 5 | 30 | | | 90 | -2.8 | |
| 7 | 5 | 35 | | | 88 | -3 | |
| 8 | 5 | 40 | | | 86 | -3.2 | |
| 9 | 5 | 45 | | | 84 | -3.4 | |
| 10 | 5 | 50 | | | 82 | -3.6 | |
| 11 | 5 | 55 | | | 80 | -3.8 | |
| 12 | 5 | 60 | | | 78 | -4 | |
| 13 | 5 | 65 | | | 76 | -4 | |
| 14 | 5 | 70 | | | 74 | -4 | |
| 15 | 5 | 75 | | | 72 | -4 | |
| 16 | 5 | 80 | | | 70 | -4 | Mid plateau |
| 17 | 5 | 85 | | | 68 | -4 | |
| 18 | 5 | 90 | | | 66 | -4 | |
| 19 | 5 | 95 | | | 64 | -4 | |
| 20 | 5 | 100 | | | 62 | -4 | |
| 21 | 5 | 105 | | | 60 | -4.2 | |
| 22 | 5 | 110 | | | 58 | -4.4 | |
| 23 | 5 | 115 | | | 56 | -4.6 | |
| 24 | 5 | 120 | | | 54 | -4.8 | 0 |
| 25 | 5 | 125 | | | 52 | -5 | |
| 26 | 5 | 130 | | | 50 | -5.2 | |
| 27 | 5 | 135 | | | 48 | -5.4 | |
| 28 | 5 | 140 | | | 46 | -5.6 | |
| 29 | 5 | 145 | | | 44 | -5.8 | |
| 30 | 5 | 150 | | | 42 | -6 | |
| 31 | 5 | 155 | | | 40 | -6.2 | |
| 32 | 5 | 160 | | | 38 | -6.4 | |
| 33 | 5 | 165 | | | 36 | -6.6 | |
| 34 | 5 | 170 | | | 34 | -6.8 | |
| 35 | 5 | 175 | | | 32 | -7 | |
| 36 | 5 | 180 | | | 30 | -7 | |
| 37 | 5 | 185 | | | 28 | -7 | |
| 38 | 5 | 190 | | | 26 | -7 | |
| 39 | 5 | 195 | | | 24 | -7 | End plateau |
| 40 | 5 | 200 | | | 22 | -7 | |
| 41 | 5 | 205 | | | 20 | -7 | |
| 42 | 5 | 210 | | | 18 | -7 | |
| 43 | 5 | 215 | | | 16 | -7 | |
| 44 | 5 | 220 | | | 0 | 0 | |
| 45 | 5 | 225 | | | 0 | 0 | |
| 46 | 5 | 230 | | | 0 | 10 | Annealing |
| 47 | 5 | 235 | | | 0 | 10 | |
| 48 | 5 | 240 | | | 0 | 10 | |

FIG. 26A

Shifts from outer to inner over time

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | 90 | 10 | 100 | -10 | Initial cool down |
| 2 | 8 | 8 | 88 | 12 | 98 | -2 | |
| 3 | 6 | 14 | 86 | 14 | 96 | -2.2 | |
| 4 | 6 | 20 | 84 | 16 | 94 | -2.4 | |
| 5 | 5 | 25 | 82 | 18 | 92 | -2.6 | |
| 6 | 5 | 30 | 80 | 20 | 90 | -2.8 | |
| 7 | 5 | 35 | 78 | 22 | 88 | -3 | |
| 8 | 5 | 40 | 76 | 24 | 86 | -3.2 | |
| 9 | 5 | 45 | 74 | 26 | 84 | -3.4 | |
| 10 | 5 | 50 | 72 | 28 | 82 | -3.6 | |
| 11 | 5 | 55 | 70 | 30 | 80 | -3.8 | |
| 12 | 5 | 60 | 68 | 32 | 78 | -4 | |
| 13 | 5 | 65 | 66 | 34 | 76 | -4 | |
| 14 | 5 | 70 | 64 | 36 | 74 | -4 | |
| 15 | 5 | 75 | 62 | 38 | 72 | -4 | |
| 16 | 5 | 80 | 60 | 40 | 70 | -4 | Mid plateau |
| 17 | 5 | 85 | 58 | 42 | 68 | -4 | |
| 18 | 5 | 90 | 56 | 44 | 66 | -4 | |
| 19 | 5 | 95 | 54 | 46 | 64 | -4 | |
| 20 | 5 | 100 | 52 | 48 | 62 | -4 | |
| 21 | 5 | 105 | 50 | 50 | 60 | -4.2 | |
| 22 | 5 | 110 | 48 | 52 | 58 | -4.4 | |
| 23 | 5 | 115 | 46 | 54 | 56 | -4.6 | |
| 24 | 5 | 120 | 44 | 56 | 54 | -4.8 | 0 |
| 25 | 5 | 125 | 42 | 58 | 52 | -5 | |
| 26 | 5 | 130 | 40 | 60 | 50 | -5.2 | |
| 27 | 5 | 135 | 38 | 62 | 48 | -5.4 | |
| 28 | 5 | 140 | 36 | 64 | 46 | -5.6 | |
| 29 | 5 | 145 | 34 | 66 | 44 | -5.8 | |
| 30 | 5 | 150 | 32 | 68 | 42 | -6 | |
| 31 | 5 | 155 | 30 | 70 | 40 | -6.2 | |
| 32 | 5 | 160 | 28 | 72 | 38 | -6.4 | |
| 33 | 5 | 165 | 26 | 74 | 36 | -6.6 | |
| 34 | 5 | 170 | 24 | 76 | 34 | -6.8 | |
| 35 | 5 | 175 | 22 | 78 | 32 | -7 | |
| 36 | 5 | 180 | 20 | 80 | 30 | -7 | |
| 37 | 5 | 185 | 18 | 82 | 28 | -7 | |
| 38 | 5 | 190 | 16 | 84 | 26 | -7 | |
| 39 | 5 | 195 | 14 | 86 | 24 | -7 | End plateau |
| 40 | 5 | 200 | 12 | 88 | 22 | -7 | |
| 41 | 5 | 205 | 10 | 90 | 20 | -7 | |
| 42 | 5 | 210 | 8 | 92 | 18 | -7 | |
| 43 | 5 | 215 | 6 | 94 | 16 | -7 | |
| 44 | 5 | 220 | 4 | 96 | 0 | 0 | |
| 45 | 5 | 225 | 2 | 98 | 0 | 0 | |
| 46 | 5 | 230 | 0 | 100 | 0 | 10 | Annealing |
| 47 | 5 | 235 | | | 0 | 10 | |
| 48 | 5 | 240 | | | 0 | 10 | |

FIG. 27A

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -10 | Initial cool down |
| 2 | 8 | 8 | | | 97 | -2 | |
| 3 | 6 | 14 | | | 94 | -2.2 | |
| 4 | 6 | 20 | | | 91 | -2.4 | |
| 5 | 5 | 25 | | | 88 | -2.6 | |
| 6 | 5 | 30 | | | 85 | -2.8 | |
| 7 | 5 | 35 | | | 82 | -3 | |
| 8 | 5 | 40 | | | 79 | -3.2 | |
| 9 | 5 | 45 | | | 76 | -3.4 | |
| 10 | 5 | 50 | | | 73 | -3.6 | |
| 11 | 5 | 55 | | | 70 | -3.8 | |
| 12 | 5 | 60 | | | 67 | -4 | |
| 13 | 5 | 65 | | | 64 | -4 | |
| 14 | 5 | 70 | | | 61 | -4 | |
| 15 | 5 | 75 | | | 58 | -4 | |
| 16 | 5 | 80 | | | 55 | -4 | Mid plateau |
| 17 | 5 | 85 | | | 52 | -4 | |
| 18 | 5 | 90 | | | 49 | -4 | |
| 19 | 5 | 95 | | | 46 | -4 | |
| 20 | 5 | 100 | | | 43 | -4 | |
| 21 | 5 | 105 | | | 40 | -4.2 | |
| 22 | 5 | 110 | | | 37 | -4.4 | |
| 23 | 5 | 115 | | | 34 | -4.6 | |
| 24 | 5 | 120 | | | 31 | -4.8 | 0 |
| 25 | 5 | 125 | | | 28 | -5 | |
| 26 | 5 | 130 | | | 25 | -5.2 | |
| 27 | 5 | 135 | | | 22 | -5.4 | |
| 28 | 5 | 140 | | | -30 | -5.6 | |
| 29 | 5 | 145 | | | -28 | -5.8 | |
| 30 | 5 | 150 | | | -26 | -6 | |
| 31 | 5 | 155 | | | -24 | -6.2 | |
| 32 | 5 | 160 | | | -22 | -6.4 | |
| 33 | 5 | 165 | | | -20 | -6.6 | |
| 34 | 5 | 170 | | | -18 | -6.8 | |
| 35 | 5 | 175 | | flow | -16 | -7 | |
| 36 | 5 | 180 | | reversal | -14 | -7 | |
| 37 | 5 | 185 | | | -12 | -7 | |
| 38 | 5 | 190 | | | -10 | -7 | |
| 39 | 5 | 195 | | | -8 | -7 | End plateau |
| 40 | 5 | 200 | | | -6 | -7 | |
| 41 | 5 | 205 | | | -4 | -7 | |
| 42 | 5 | 210 | | | -2 | -7 | |
| 43 | 5 | 215 | | | 0 | -7 | |
| 44 | 5 | 220 | | | 0 | 0 | |
| 45 | 5 | 225 | | | 0 | 0 | |
| 46 | 5 | 230 | | | 0 | 10 | Annealing |
| 47 | 5 | 235 | | | 0 | 10 | |
| 48 | 5 | 240 | | | 0 | 10 | |

FIG. 28A

Shifts from outer to inner over time

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | 90 | 10 | 100 | -10 | Initial cool down |
| 2 | 8 | 8 | 88 | 12 | 97 | -2 | |
| 3 | 6 | 14 | 86 | 14 | 94 | -2.2 | |
| 4 | 6 | 20 | 84 | 16 | 91 | -2.4 | |
| 5 | 5 | 25 | 82 | 18 | 88 | -2.6 | |
| 6 | 5 | 30 | 80 | 20 | 85 | -2.8 | |
| 7 | 5 | 35 | 78 | 22 | 82 | -3 | |
| 8 | 5 | 40 | 76 | 24 | 79 | -3.2 | |
| 9 | 5 | 45 | 74 | 26 | 76 | -3.4 | |
| 10 | 5 | 50 | 72 | 28 | 73 | -3.6 | |
| 11 | 5 | 55 | 70 | 30 | 70 | -3.8 | |
| 12 | 5 | 60 | 68 | 32 | 67 | -4 | |
| 13 | 5 | 65 | 66 | 34 | 64 | -4 | |
| 14 | 5 | 70 | 64 | 36 | 61 | -4 | |
| 15 | 5 | 75 | 62 | 38 | 58 | -4 | |
| 16 | 5 | 80 | 60 | 40 | 55 | -4 | Mid plateau |
| 17 | 5 | 85 | 58 | 42 | 52 | -4 | |
| 18 | 5 | 90 | 56 | 44 | 49 | -4 | |
| 19 | 5 | 95 | 54 | 46 | 46 | -4 | |
| 20 | 5 | 100 | 52 | 48 | 43 | -4 | |
| 21 | 5 | 105 | 50 | 50 | 40 | -4.2 | |
| 22 | 5 | 110 | 50 | 50 | 37 | -4.4 | |
| 23 | 5 | 115 | 50 | 50 | 34 | -4.6 | |
| 24 | 5 | 120 | 50 | 50 | 31 | -4.8 | 0 |
| 25 | 5 | 125 | 50 | 50 | 28 | -5 | |
| 26 | 5 | 130 | 50 | 50 | 25 | -5.2 | |
| 27 | 5 | 135 | 0 | 100 | -33 | -5.4 | |
| 28 | 5 | 140 | 0 | 100 | -30 | -5.6 | |
| 29 | 5 | 145 | 0 | 100 | -28 | -5.8 | |
| 30 | 5 | 150 | 0 | 100 | -26 | -6 | |
| 31 | 5 | 155 | 0 | 100 | -24 | -6.2 | |
| 32 | 5 | 160 | 0 | 100 | -22 | -6.4 | |
| 33 | 5 | 165 | 0 | 100 | -20 | -6.6 | |
| 34 | 5 | 170 | 0 | 100 | -18 | -6.8 | |
| 35 | 5 | 175 | 0 | 100 | -16 | -7 | |
| 36 | 5 | 180 | 0 | 100 | -14 | -7 | |
| 37 | 5 | 185 | 0 | 100 | -12 | -7 | |
| 38 | 5 | 190 | 0 | 100 | -10 | -7 | |
| 39 | 5 | 195 | 0 | 100 | -8 | -7 | End plateau |
| 40 | 5 | 200 | 0 | 100 | -6 | -7 | |
| 41 | 5 | 205 | 0 | 100 | -4 | -7 | |
| 42 | 5 | 210 | 0 | 100 | -2 | -7 | |
| 43 | 5 | 215 | 0 | 100 | 0 | -7 | |
| 44 | 5 | 220 | 0 | 100 | 0 | 0 | |
| 45 | 5 | 225 | 0 | 100 | 0 | 0 | |
| 46 | 5 | 230 | 0 | 100 | 0 | 10 | Annealing |
| 47 | 5 | 235 | 0 | 100 | 0 | 10 | |
| 48 | 5 | 240 | 0 | 100 | 0 | 10 | |

Flow reversal

FIG. 29A

SYSTEMS AND METHODS FOR CREATING CLEAR ICE

CROSS-REFERENCE TO RELATED APPLICATIONS

This application is a 35 U.S.C. 371 National Stage Application of PCT/US2020/059014, filed Nov. 5, 2020; which claims the priority benefit of U.S. Provisional Patent Application Ser. No. 62/931,467, filed Nov. 6, 2019, the contents of each of which are herein incorporated by reference in their entireties.

TECHNICAL FIELD

This disclosure relates generally to the field of beverage accessories, and more specifically to the field of spirits accessories. Described herein are systems and methods for creating clear ice.

BACKGROUND

From the end of the prohibition error to modern day, craft cocktails are a mainstay in most restaurants and bars. To enhance the overall experience, many restaurants and bars add garnishes and/or specialty ice to the cocktails. Currently, these restaurants and bars buy large blocks of ice that are then cut down in-house to the appropriate size for each drink. Some companies in the space claim to produce clear ice using directional freezing, but the clarity of the ice and scalability of the technology are questionable. Further, issues with standard ice machines include cracking, trapped air bubbles, dendritic formations, and water impurities resulting in ice that lacks the desired appeal and appearance.

For example, ice cracks when the exterior of the ice freezes first and then the interior freezes resulting in expansion of the earlier formed exterior ice and cracking of the ice. Additionally, or alternatively, during the freezing process, when the exterior of the ice freezes first and then further cools during subsequent freezing, interior tension in the ice is created. This interior tension causes cracking of the ice when it exceeds a certain threshold (e.g., about 1 MPa). Unclear ice may result from super cooling. Water crystallizes around nucleation sites. The ice then grows from this point forming a near perfect lattice structure, given the proper environment. For example, some ice machines slightly super cool the water before freezing. This causes smaller, faster crystallization, which can lead to uneven pressure and greater cloudiness. Lastly, impurities in the water used for freezing can create unclear ice. While impurities play a role in the imperfections in ice, they often aren't the main culprit. Filtered water has on average 30 ppm impurities.

In other cases, some ice machines cause cloudy ice because the water contains dissolved air, and ice contains almost none. During the freeing process, as water turns to ice, and the remaining water reaches saturation level for dissolved gases, the dissolved gas comes out of solution. The gas bubbles stick to the ice-water interface due to surface adhesion. If these gas bubbles do not get released, they get frozen into the ice, resulting in optical imperfections which affect the straight passage of light (i.e., "cloudiness").

Taken together, improper ice freezing techniques and equipment result in less than ideal ice for the booming craft cocktail industry. Thus, there is a need for new and useful systems and methods for creating clear ice.

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying drawings.

FIGS. 21A-21B show one embodiment of a method for making clear ice.

FIGS. 22A-22B show one embodiment of a method for making clear ice.

FIGS. 23A-23B show one embodiment of a method for making clear ice.

FIGS. 24A-24B show one embodiment of a method for making clear ice.

FIGS. 25A-25B show one embodiment of a method for making clear ice.

FIGS. 26A-26B show one embodiment of a method for making clear ice.

FIGS. 27A-27B show one embodiment of a method for making clear ice.

FIGS. 28A-28B show one embodiment of a method for making clear ice.

FIGS. 29A-29B show one embodiment of a method for making clear ice.

Figure 1:
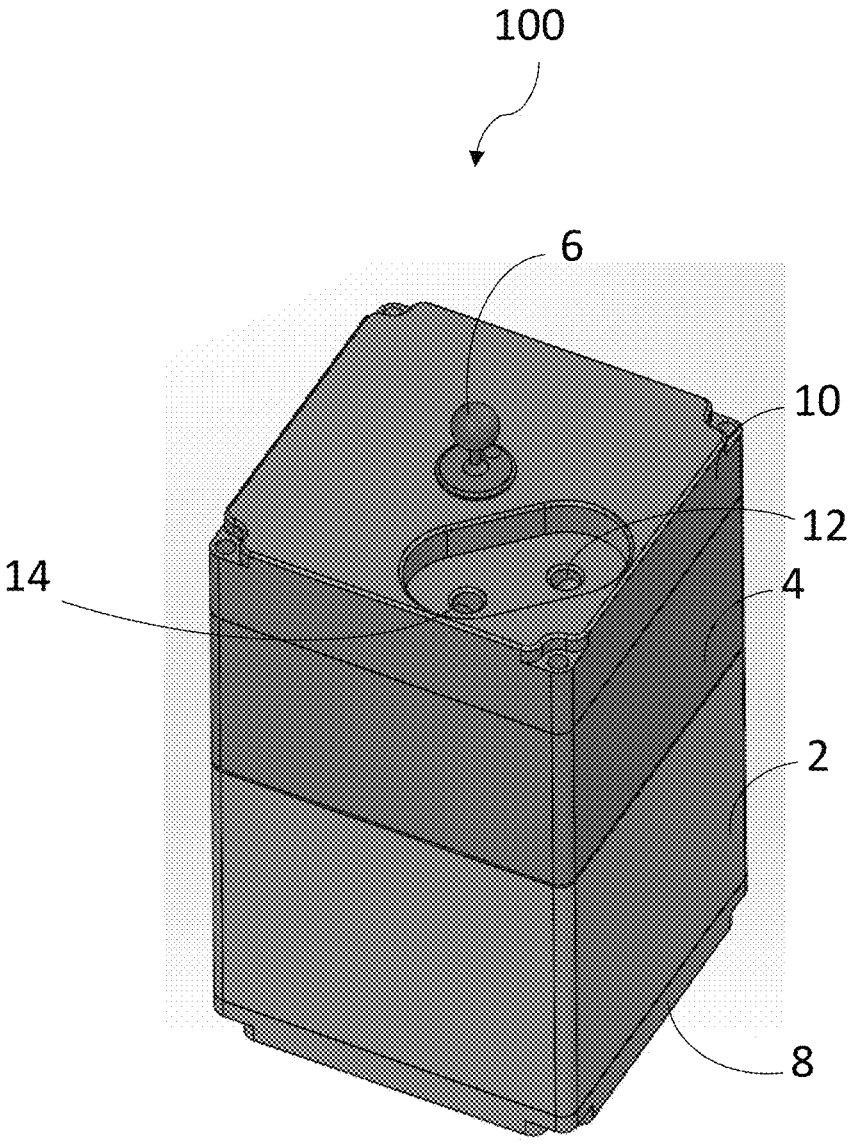
FIG. 1 shows a perspective view of one embodiment of a mold with a reservoir integrated into the mold cavity used in a system configured to create clear ice.

The illustrated embodiments are merely examples and are not intended to limit the disclosure. The schematics are drawn to illustrate features and concepts and are not necessarily drawn to scale.

DETAILED DESCRIPTION

The foregoing is a summary, and thus, necessarily limited in detail. The above-mentioned aspects, as well as other aspects, features, and advantages of the present technology will now be described in connection with various embodiments. The inclusion of the following embodiments is not intended to limit the disclosure to these embodiments, but rather to enable any person skilled in the art to make and use the contemplated invention(s). Other embodiments may be utilized, and modifications may be made without departing from the spirit or scope of the subject matter presented herein. Aspects of the disclosure, as described and illustrated herein, can be arranged, combined, modified, and designed in a variety of different formulations, all of which are explicitly contemplated and form part of this disclosure.

It is an object of the present disclosure to describe devices, systems, and methods for creating clear ice. For example, the devices, systems and methods described herein may be configured to produce clear ice in a variety of shapes that are ready for use in beverages.

In some embodiments, the ice created by the systems and devices described herein may have one or more of the following characteristics: clear, relatively free of impurities, relatively free of gas bubbles, relatively free of dissolved gasses, and/or cracking, may or may not have inclusions (e.g., flowers, liquor, food, etc.), etc. Such characteristics shall not be viewed as limiting in any way.

In some embodiments, water or liquid used to make the clear ice may be deaerated (e.g., gas sweeps, via vacuum, etc.), degassed, purified (e.g., sediment filtered, activated carbon block filtered, granular activated carbon filtered, reverse osmosis filtered, distilled, passed over an ion exchange column, treated with ultraviolet light, ultrafiltered, activated alumina filtered, ionized, etc.), or otherwise treated before being used to make clear ice. The water or liquid may be from a private well, a municipality, groundwater source, reservoir, etc.

In some embodiments, the devices and systems described herein may have one or more of the following characteristics: sized to fit in a bar (e.g., under a counter, on a countertop, in backroom, etc.) but scalable to a manufacturing or a large or industrial scale method, units of ice produced are controllable, minimal effort is required by the user, device outputs sufficient for an establishment's daily needs, etc. Such characteristics shall not be viewed as limiting in any way.

As one of skill in the art will appreciate, the methods described herein may be applicable to any size of device or system—small or large scale. For example, the methods described herein may be employed in a bar top device but also in a large scale, industrial device or system.

In any of the embodiments described herein, each mold may include a cold surface interfacing with a cold plate, which forms at least one direction in a directional freezing process. Directional freezing of ice formed in each mold may be achieved by applying a cooling effect to a bottom mold portion, a top mold portion, a first mold portion, a second mold portion, and/or to one or more sides of the mold. In some embodiments, the cooling effect is movable such that directional freezing can be initiated in any direction (e.g., top to bottom, bottom to top, side to side, etc.).

In any of the embodiments described herein, vacuum may be applied to the mold, for example to deaerate the mold or liquid in the mold. Further, in any of the embodiments described herein, agitation or circulation of the liquid in the mold may be included, for example via water flow via inlets and outlets, mechanical flow (e.g., via a propeller at the top of the mold and/or reservoir that circulates water in the mold; shaking table; ultrasonic movement from piezo electric elements), or any other method that induced water circulation or agitation. In one embodiment, applying ultrasonic energy to a mold or a portion of a mold may induce ultrasonic moving of a skewer or clip in the mold, thereby creating agitation or water circulation.

In any of the embodiments described herein, freezing may be accomplished by any device or method known in the art, for example compressors, thermoelectric devices, etc.

Described herein are reservoirless molds, for example, such that the water is circulated into and out of the main cavity for forming one or more ice structures. Further, described herein are molds including a reservoir, for example, such that the mold includes a cavity or other means in which to circulate water (e.g., to prevent dissolved gases from freezing in the water) into and out of the main cavity for forming one or more ice structures. Both reservoirless and reservoir containing molds allow liquid to circulate around the formed ice structure even once the mold has been frozen past the point where the desired shape is achieved. In some embodiments, reservoirless molds will either have flow turned off before the top most section of the mold freezes or ice formation will block inlets/outlets and stop flow in the mold.

Various molds described herein may include one liquid inflow or inlet and one liquid outflow or outlet or one or more or a plurality, such that water can be circulated into and out of the cavity in any pattern or dimension to produce a clear ice structure. In some embodiments, an outlet may be used to remove gas from a liquid in the mold, for example to form deaerated liquid.

In any of the embodiments described here, the mold may be a monolithic piece (one piece) or two or three or any number of pieces. The pieces of each mold may be easily separated and assembled via a snap-fit connection or screw connection or hinge connection or the like.

Using any of the embodiments described herein, any size and/or shaped ice structure may be formed. For example, a completely assembled mold may be about 2 cubic inches to about 16 cubic inches; about 3 cubic inches to about 12 cubic inches; about 8 cubic inches to about 12 cubic inches, about 3 cubic inches, about 2.75 cubic inches, about 2 cubic inches, about 3.5 cubic inches, about 4 cubic inches, about 8 cubic inches, about 11 cubic inches, etc. The shape inside the mold that is formed by a first mold portion and a second mold portion may vary and be any number of shapes such as cubes, spheres, rectangles, cylinders, stars, hearts, custom shapes, crescents, etc. The size of the ice shape formed within the molds will necessarily be smaller than the size of the mold. For example, a 2 inch mold may form an 8 cubic inch cube or a 2.75 mold may form a 10.9 cubic inch sphere, etc. Any mold size may be configured to create any sized ice form therein.

The systems and devices described herein allow for the automated production of clear ice into predetermined shapes. In some cases, the systems and devices may also enable the addition of inclusions into each ice shape.

Figure 2:
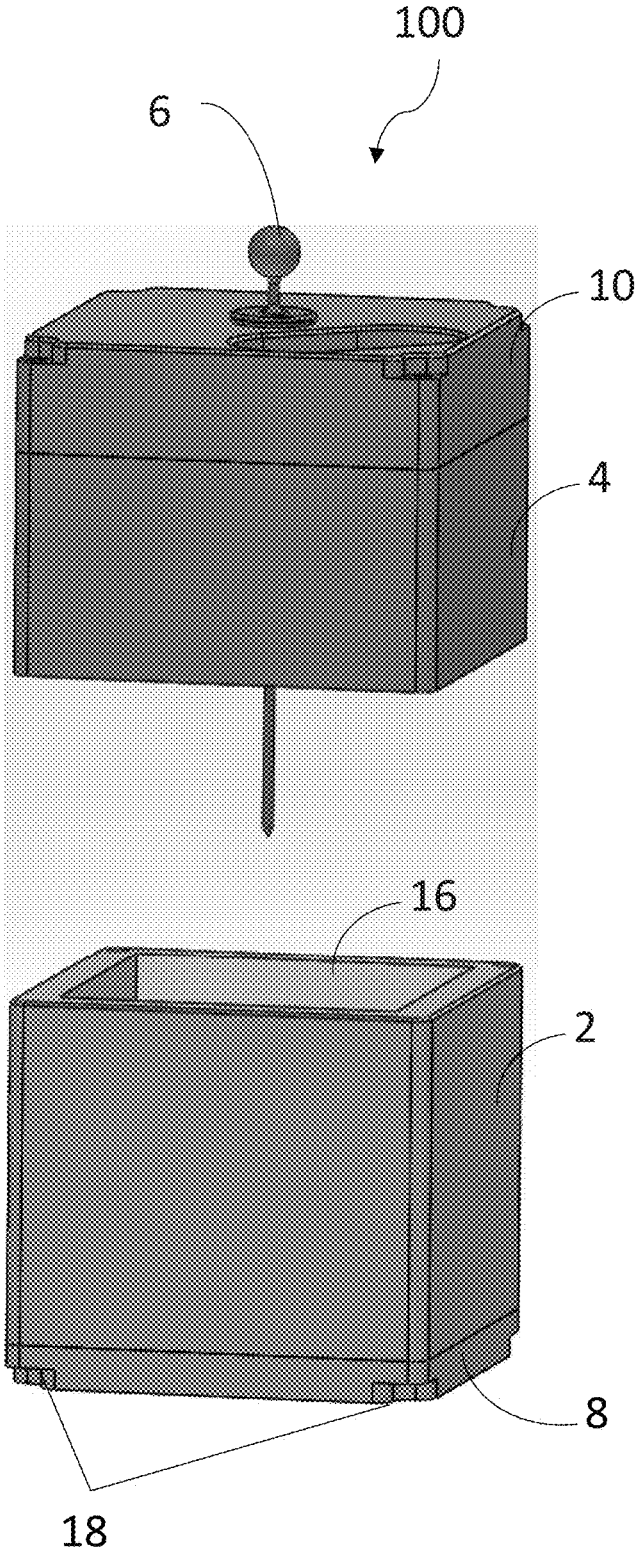
FIG. 2 shows a perspective view of the mold of FIG. 1 with a first mold portion and a second mold portion disassembled.
Figure 3:
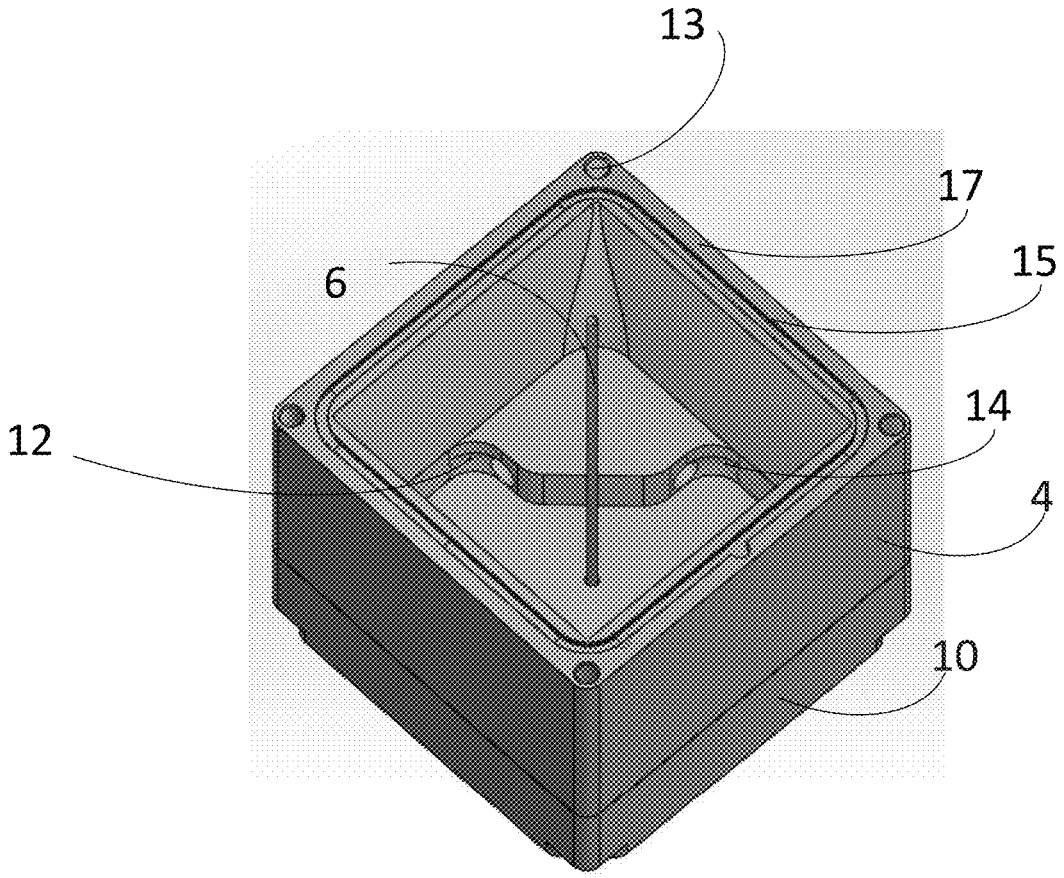
FIG. 3 shows a perspective view the first mold portion of the mold of FIG. 1.

Various embodiments of a mold with a reservoir integrated into the mold cavity will now be described with reference to FIGS. 1-8. One embodiment of a reservoirless mold 100 for forming a cuboidal ice structure is shown in FIGS. 1-3. Mold 100 includes a first mold portion 4 and a second mold portion 2. In a closed configuration, as shown in FIG. 1, first mold portion 4 and second mold portion 2 together form mold 100, such that a clear ice structure is formed therein. In an open configuration, as shown in FIG. 2, an ice structure formed within mold 100 is accessible, for example, to remove the ice structure. First and second mold portions 4, 2 are matingly secured together during ice formation via one or more mechanisms. For example, first mold portion 4 may include sealing member 15 (e.g., gasket) extending around a portion of or all of a perimeter 17 on a bottom of mold portion 4 to seal the first mold portion 4 to a second mold portion 2. Alternatively, or additionally, first mold portion 4 may define one or more apertures 13 that are configured to receive one or more pins or dowels extending from a second mold portion 2 to seal the first mold portion 4 to a second mold portion 2. Pressure may also be applied optionally to a first and/or second mold portion 4, 2 to create a liquid tight seal therebetween, for example via a plate in a system or device for freezing multiple molds, as will be described in greater detail elsewhere herein.

While the terms top mold and bottom mold or first mold portion and second mold portion are used herein, this is not intended to limit the scope of this invention but rather as a reference to some of the included figures. In some embodiments, what is called the top mold may be the bottom mold and vice versa. In other embodiments, the molds may be split between a left side and a right side or a front side and a back side. Alternatively, the molds may be split along a plane or surface that is not orthogonal. In still other embodiments, there may be a different number of mold portions such as three or four or any other suitable number.

The first mold portion 4 may further include liquid compartment 10 that is configured for liquid circulation during ice formation, as will be described in greater detail elsewhere herein. First mold portion 4 further includes liquid inlet 12 and liquid outlet 14, such that the liquid is transferred into mold 100 via liquid inlet 12 and cycled out of mold 100 via liquid outlet 14. Liquid entering the mold 100 through liquid inlet 12 circulates in mold cavity 16 defined by the first and second mold portions 2, 4. The ice structure for use is defined by first and second mold portions 4, 2, while liquid compartment 10 defines an internal water circulation cavity, similar to a reservoir. During post-processing, the ice formed in liquid compartment 10 is removed by shaving, melting, or cleaving the ice so that a spherical, cuboidal, or otherwise shaped ice structure is the end result. Second or bottom portion 2 of mold 100 further includes one or more cutouts 18 or features that enable mold 100 to be matingly coupled, slidingly received, or snapped into a system where multiple molds fit therein, as will be shown and described in connection with FIGS. 7-8.

The first mold portion may be comprised of any number of materials. For example, the first mold may be comprised of plastics such as acetal, polycarbonate, or any other suitable plastic. In some embodiments, the first mold is a composite of multiple materials. The second mold may likewise be comprised of any number of materials. In some embodiments, the second mold comprises or is formed of a material that conducts heat well such as an aluminum while the top mold comprises or is formed of a material that conducts heat less well such as a plastic. In such a configuration (i.e., differing materials forming the top and bottom mold portions), the directional freezing that occurs from the cooling plate connected to the second mold portion may be limited past the point where the first and second mold portions connect.

Figure 4:
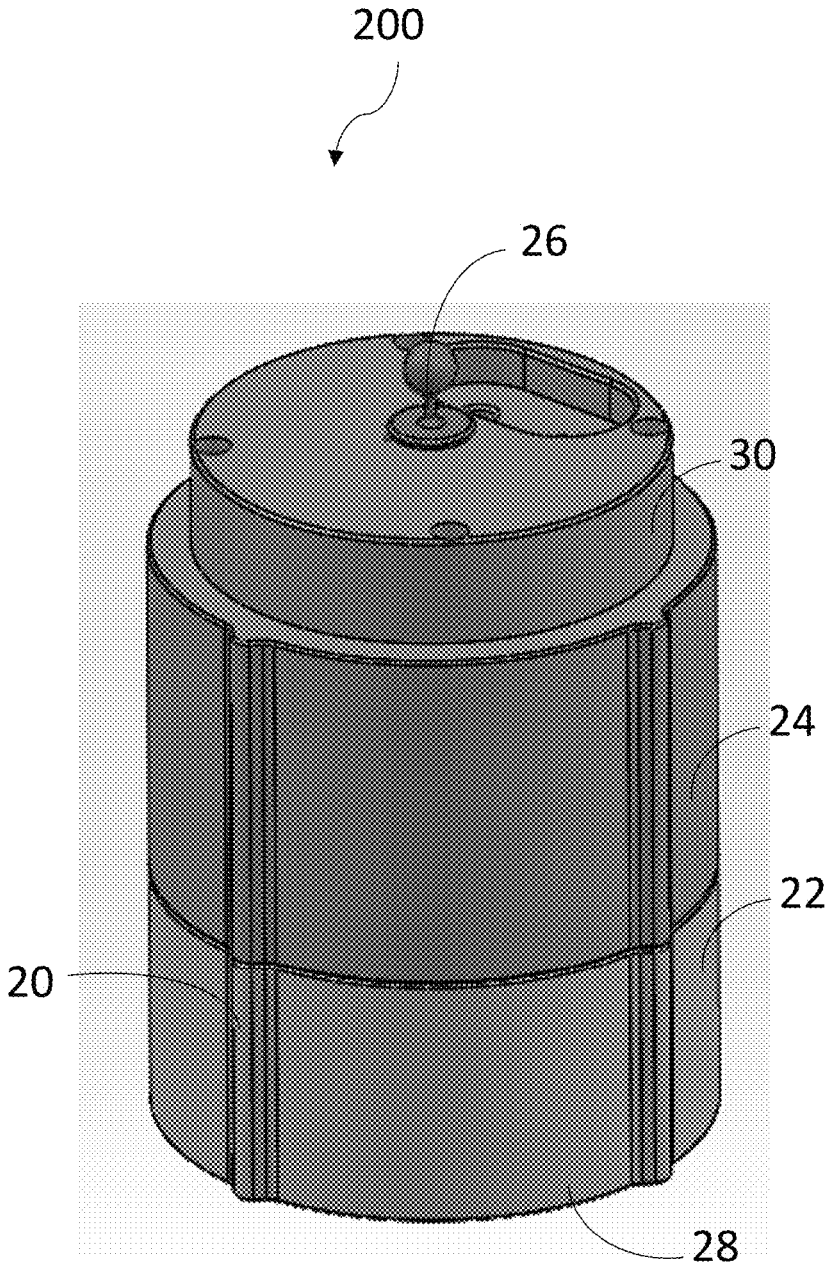
FIG. 4 shows a perspective view of another embodiment of a mold with a reservoir integrated into the mold cavity used in a system configured to create clear ice.
Figure 5:
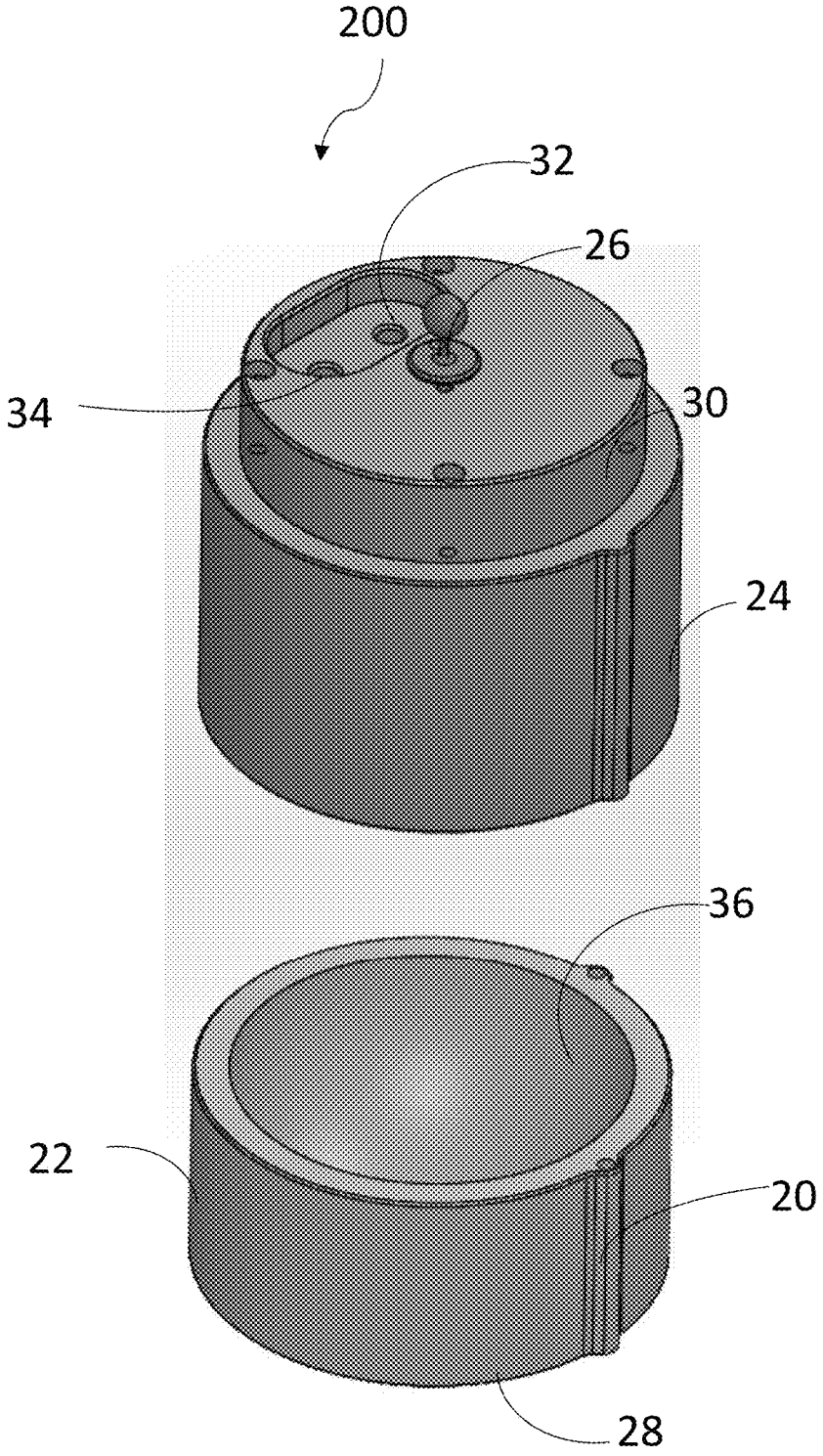
FIG. 5 shows a perspective view of the mold of FIG. 4 with a first mold portion and a second mold portion disassembled.
Figure 6:
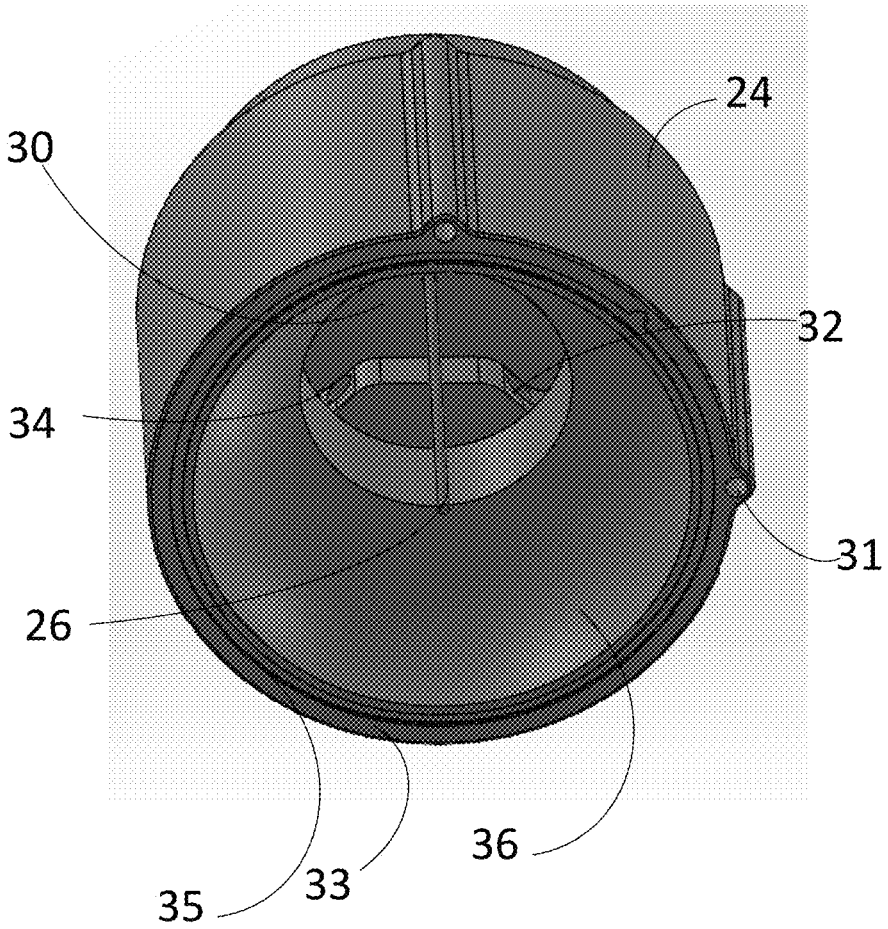
FIG. 6 shows a perspective view the first mold portion of the mold of FIG. 4.

Turning now to FIGS. 4-6, which show one embodiment of a reservoirless mold 200 for forming a spherical ice structure. Mold 200 includes a first or top mold portion 24 and a second or bottom mold portion 22. In a closed configuration, as shown in FIG. 4, first mold portion 24 and second mold portion 22 together form mold 200, such that a clear ice structure is formed therein. In an open configuration, as shown in FIG. 5, an ice structure formed within mold 200 is accessible, for example, to remove or eject the ice structure. First and second mold portions 24, 22 are matingly secured together during ice formation via one or more mechanisms. For example, first mold portion 24 may include sealing member 35 (e.g., gasket) extending around a portion of or all of a perimeter 33 on a bottom of mold portion 24 to seal the first mold portion 24 to a second mold portion 22. Alternatively, or additionally, first mold portion 24 may define one or more apertures 31 that are configured to receive one or more pins or dowels extending from a second or bottom mold portion 22 to seal the first mold portion 24 to a second mold portion 22. Pressure may also be applied optionally to a first and/or second mold portion 24, 22 to create a liquid tight seal therebetween, for example via a plate in a system or device for freezing multiple molds, as will be described in greater detail elsewhere herein.

Figure 7:
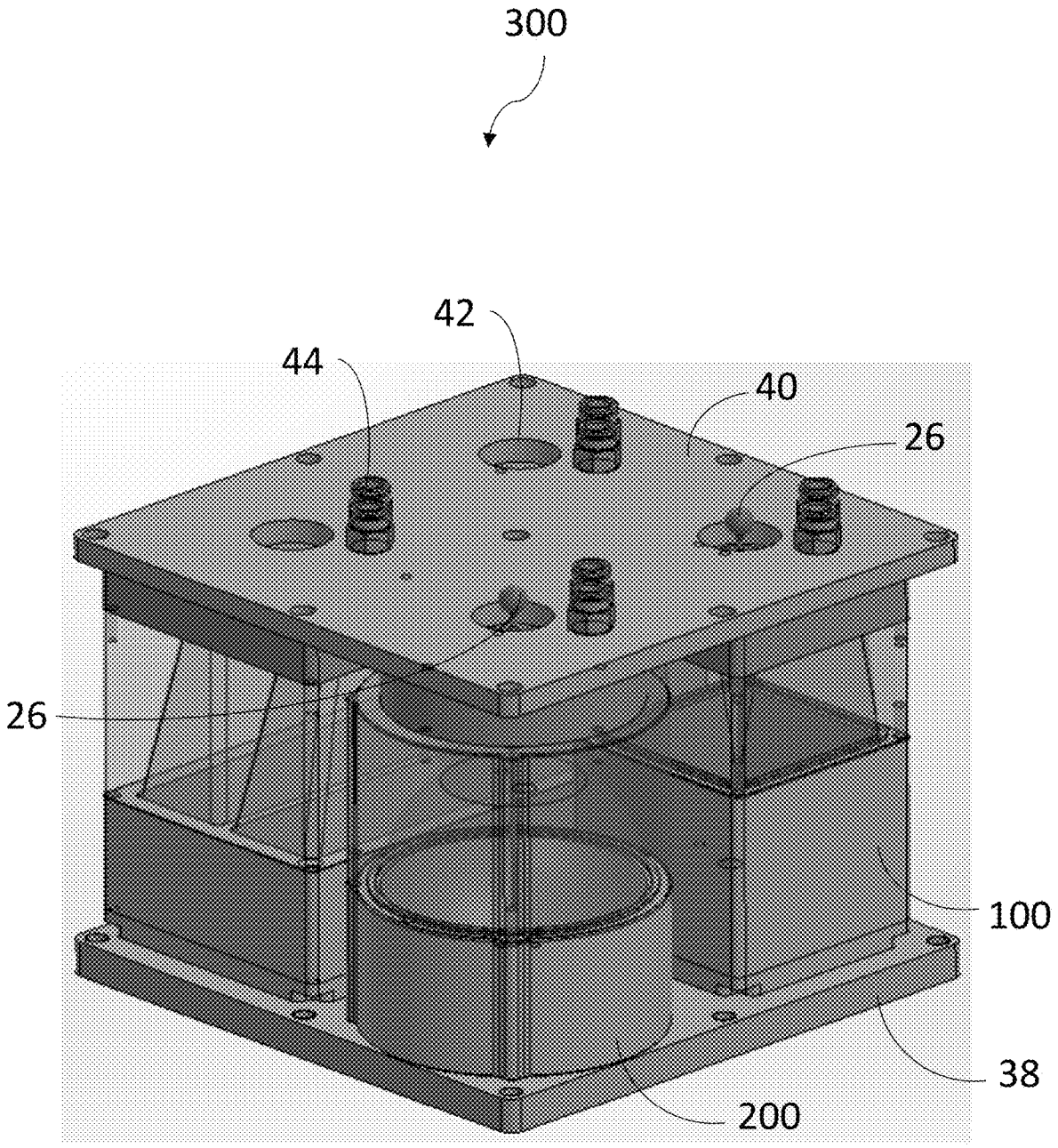
FIG. 7 shows a perspective view of various molds within a system configured to create clear ice, each mold having a transparent first portion for description purposes only of showing a shape of the formed ice therein.
Figure 8:
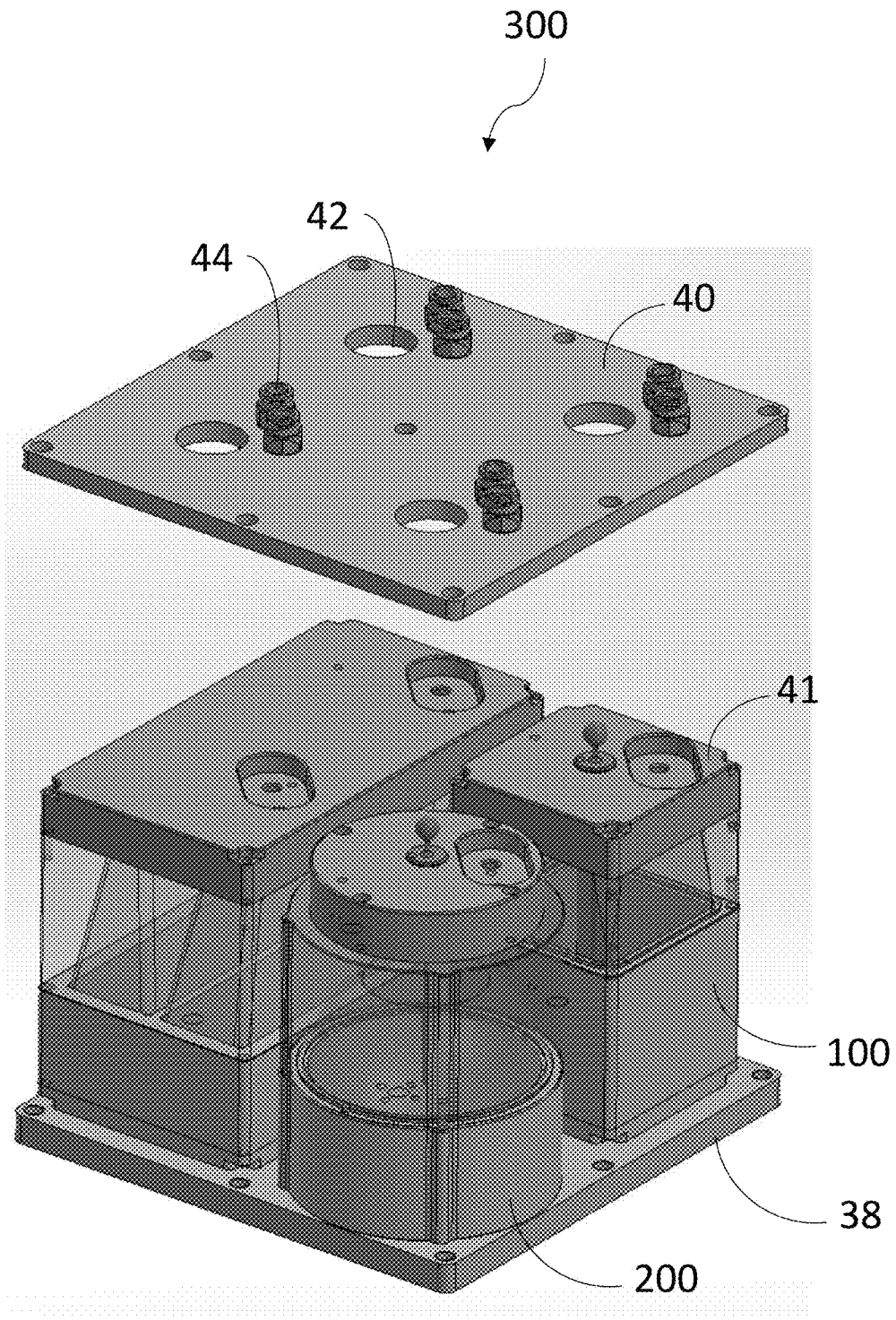
FIG. 8 shows a perspective view of the system of FIG. 7 partially disassembled.

The first mold portion 24 may further include liquid compartment 30 that is configured for liquid circulation during ice formation, as will be described in greater detail elsewhere herein. First mold portion 24 further includes liquid inlet 34 and liquid outlet 43, such that the liquid is transferred into mold 200 via liquid inlet 34 and cycled out of mold 200 via liquid outlet 32. Liquid entering the mold 200 through liquid inlet 34 circulates in mold cavity 36 defined by the first and second mold portions 24, 22. The ice structure for use is defined by first and second mold portions 24, 22, while liquid compartment 30 defines an internal water circulation cavity, similar to a reservoir. During post-processing, the ice formed in liquid compartment 30 is removed by shaving, melting, or cleaving the ice so that a spherical, cuboidal, pressing, or otherwise shaped ice structure is the end result. First and second mold portions 24, 22 of mold 200 further include one or more ribs 20, as shown in FIG. 5, or features that enable mold 200 to be matingly coupled, slidingly received, or snapped into a system where multiple molds fit therein (FIGS. 7-8). Alternatively, or additionally, each rib 20 houses a fixed or moveable pin therein for securing the first mold portion 24 to the second mold portion 22. In a moveable state, the pin may be advanced and retracted to secure the first mold portion 24 to the second mold portion 22.

Figure 30:
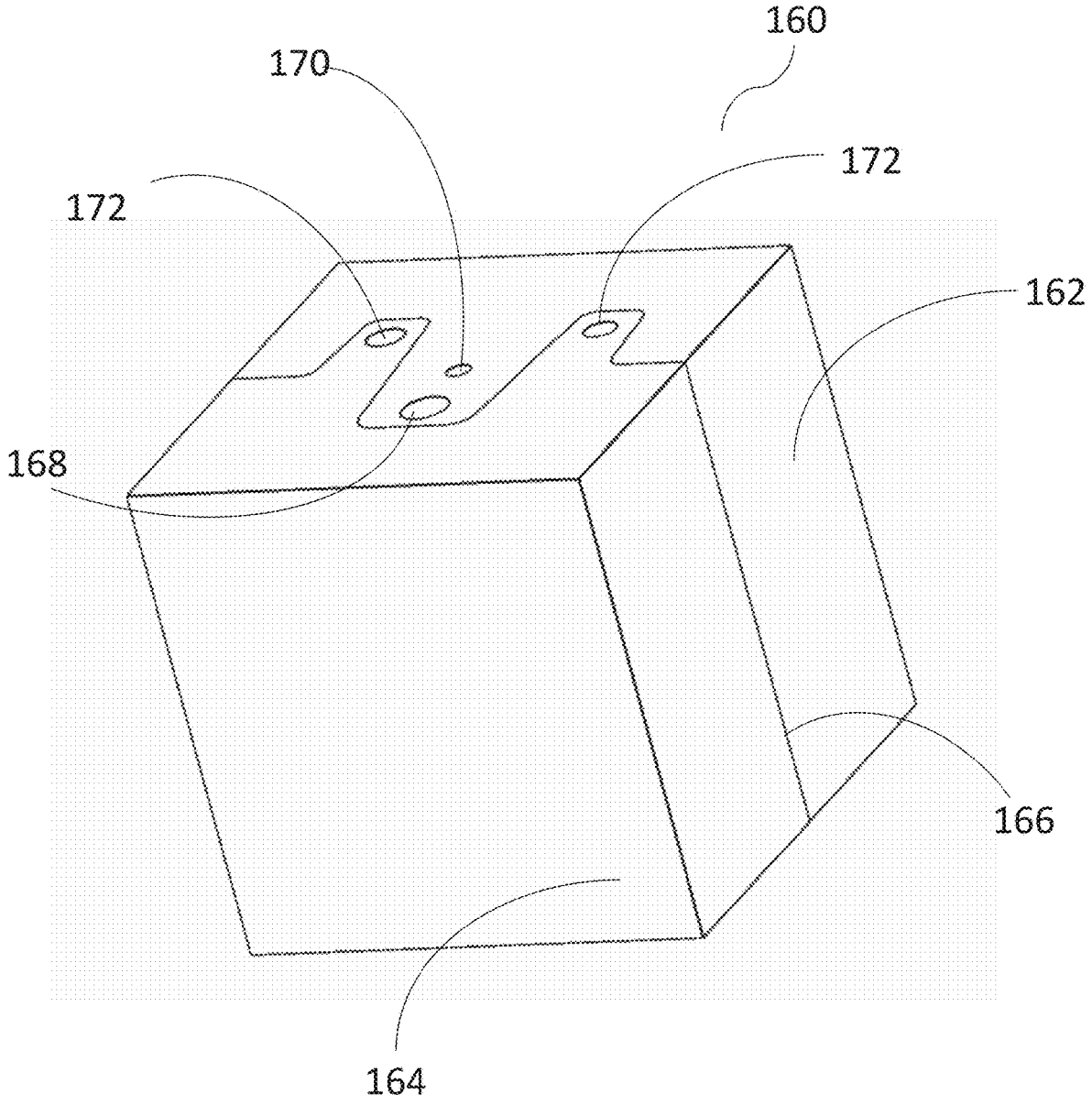
FIG. 30 shows a perspective view of one embodiment of a mold having a first mold portion and a second mold portion.

Turning now to FIG. 30, which shows a vertically splitting mold (as opposed to the horizontally splitting molds described above). Mold 160 includes a first mold portion 162 and a second mold portion 164 that seal together along vertical line or vertical engagement plane 166 during an ice making process. Further, mold 160 defines one or more apertures for liquid inlets, liquid outlets 168, and/or retractable skewers or clips. For example, first mold portion 162 defines liquid outlet 168 and aperture 170 for receiving a retractable skewer or clip therethrough (either manually or automatically retractable). The second mold portion 164 defines one or more liquid inlets 172. The first and second mold portions may be keyed to one another, as shown in FIG. 30 such that when sealed together, they form a liquid tight seal for making clear ice therein. Further, as one of skill in the art will appreciate, the second mold portion 164 or the first mold portion 162 may include all the inlets, outlets, and apertures for the skewer or clip. Further, although the inlets 172 are formed in the second mold portion 164, one will appreciate that these inlets may alternatively reside in the first mold portion 162. Further, although outlet 168 and skewer or clip aperture 170 is in the first mold portion 162 as depicted, one of skill in the art will appreciate that they be formed alternatively in the second mold portion 164.

Figure 9:
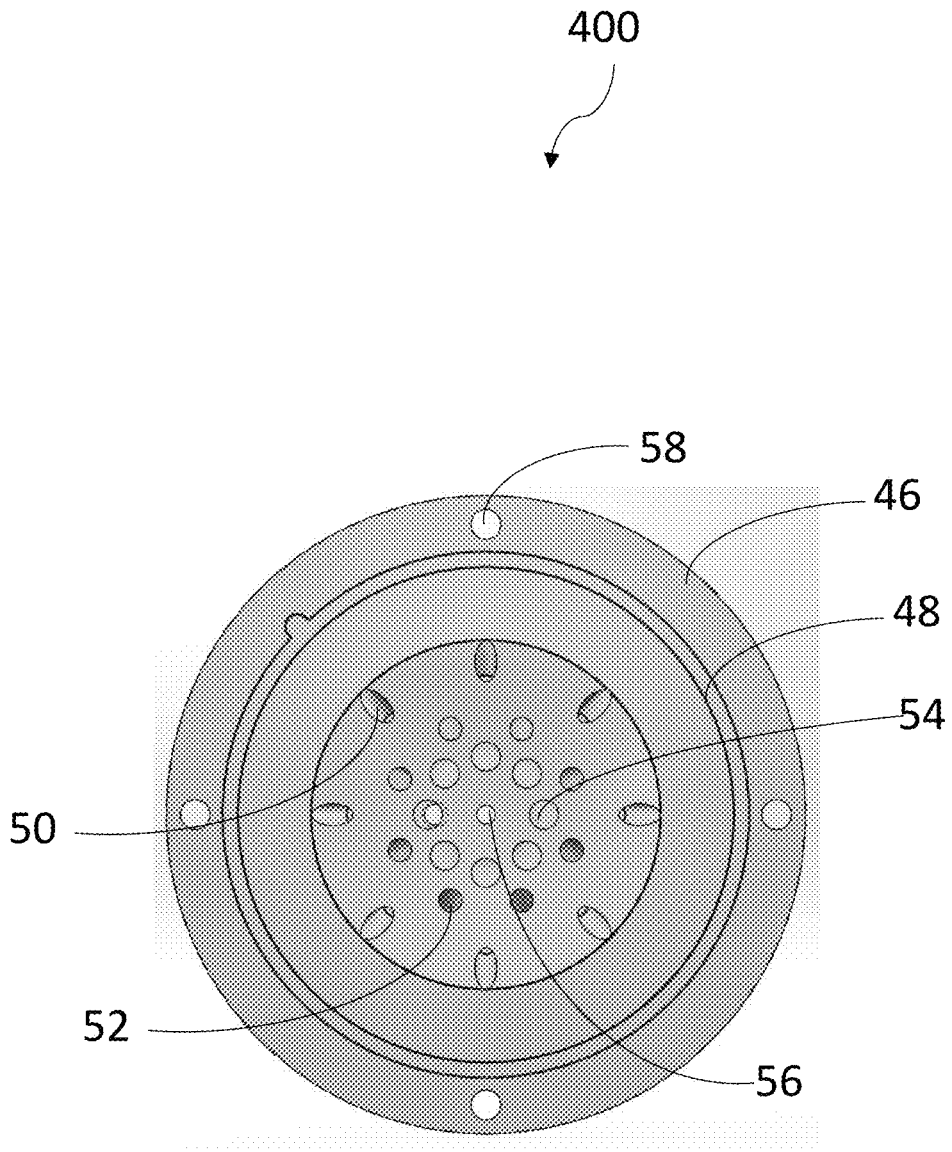
FIG. 9 shows a bottom view of a first mold portion of a mold having concentric rings for inlet and/or outlet liquid flow.

Any of the mold portions described herein may include various arrangements of liquid inlets and outlets. For example, as shown in FIG. 9, a mold portion 400 may include optionally concentrically arranged liquid inlets 50, 52 and/or liquid outlets 54. Liquid inlets may include an outer ring 50 and/or 52 an inner ring. These various arrangements may allow inlets and outlets to be turned on and off in various patterns to promote clear ice formation. For example, liquid inflows 50 may be turned on first and then liquid inflows 52, starting from outside to inside of the mold, although inside to outside turning on of inflows may also be employed. Alternatively, or additionally, the liquid inflows 50, 52 are turned on and/or off depending on the stage of freezing and/or a location of the boundary layer of ice formation. In some embodiments, liquid inflows are turned on in a sweeping pattern during early ice formation and then into a more targeted pattern, for example directed to the boundary layer, during later ice formation. Although various patterns are described herein, one of skill in the art will appreciate that any combination of activation of inflows and outflows is envisioned that will promote clear ice formation. Each inlet and/or outlet may further include an independent flow rate, such that the flow rate of each inlet and/or outlet may be controlled and/or configured for optimal ice formation.

Further as shown FIG. 9 and as described with respect to FIGS. 3 and 6, mold portion 400 may include a sealing feature (e.g., gasket) along a perimeter 46 of a bottom of the mold portion and/or one or more apertures 58 configured to receive a dowel or pin from the other mold portion to seal the first mold portion to a second mold portion. Mold portion 400 may further define an aperture 56 configured to receive a skewer therethrough.

Optionally, first mold portion 24 and/or second mold portion 22 further defines an aperture for receiving a skewer 26 therein for suspending an article (e.g., food, prize, liquid, etc.) in an ice structure formed in mold 200. A distal end portion of skewer 26 is shown in FIG. 6. The skewer 26 holds an inclusion (e.g., fruit, leaf, etc.) at a desired location in the mold 200 while the liquid is freezing. When the ice freezes past the inclusion, the skewer 26 is removed (e.g., automatically or manually retracted) and the rest of the ice freezes around the inclusion. For example, the skewer 26 may sense a progression of freezing based on a sensor or probe on the skewer 26. Alternatively, in methods where the freezing process occurs during a relatively fixed length of time, the skewer 26 is retracted at a pre-determined time or after a fixed length of time has elapsed. The distal tip of the skewer may be sharpened or barbed to enhance retention of objects.

In some embodiments, the skewer may include inlets or outlets for fluids or gases. For example, the skewer may be used as an inlet port in the manner described above that circulates water into the mold. In this embodiment, the water may circulate out of the skewer through a single hole at its distal end or through any number of holes along its length. The holes may be sized and positioned such that they provide optimal flow for the agitation of the water during the freezing process. The skewer may be retracted during the freezing process such that the inlet hole or holes remain above the frozen ice. Alternatively, the holes may be occluded as the ice freezes, resulting in blockade of the holes while other holes above the ice remain patent. This may act to selectively change the flow profile as the ice is formed. In other embodiments, the skewer may form the outlet rather than the inlet. In some embodiments, the skewer may have multiple lumens and have both inlets and outlets along its length. In still other embodiments, the skewer may be used to inject gases such as air into the water. The injected gases may act as an agitator during the ice formation process. Alternatively, the gases may be used to form decorative bubbles within the ice. In still other embodiments, other fluid infusions may be injected into the ice through the skewer such as alcohol, mixers, CBD liquid, or any other number of fluids that may enhance the ice novelty.

Figure 10A:
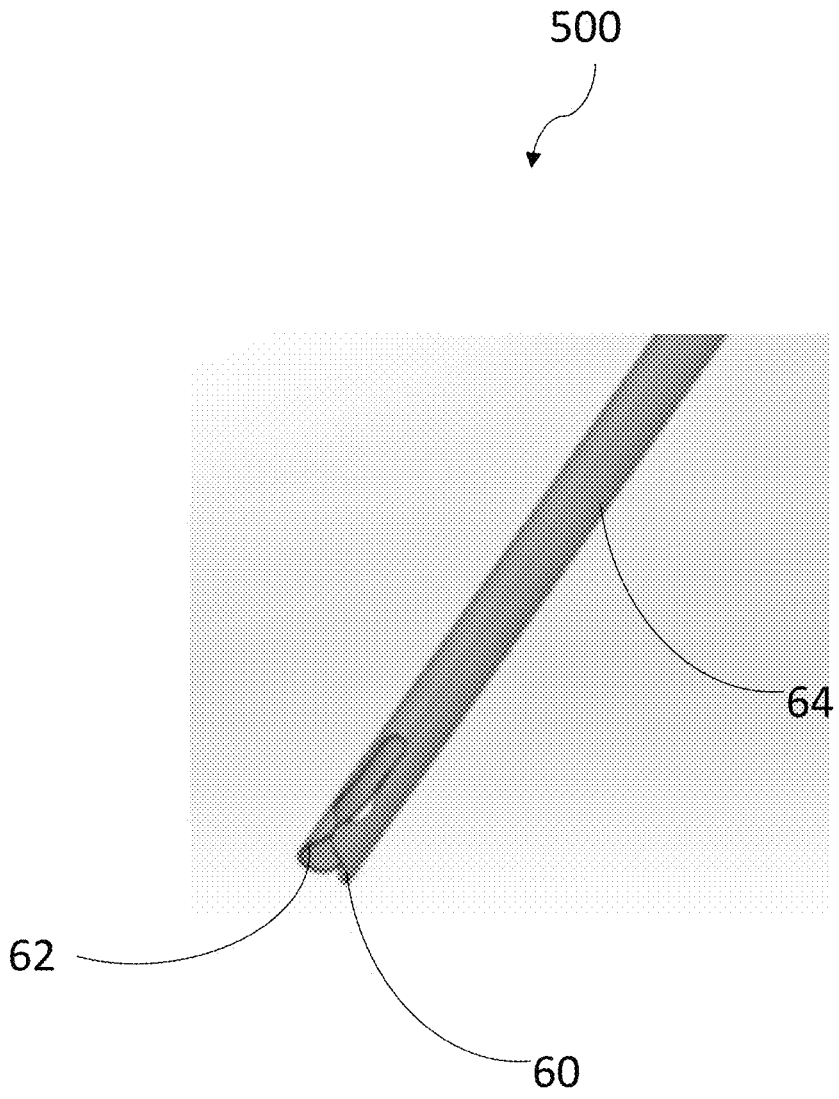
FIG. 10A shows a perspective view of a skewer for positioning an article within a frozen body formed by one or more molds described herein.
Figure 10B:
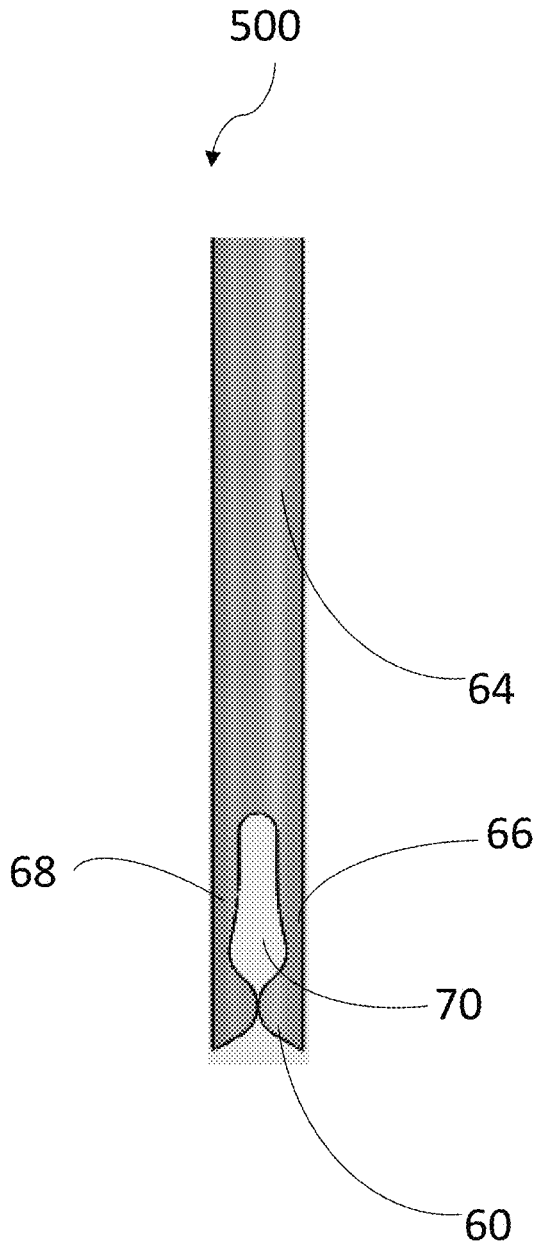
FIG. 10B shows a side view of a skewer for positioning an article within a frozen body formed by one or more molds described herein.
Figure 10C:
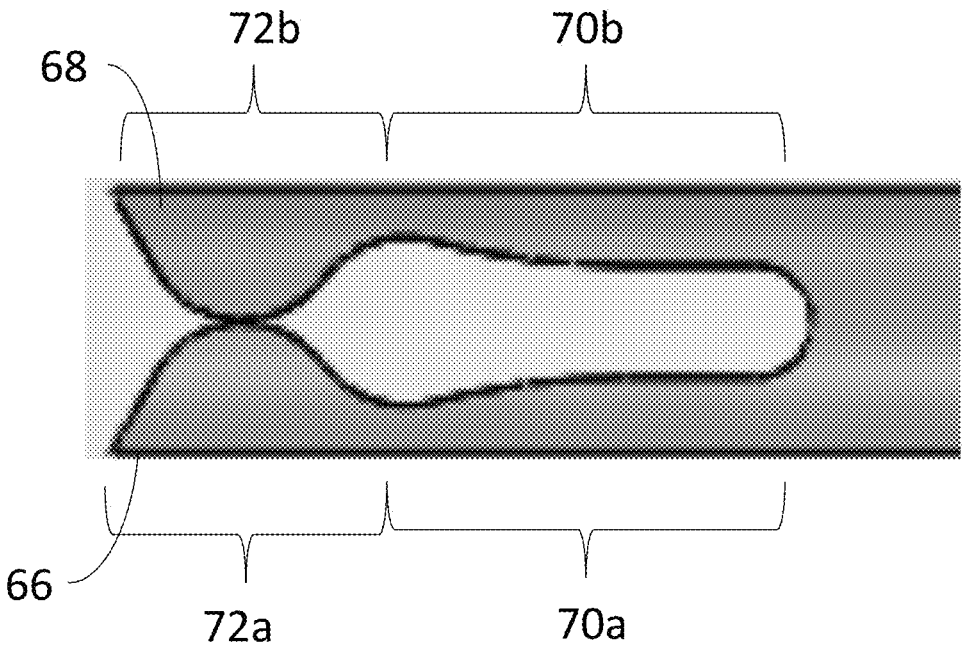
FIG. 10C shows a zoomed in view of a distal end of a skewer for positioning an article within a frozen body formed by one or more molds described herein.

One embodiment of a skewer 500 is shown in FIGS. 10A-10C. Each skewer 500 may include an elongate body 64 comprising or coupled to a distal tip 60 configured to pierce an article or clasp an article. In one embodiment, the distal end of skewer 500 includes a first leg 66 and a second leg 68 that are transitionable between an open or unclasped configuration and a closed or clasped configuration. Legs 66, 68 are biased towards the closed or clasped configuration such that pressure or force is applied to the article clasped therein. As shown in FIG. 10B, legs 66, 68 define slot 70 in which an article is clasped therein and between legs 66, 68 in the closed, clasped configuration. Further, each leg 66, 68 includes a first region 70*a*, 70*b* and a second region 72*a*, 72*b*. The first regions 70*a*, 70*b* slightly decrease in thickness from a proximal end to a distal end and encounter or couple to second regions 72*a*, 72*b* which each include a bevel or convex groove. Region 72*a* contacts region 72*b* when the skewer 500 is in a closed, clasped configuration, although an article may be therebetween in some embodiments. Once at least a portion or part of the article is frozen in the ice structure in the mold, retraction of the skewer 500 causes leg 66 to move apart from leg 68, which releases the article and allows the skewer 500 to be fully removed. Alternatively, in some embodiments, legs 66, 68 each have a fixed width. Alternatively, in some embodiments, legs 66, 68 include a hinge mechanism that is biased towards the closed or clasped configuration. In such embodiments, one or both legs 66, 68 include a hinge that, when manipulated, allows an article to be secured therein.

Figure 19:
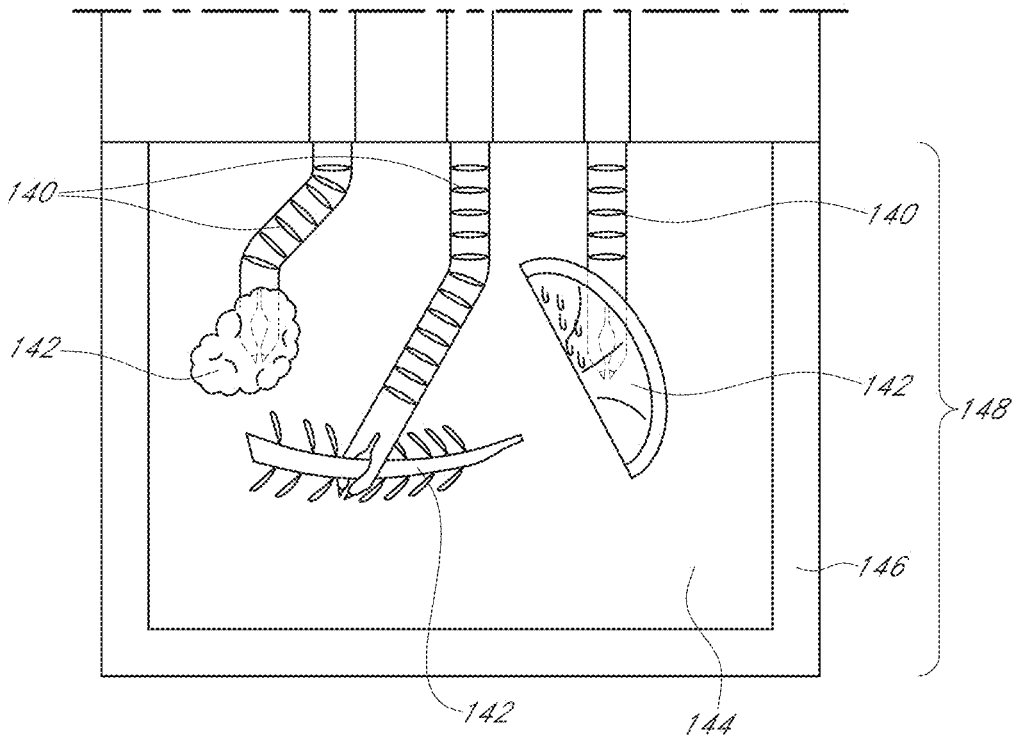
FIG. 19 shows ice formation and inclusion placement in a mold during one embodiment of an ice formation cycle.
Figure 20:
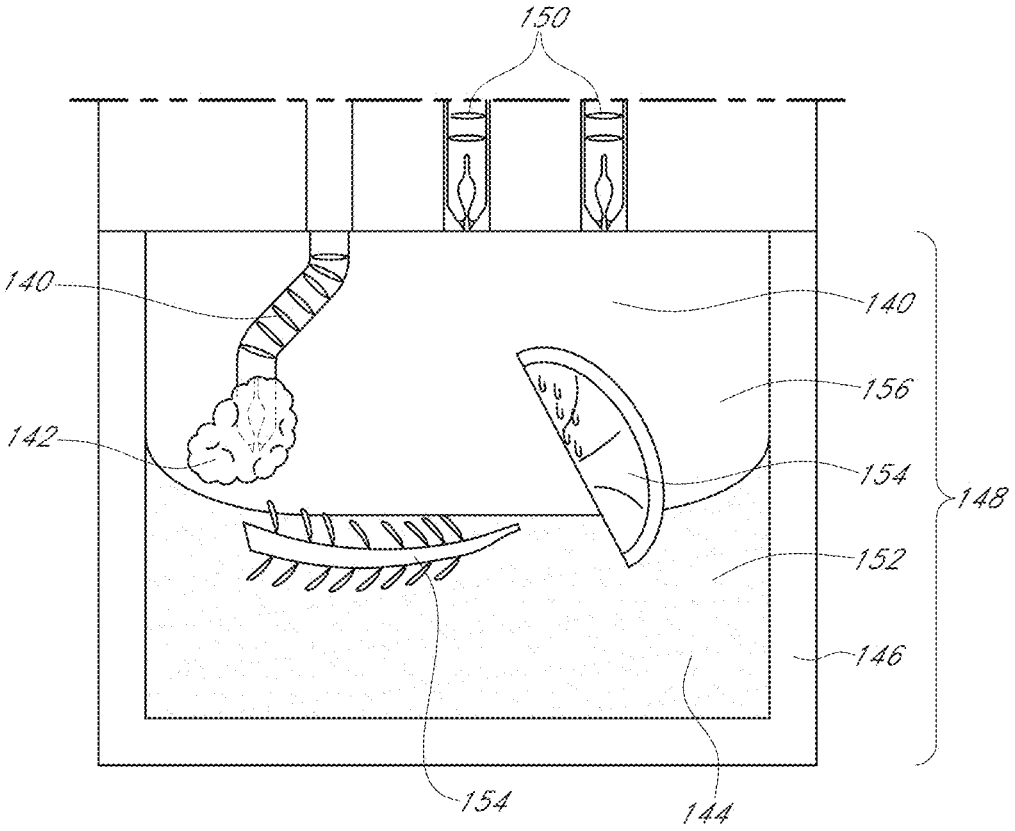
FIG. 20 shows ice formation and inclusion placement in a mold during another embodiment of an ice formation cycle.

Turning now to FIGS. 19-20, which show various embodiments of skewer placement and/or a retraction process. In some embodiments, one or more implements or skewers may be used to secure inclusions within the mold cavity during an ice formation cycle. Further, height and/or positioning can be adjusted for each skewer or a subset of skewers, such that each skewer comprises a flexible shaft. In some embodiments, a timing of retraction can be controlled individually to accommodate the different placements and/or freeze times of the molds and/or synchronized such that all skewers are removed at the same time. In some embodiments, one or more mold portions include a skewer drive housing (e.g., motor, processor, etc.) within a sidewall of the mold portion to control skewer movement, heating, positioning, etc. Further, one or more of the skewers may include a heating element therein such that the skewer can be heated for ease of retraction in the case of ice formation around skewer. As shown in FIG. 19, three flexible skewers or clips 140 with inclusions 142 secured thereto are positioned within the mold cavity 144 defined by sidewalls 146 of mold 148. As shown in FIG. 20, two of the three skewers or clips of FIG. 19 have been retracted (retracted skewers 150, unretracted skewer 140) leaving the articles 154 frozen in the ice 152, while the third skewer 140 is currently above the boundary of the ice 152 in liquid 156, so it will not be retracted until the ice 152 forms past or partially past the article 142 secured thereto. Alternatively, or additionally, in some embodiments, more than one skewer or a plurality of skewers may be aggregated (manually or automatically) to maintain an inclusion in a desired position.

Turning now to FIGS. 7-8 and FIGS. 31-37, which show systems for creating clear ice. For example, as shown in FIGS. 7-8, system 300 for creating clear ice has a closed configuration and an open configuration, respectively. System 300 includes one or more or a plurality of molds 100, 200, arranged therein. As described elsewhere herein, the molds 100, 200 may be coupled to, attached to, matingly received, or otherwise snapped into system 300 for ice creation. For example, each mold 100, 200 may include a dowel or pin along its length (e.g., see ribs 20 of FIG. 5), such that the system 300 includes a slotted tube extending perpendicularly from base or cooling apparatus 38 that is configured to receive the dowel or pin to secure the mold 100, 200, into the system. Alternatively, each mold 100, 200 may include a slotted tube such that the system 300 includes one or more dowels or pins extending perpendicularly from base or cooling apparatus 38 to be received within the slotted tube of each mold to secure the mold to the base plate or cooling apparatus 38. Of course, as one of skill in the art will appreciate, any mechanical connection or coupling mechanism may be used to secure each mold to the base plate or cooling apparatus 38. System 300 further includes lid 40. Lid 40 includes one liquid compartment or manifold for all molds positioned therein or a separate manifold or liquid compartment 41 for each mold. Lid 40 further defines one or more apertures 40 configured to receive a skewer or clip 26 therein for inclusion insertion in each mold. As described elsewhere herein, the skewers or clips 26 may be manually or automatically retracted. Lid 40 includes one or more ports 44 (e.g., valves, inlets, outlets) that are configured to move liquid into and out of each mold. Lid 40 may be removably coupled to the manifolds or liquid compartments 41 of each mold 100, 200. Alternatively, lid 40 may have integrated liquid compartments or manifolds or be irreversibly coupled to the liquid compartments or manifolds such that removing lid 40 from the system 300 allows access to the formed ice in each mold.

FIGS. 31-38 disclose another system 600 for making clear ice. A system 600 for creating clear ice includes an ice forming module 250, an inclusion module 204, an ejector module 232, and a movement module 230, each of which will be described in turn below. As one of skill will appreciate, the embodiment shown and described in FIGS. 31-38 may function in the absence of an inclusion module 204, an ejector module 232 (e.g., ice may be removed manually or by gravity), and/or a movement module 230. The system as shown in FIGS. 31-38 may be structured and configured that it fits on a countertop, for example in a bar or home. Alternatively, it may be structured or configured for large scale manufacturing or industrial scale ice production.

Figure 31:
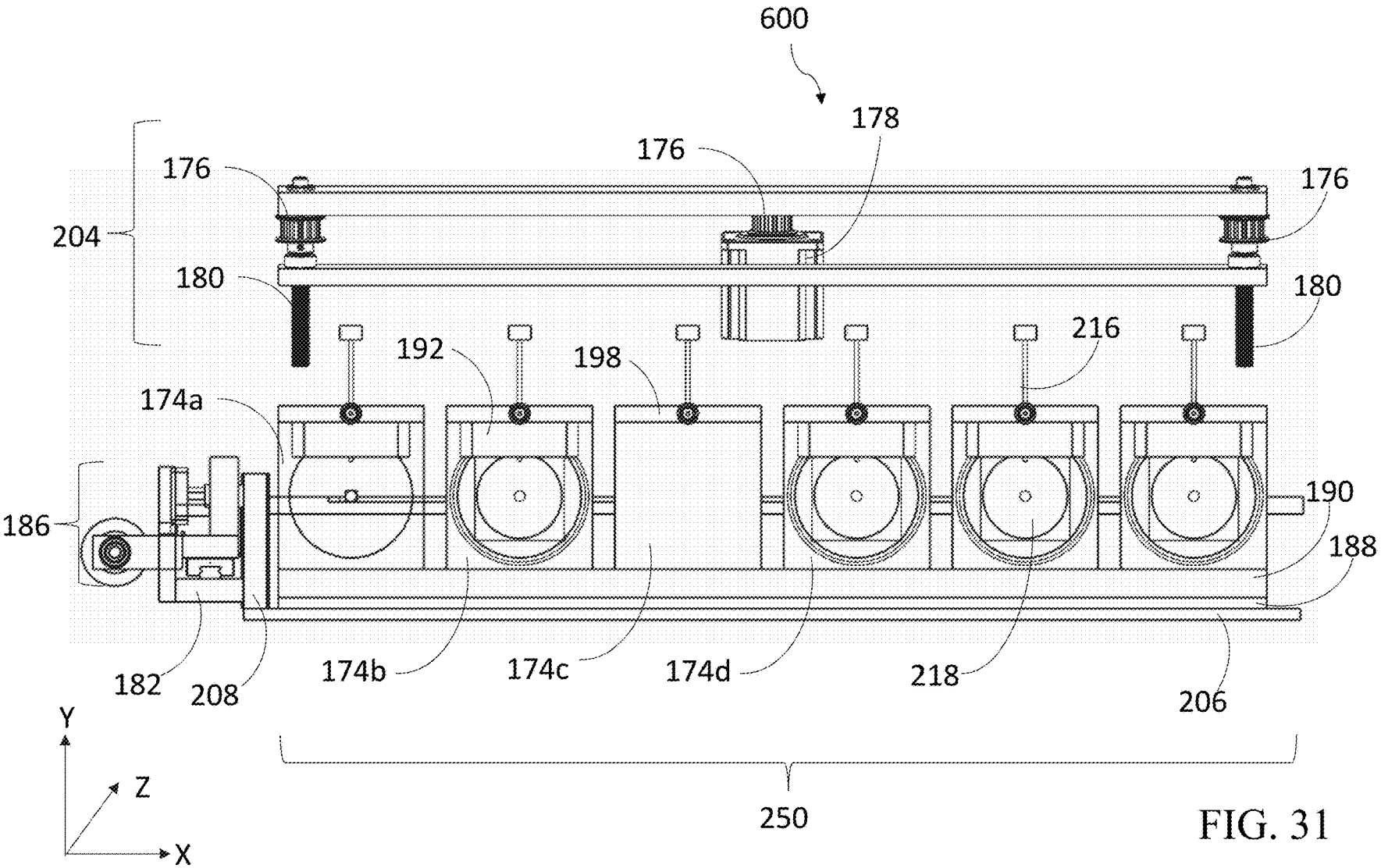
FIG. 31 shows a front view of device for making clear ice.
Figure 32:
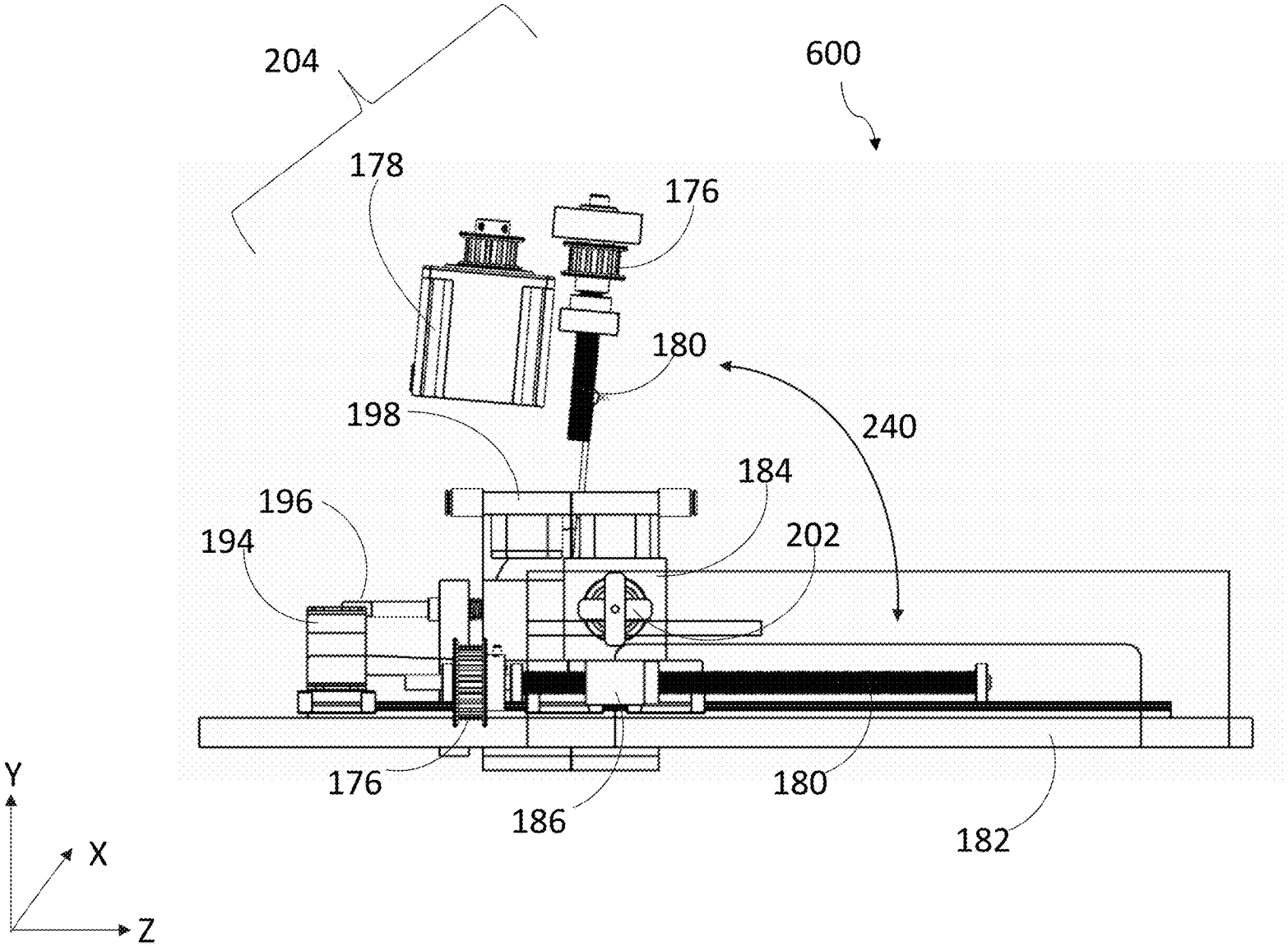
FIG. 32 shows a side view of the device of FIG. 31.
Figure 33:
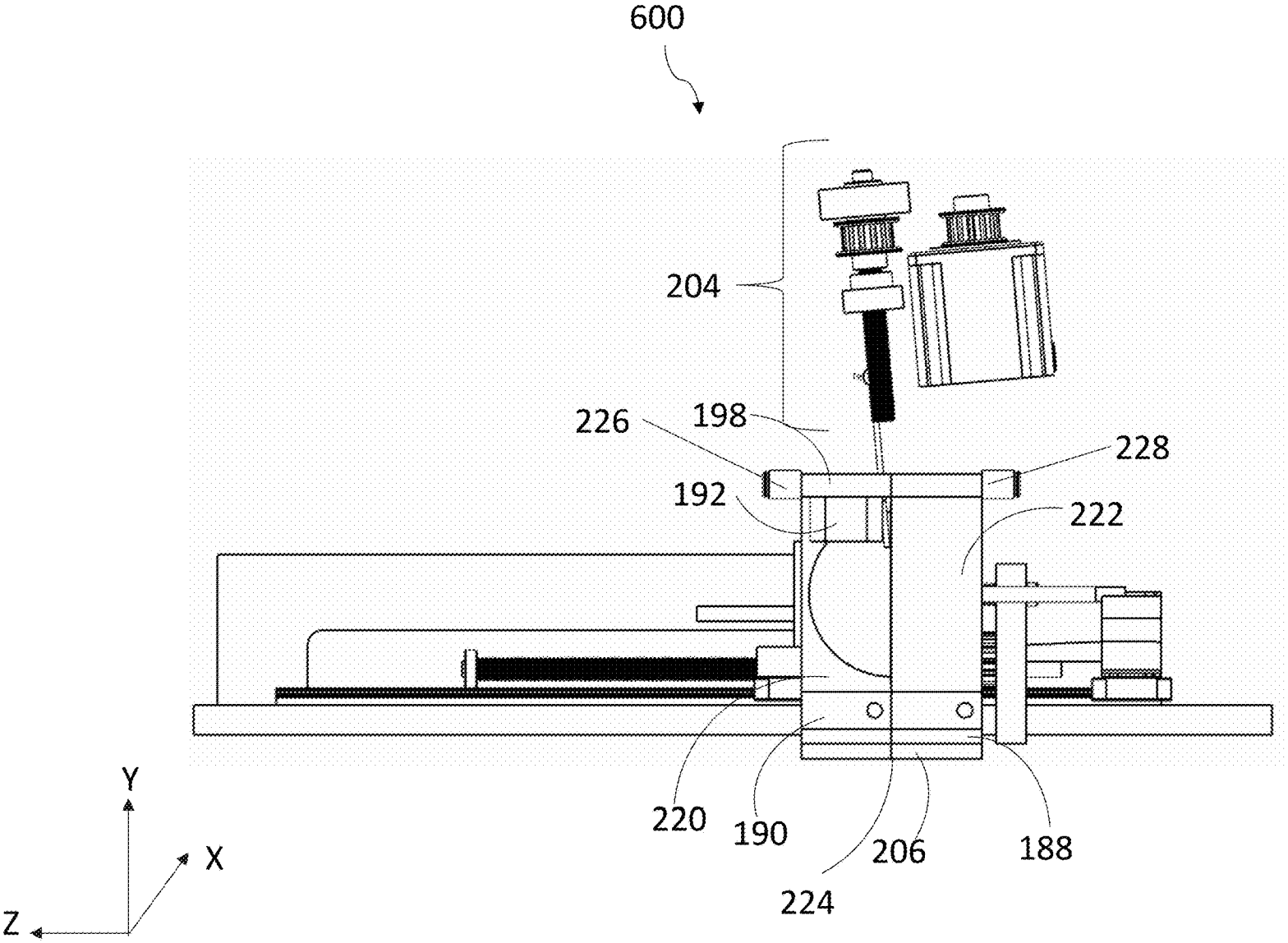
FIG. 33 shows an opposite side view of that shown in FIG. 32.

As shown in FIGS. 31-38, an ice forming module 250 includes one or more molds 174 (e.g., 174*a*, 174*b*, 174*c*, 174*d* . . . 174*n*) coupled to a cooling apparatus 190. For example, either or both molds may be coupled to a cooling apparatus 190. Each mold 174 may comprise one monolithic piece; alternatively, each mold may include a first mold portion 220 and a second mold portion 222 or any number of mold portions, as shown and/or described elsewhere herein. Mold 174 may define a mold cavity 218. In some embodiments, a second mold portion 222 is reversibly couplable to the first mold portion 220 along a vertical axis or an engagement plane 224 that is substantially perpendicular (e.g., about 75 degrees to about 105 degrees) to the cooling apparatus 190, as shown in FIG. 33. Although molds for making spherical ice shapes are represented, one of skill in the art will appreciate that molds for making any ice shape (e.g., cube, rectangle, etc.) may be included. Further, system 600 may include a variety of molds for forming different ice shapes during one cycle.

Figure 36:
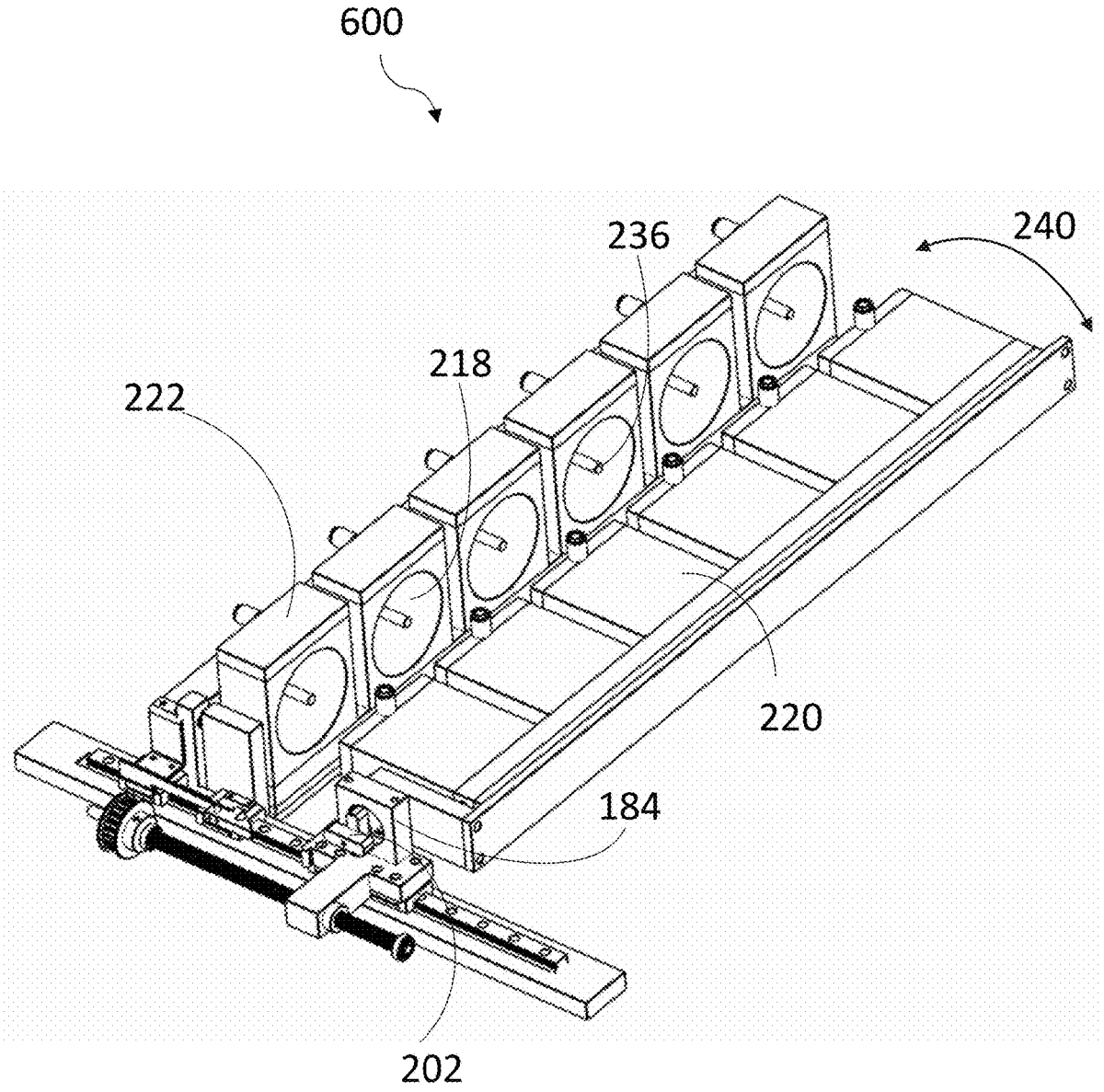
FIG. 36 shows an ejection mode of the device of FIG. 31.
Figure 37:
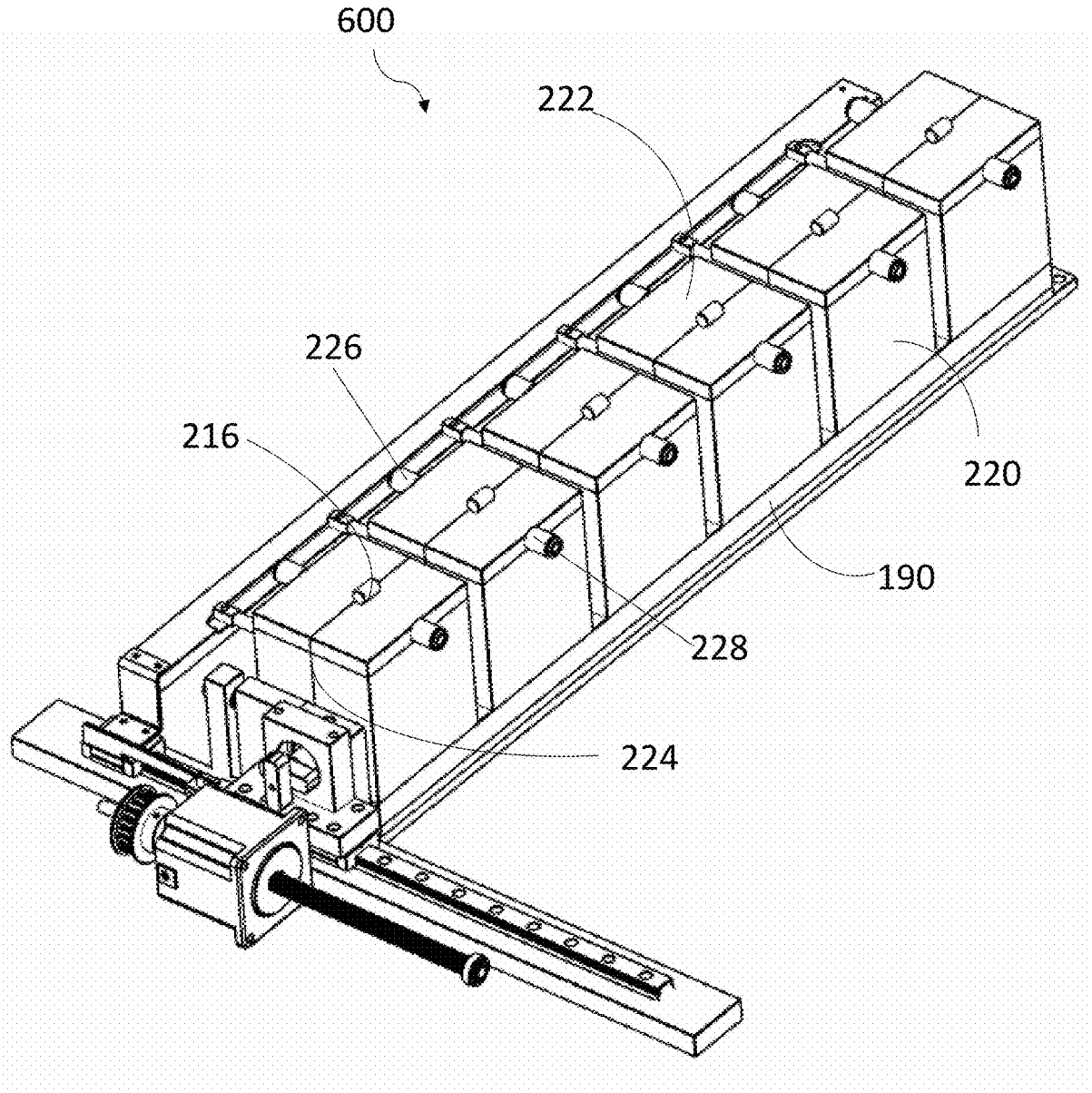
FIG. 37 shows an ice formation mode of the device of FIG. 31.

In some embodiments, a first mold portion 220 is movable relative to a second mold portion 222 and/or a cooling apparatus 190. In other embodiments, a second mold portion 222 is movable relative to a first mold portion 220 and/or a cooling apparatus 190. A mold portion may be static or fixed relative to the other mold portion and/or relative to a cooling apparatus. For example, a first 220 or second 222 mold portion may be static or fixed while the opposite mold portion is movable. In other embodiments, the first 220 and second 222 mold portions are movable relative to one another and/or a cooling apparatus 190. Movement of the first 220 and/or second 222 mold portions may be parallel with respect to the cooling apparatus 190. For example, FIG. 36 shows the first mold portion 220 moving rotationally 240 counterclockwise relative to the second mold portion 222. For example, rotational translation 240 may be about 20 degrees to about 270 degrees; about 45 degrees to about 180 degrees; about 70 degrees to about 100 degrees; about 85 degrees to about 95 degrees; about 90 degrees to about 180 degrees; or any range or subrange therebetween relative to a position of the first mold portion 220 that is parallel to the second mold portion 222 or relative to a position of the first mold portion 220 that is perpendicular to alignment rail 182 (see FIGS. 33 and 37). For example, as shown in FIG. 36, first mold portion 220 may be rotated 240 counterclockwise about 90 degrees to release the ice therein via gravity.

Figure 38:
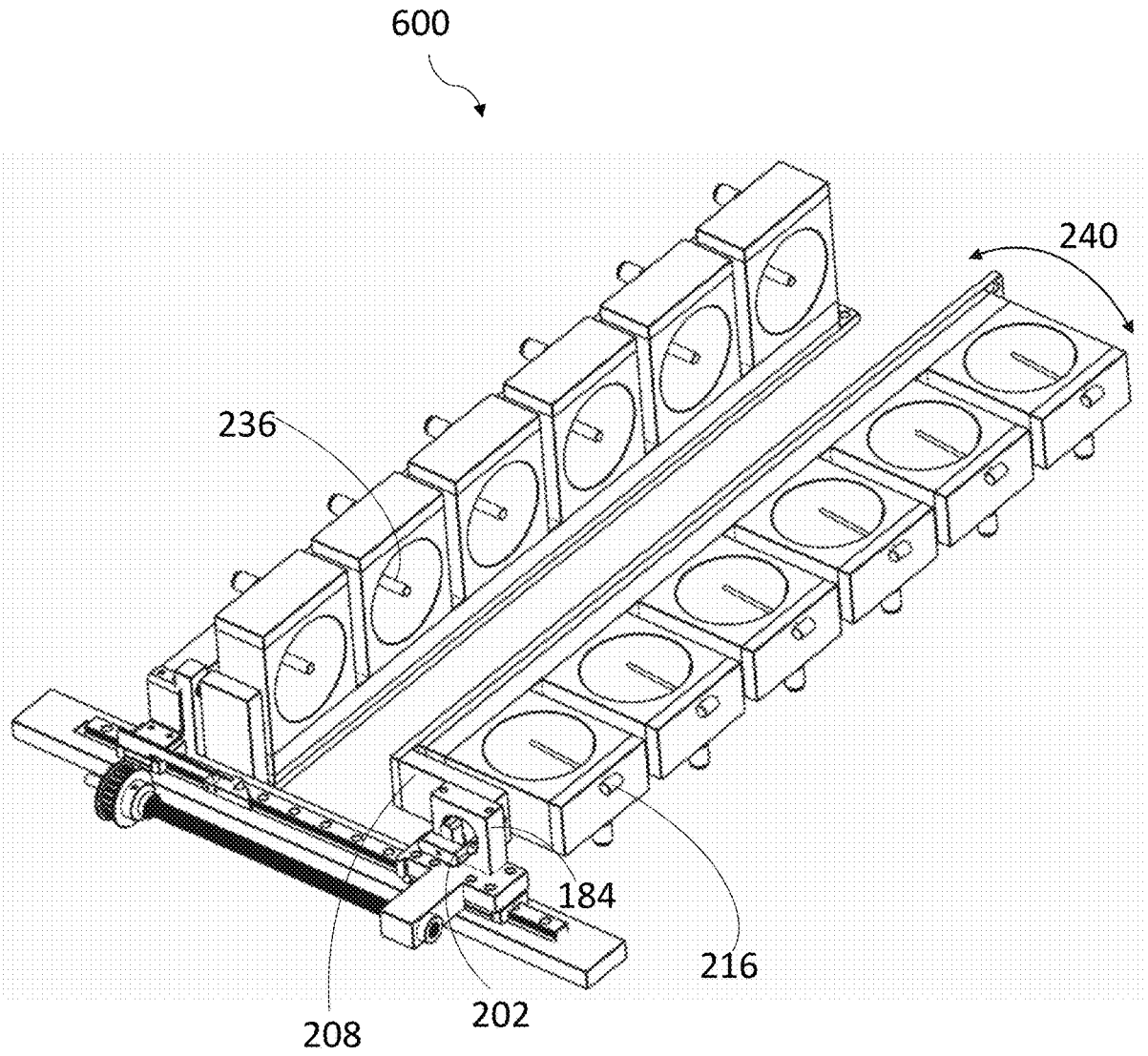
FIG. 38 shows an inclusion loading mode of the device of FIG. 31.

Alternatively, or additionally, as shown in FIG. 38, first mold portion 220 may be rotated 240 clockwise about 90 degrees to allow for inclusion (skewer or clip 216) loading and/or manual ice removal.

Figure 12:
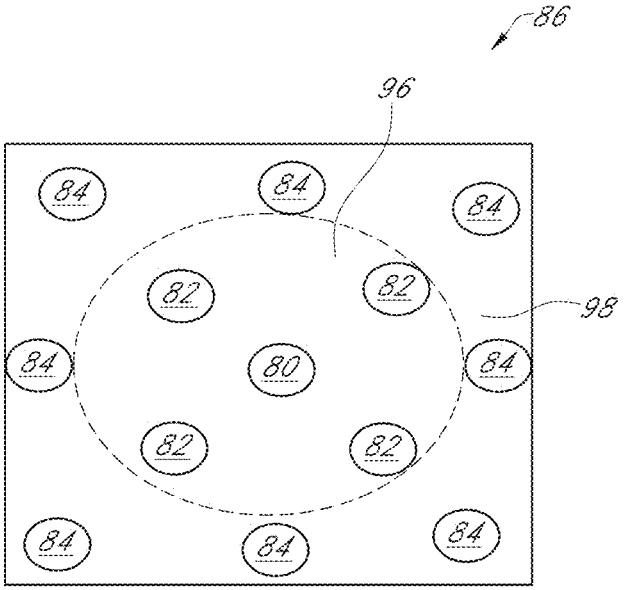
FIG. 12 shows a bottom view of the embodiment of FIG. 11.
Figure 15:
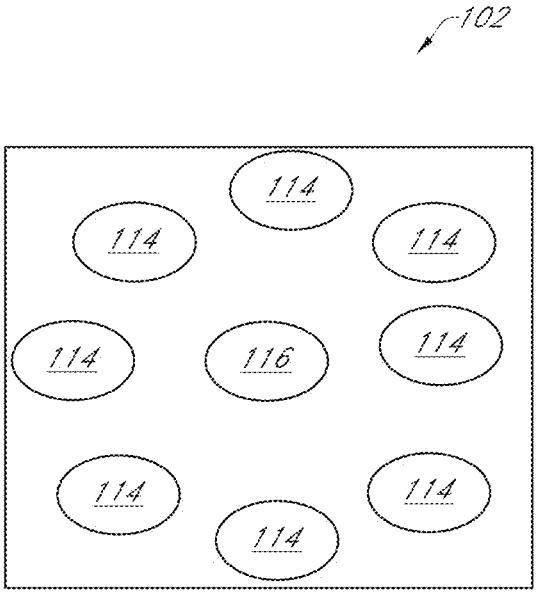
FIG. 15 shows a bottom view of the embodiment of FIG. 14.

In some embodiments, as shown in FIGS. 31 and 33, each mold 174 includes a manifold 198, one or more fluid inlet valves 226, and one or more fluid outlet valves 228, such that fluid flow is controllable within each mold 174. Optionally, mold flow insert 192, defining one or more ports or apertures, may be included in one or more molds or a subset of the one or more molds for varying a liquid flow rate into the mold. For example, FIGS. 9, 12, and 15 show various arrangements of ports or apertures.

In some embodiments, ice forming module 250 includes a manifold, one or more fluid inlet valves, and one or more fluid outlet valves, such that the one or more molds are in fluid communication so that fluid flows between molds and/or fluid flow in all the molds is substantially similar.

In one embodiments of a mold 174, as shown in FIG. 33, the one or more fluid inlet valves 228 are on the first mold portion 220, and the one or more fluid outlet valves 226 are on the second mold portion 222. Alternatively, the one or more fluid inlet valves 228 are on the second mold portion 222 and the one or more fluid outlet valves 226 are on the first mold portion 220. In still other embodiments, the first mold portion 220 includes one or more fluid inlet valves 228 and one or more fluid outlet valves 226. Alternatively, the second mold portion 222 includes one or more fluid inlet valves 228 and one or more fluid outlet valves 226.

The ice forming module 190 may further includes mold carrier 206 coupled to cooling apparatus insulation 188, which insulates cooling apparatus 190 (e.g., chill plate, Peltier, thermoelectric cooler, coolant, refrigerant, etc.), as shown in FIG. 33.

A system 600 for creating clear ice, as shown in FIGS. 31-38, may further include an inclusion module 204. The inclusion module 204 may include one or more skewers or clips 216 that are each reversibly insertable into one of the one or more molds 174. For example, a first mold portion 220 may define an aperture configured to receive a skewer or clip 216 therein. Alternatively, a second mold portion 222 defines an aperture configured to receive a skewer or clip 216 therein. The skewer or clip 216 may enter each mold 174 at an angle to center an item or inclusion in the mold during ice formation. Alternatively, when the first and second mold portions come together at an engagement plane 224, they may, together, define an aperture configured to receive a skewer or clip 216 therein. An inclusion may include a consumable or a non-consumable. An inclusion may include a liquid, solid, or gas, such that the skewer may define one or more apertures to release a liquid or gas into the ice during ice formation, to remove a liquid or gas from the liquid during ice formation, or such that the skewer may pierce or pinch a solid and hold it in position during ice formation.

As shown in FIG. 31, the inclusion module 204 may include a motor 178 and one or more timing belts 176 coupled to one more screws 180, such that when the motor 178 is actuated, the one or more timing belts 176 move the one or more screws 180 to move the skewer or clip 216 into or out of each mold 174 via plate 217 which interfaces with the skewers or clips 216. As one of skill in the art will appreciate, while a screw mechanism is shown in the figures, other mechanisms may be used, such as electro-magnetic solenoids, pneumatics solenoids, etc.

Figure 34:
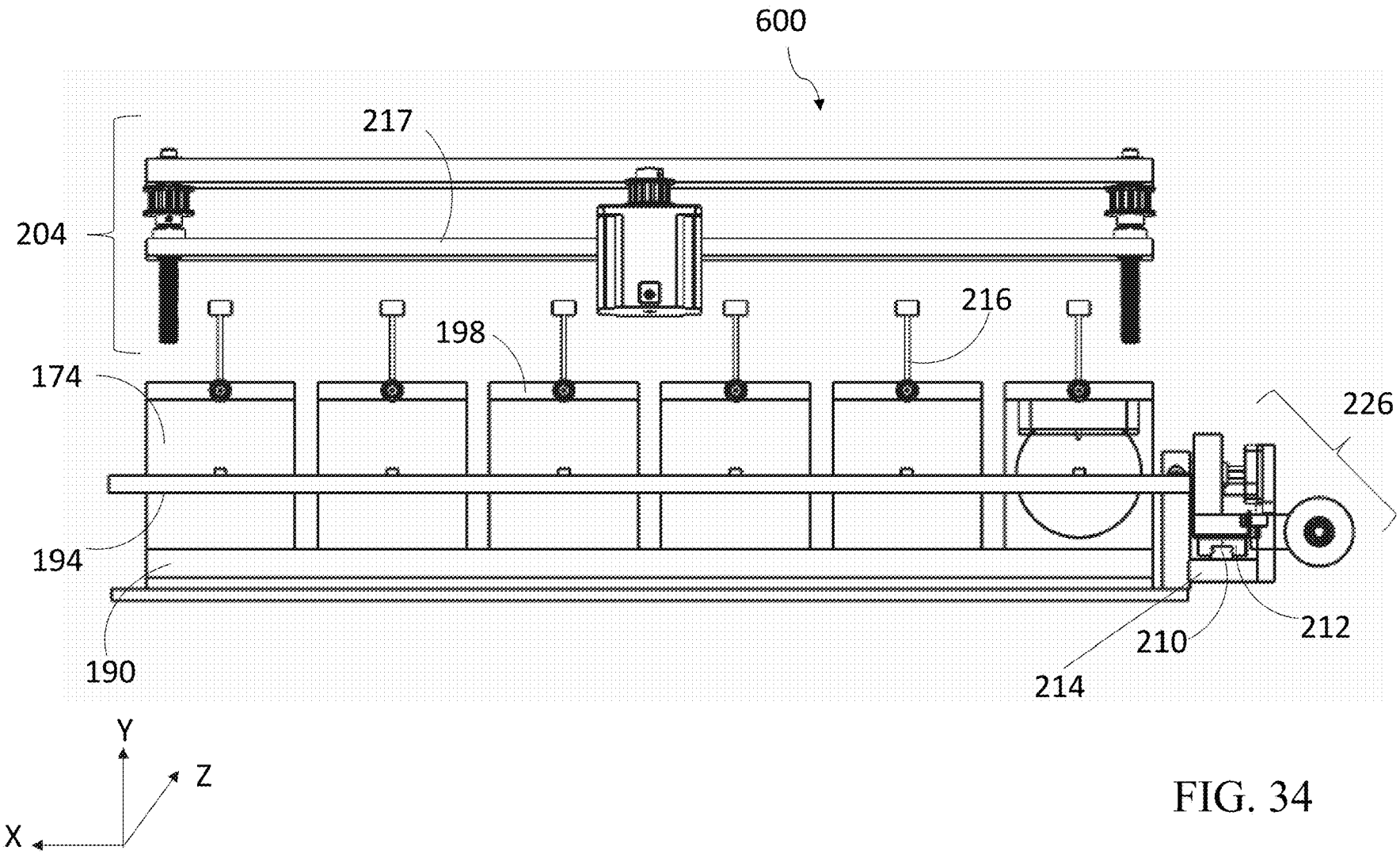
FIG. 34 shows a rear view of the device of FIG. 31.
Figure 35:
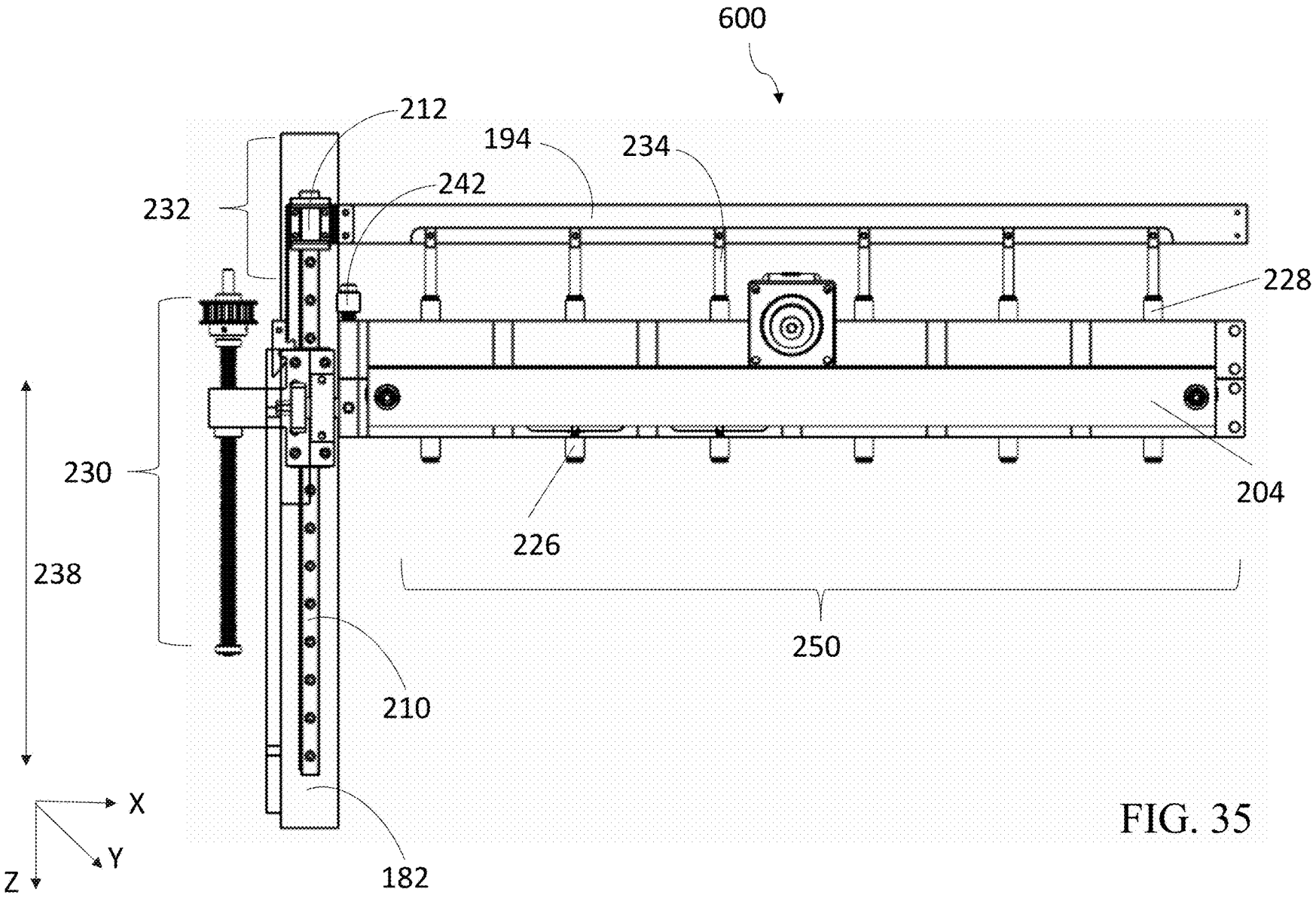
FIG. 35 shows a top view of the device of FIG. 31.

In some embodiments, a system 600 for creating clear ice may include an ejector module 232, as shown in FIGS. 34-36. The ejector module 232 includes one or more ejector pins 236 that are each reversibly insertable into one of the one or more molds 174 to dislodge an ice shape that is formed in the one or more molds 174. The one or more ejector pins 236 are coupled to an ejector pin brace 194, via ejector pin bracket 234. The ejector pin brace 194 is coupled to the ejector carriage 212 (e.g., ball bearing carriage). Ejector carriage 212 moves along rail 210 to move the ejector pin brace 194, and thus ejector pins 236 into and out of the molds. As one of skill in the art will appreciate, the ejector pin mechanism may be replaced with an air-based mechanism, hydraulics, or the like without departing from the original intent and scope of this disclosure. Further, in some embodiments, the molds include heat coils therein, such that at the conclusion of an ice formation cycle, the molds are heated to allow removal of the ice shapes by gravity or manually via a user grasping the ice shapes from each mold. Alternatively, in some embodiments, the ice formed in the molds is simply removed by gravity or manually by a user.

A system 600 for creating clear ice may further include a movement module 230, as shown in FIGS. 31-32 and 35. The movement module 230 is configured to axially translate 238 the first mold portion 220 and/or the ejector module 232 (in embodiments having an ejector module) relative to the second mold portion 222 and/or rotationally translate 240 the first mold portion 220 relative to the second mold portion 222. For example, as shown in FIGS. 32 and 35, the movement module 230 includes a rail 210 (e.g., ball bearing rail) coupled to alignment rail 182 and a mold carriage 186 coupled to the first mold portion 220. In embodiments having both an ejector module 232 and a movement module 230, the mold carriage 186 and the ejector carriage 212 translate axially 238 along the rail 210. In some embodiments, movement of the mold carriage 186 and the ejector carriage 212 along the rail 210 occurs substantially simultaneously. For example, as the first mold portion 220 is axially translated, the ejector module 232 is also axially translated which causes ejector pin 236 to enter the second mold portion 222 to dislodge the ice shape formed therein. Alternatively, movement of the mold carriage 186 and the ejector carriage 212 along the rail 210 occurs asynchronously. In some embodiments, alignment rail 182 includes a stop 242 (e.g., spring based mechanism), as shown in FIG. 35, such that the ejector carriage 212 is prevented from further axial movement once the ice shape is ejected from the second mold portion 222, while the mold carriage 186 coupled to the first mold portion 220 further axially translates and/or rotationally translates to dispense the ice shape therein, as shown in FIGS. 36 and 38. The movement module 230 may further include guide block 202 pivotally coupled to bearing block 184 which is pivotally coupled to mold pivot plate 208. Mold pivot plate 208 is coupled to a first or only mold 174 in an assembly of molds 174 such that mold pivot plate 208 rotates 240 with the first or only mold 174 relative to the bearing block 184.

Turning now to FIGS. 21A-29B, which disclose ice formation processes and related mechanisms. The following parameters may be adjusted to affect the speed of ice formation and clarity:

cooling apparatus temperature profile (e.g., start a 0 C and gradually decrease to −30 C over the course of 6 hours);

circulating liquid flow rate and/or profile. Exemplary profiles include: liquid circulating for certain time periods and not at others or the liquid circulating more during the beginning of freezing process and less during the end of the freezing process;

mold inlet and/or outlet nozzle geometry (e.g., angled) and spray direction inside the mold (e.g., potentially dictated by which inlets or outlets are turned on or off during and at which times or by flow reversal periods or by percent max flow for the inlets or outlets). For example, it may be desirable to create swirling fluid within the mold so there are no dead or still zones. There will likely be an optimization where the swirling is relatively or substantially uniform. However, too much swirling may slow down the freezing process;

an amount of insulation in the sidewalls or walls of each mold may be varied;

the liquid that is added to the molds or circulated around/through the molds may be heated;

a shape and/or size of the reservoir in the molds; and a connection configuration between the molds and to the pump.

Figure 11:
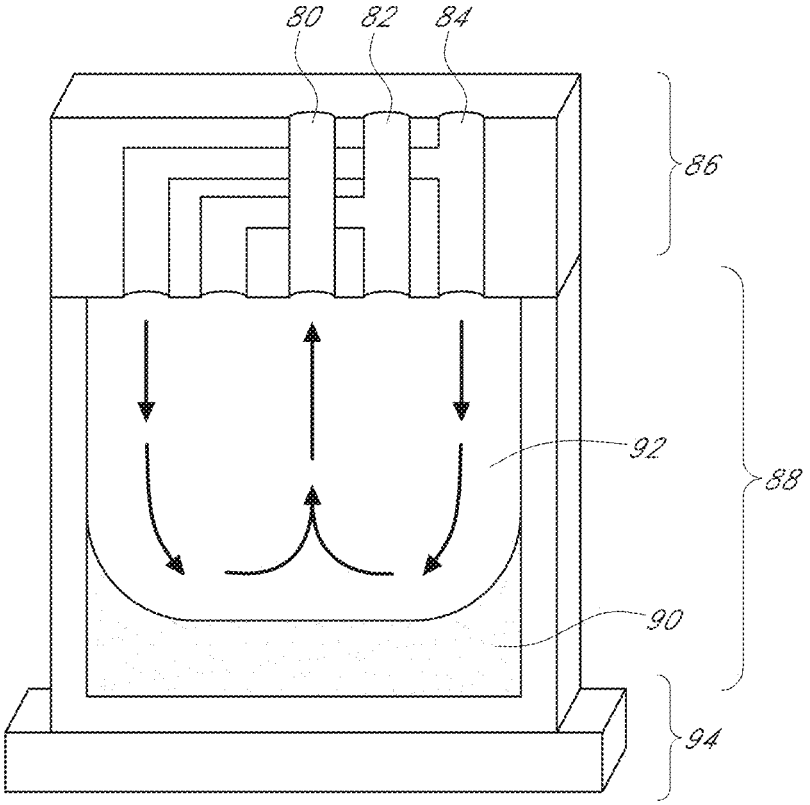
FIG. 11 shows ice formation in a mold during a start phase of one embodiment of a process for creating clear ice.
Figure 13:
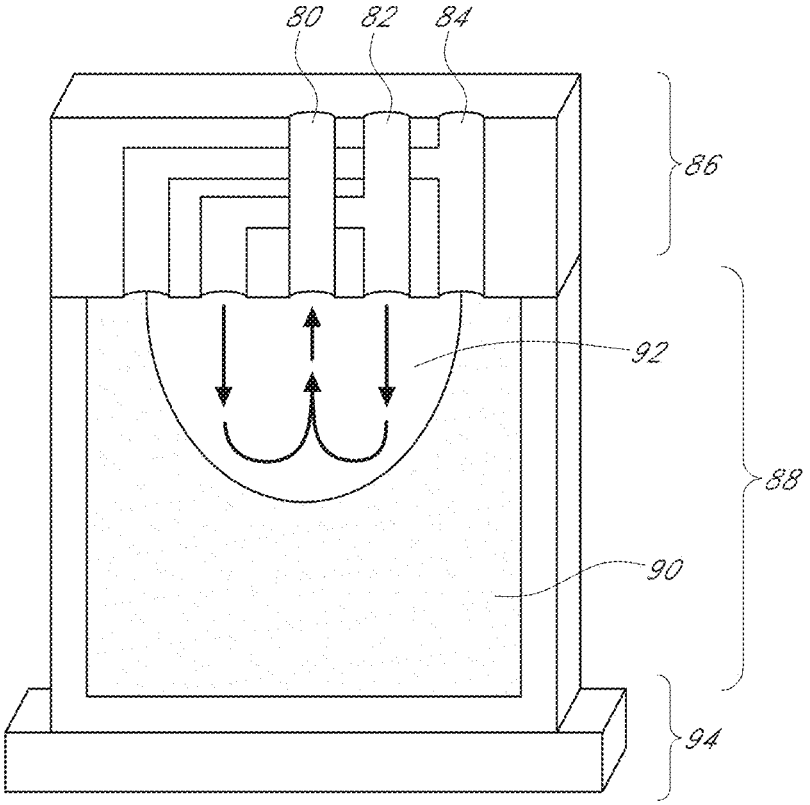
FIG. 13 shows ice formation in a mold during an end phase of one embodiment of a process for creating clear ice.

FIGS. 11 and 13 illustrate the ice formation in a mold during a start phase and end phase, respectively, of one embodiment of a process for ice formation. Water is circulated from one or more inlets (e.g., inner region inlets 82; outer region inlets 84) and out through an outlet 80, disposed in manifold 86, in the mold cavity 88 defined by first and second mold portions. As shown in FIG. 11, liquid 92 is circulated in mold cavity 88. Ice formation 90 begins proximal to cold plate 94 as liquid 92 is circulated in the remained of mold cavity 88. Ice 90 continues to form over time resulting in a smaller volume in which liquid is flowed during the ice making process, as shown in FIG. 13. As shown in FIGS. 11 and 13, liquid 92 may flow into the mold cavity 92 via inner region inlet 82 and/or outer region inlet 84. As is described elsewhere herein, flow may be switched between inlets during an ice making method and/or flow may come from both inlets during an ice making method. In one embodiment, during an end phase of ice formation as shown in FIG. 13, liquid is circulated from the inner inlets 82 (as opposed to the outer inlets 84) and out through outlet 80. The flow rate (percent of max flow) and origination of flow (inner region, outer region, flow reversal) may change over time during a method of making clear ice. For example, in some embodiments, outlet 80 may become a liquid inlet during a flow reversal period in a clear ice making method. Additionally, or alternatively, inlets 82, 84 may become a liquid outlet during a flow reversal period in a clear ice making method.

FIG. 12 illustrates an arrangement of one or more ports or valves on a bottom of a manifold 86 of the embodiment of FIG. 11. In this embodiment, the outer inlets 84 are around a perimeter of the mold (in this case a cube), and the inner inlets 82 are arranged radially such that they are between the outer inlets 84 and outlet 80. For example, as shown in FIG. 12, inner region 96 (demarcated by the dotted oval) includes inner inlets 82 and outlet 80, and outer region 98 includes outer inlets 84. FIG. 13 illustrates the ice formation in a mold during an end phase of one embodiment of a process for forming ice.

Figure 14:
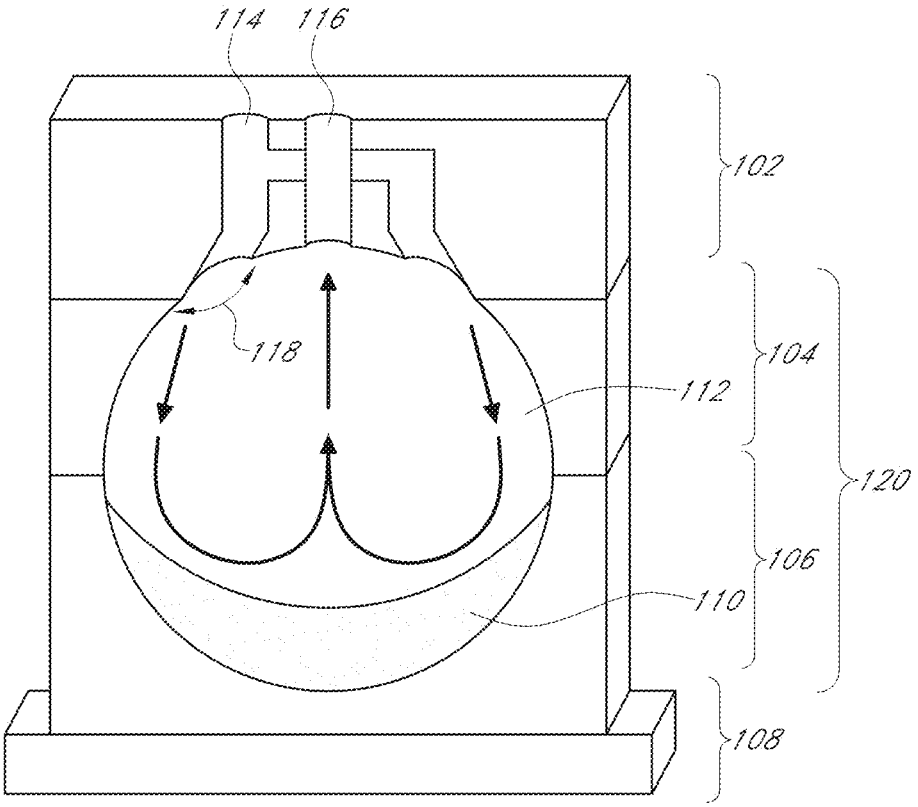
FIG. 14 shows a side profile view of one embodiment of a manifold of a housing having one or more angled liquid inlets in liquid communication with a mold.

FIG. 14 shows a side profile view of a device for making clear ice. The device includes manifold, mold 120, and cold plate 108. One embodiment of a manifold 102 of a housing has one or more angled liquid inlets 114. For example, an angle 118 of the inlet 114 may be about 10 degrees to about 60 degrees, about 20 degrees to about 60 degrees, about 30 degrees to about 50 degrees, about 35 degrees to about 45 degrees, about 45 degrees to degrees 75 degrees, about 35 degrees to about 90 degrees, about 45 degrees to about 90 degrees, or any range or subrange therebetween. The angle 118 of the liquid inlets 114 may match an angle or curvature of the mold 120 (forming of first 106 and second 104 mold portions), for example a spherical mold. As shown in FIG. 14, inlet 114 may be positioned on the same mold portion (i.e., in this embodiment, the first mold portion 104) as outlet 116; in other embodiments, inlet 114 and outlet 116 are positioned on separate mold portions. Further, the angled liquid inlets 114 may function to create liquid 112 flow along a perimeter of the mold cavity in areas that typically receive little to no flow, such as undercut (i.e., a lip or a shelf adjacent to the inlets) or narrow regions to increase clear ice formation 110. FIG. 15 shows a bottom view of the manifold 102 of FIG. 14, where the angled liquid inlets 114 are disposed radially or circumferentially on one of the mold portions and a liquid outlet 116 resides in a center region of the angled liquid inlets 114. In some embodiments, the liquid outlet 116 is substantially equally spaced from all the angled liquid inlets 114. Alternatively, the liquid outlet 116 may be closer or in proximity to a subset of the angled liquid inlets 114. Although a plurality of liquid inlets is shown in FIGS. 12 and 15, one of skill in the art will appreciate that any of the preceding embodiments may include one, more than one, one or more, or a plurality of liquid inlets.

Figure 16:
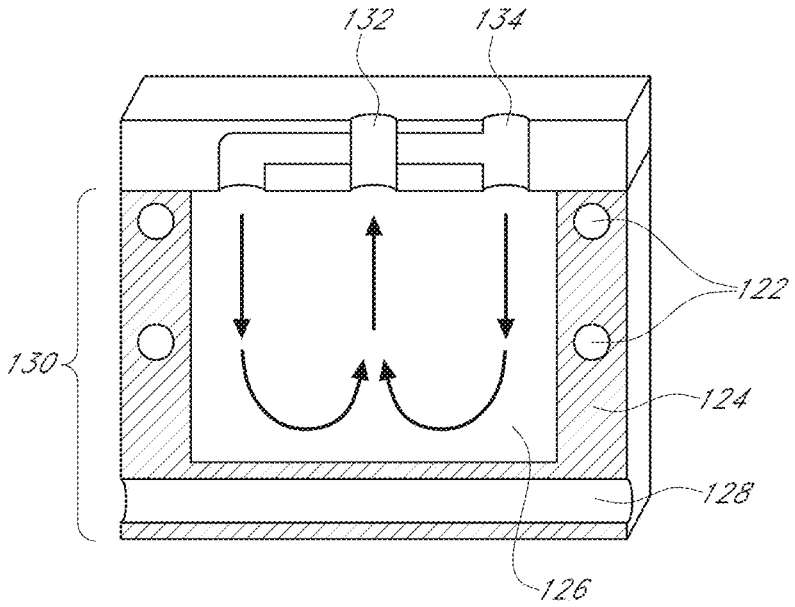
FIG. 16 shows ice formation in a mold during one embodiment of a process for modulating temperature during an ice formation cycle.
Figure 17:
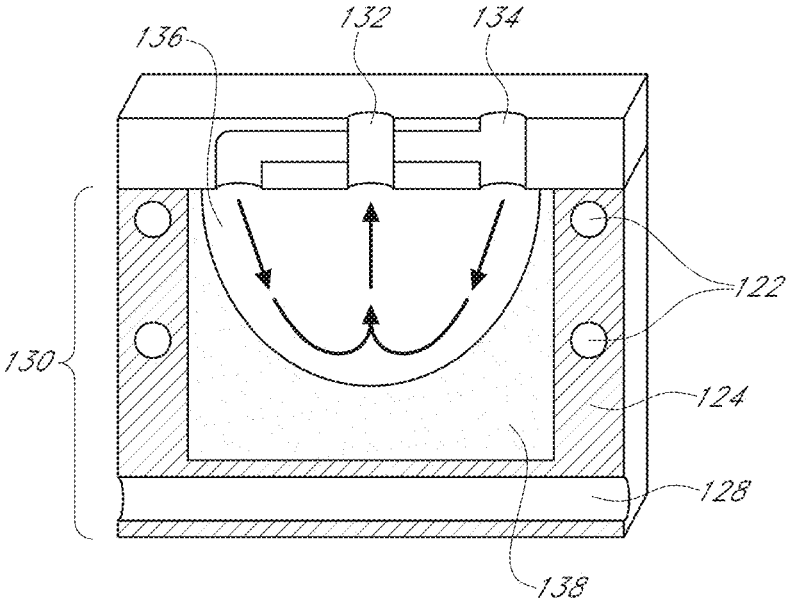
FIG. 17 shows ice formation in a mold during another embodiment of a process for modulating temperature during an ice formation cycle.
Figure 18:
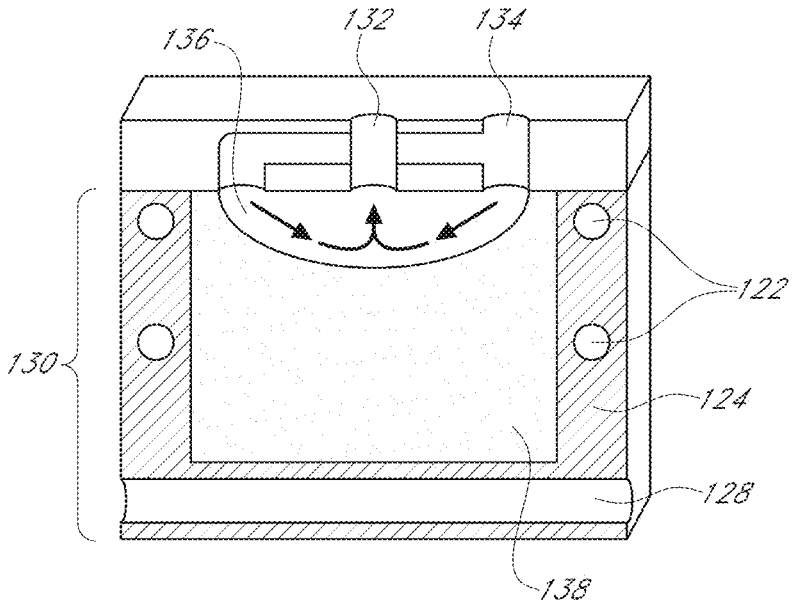
FIG. 18 shows ice formation in a mold during another embodiment of a process for modulating temperature during an ice formation cycle.

Various temperature control configurations and/or processes will now be described with respect to FIGS. 16-18. FIGS. 16-18 show a device for making clear ice including mold 130, inlet 132, outlet 134, optionally one or more sidewall refrigerant lines 122, and optionally one or more cold plate refrigerant lines 128. In some embodiments, as shown in FIGS. 16-18, mold temperature may be controlled in segmented bands such that one or more sidewalls 124 of the mold 130 include one or more refrigeration lines 122, for example formed in concentric circles around a mold cavity 126 from bottom to top (or any patterned deemed to be effective). In such embodiments, the mold 130 is chilled from the bottom or from a first mold portion and/or the sides to improve efficiency and/or overall process duration. FIGS. 16-18 show various temperature control scenarios. For example, as shown in FIG. 16, all refrigerant lines are active. The process for ice formation 138 may include an initial cool down to bring a liquid 136 temperature down from ambient temperature to just above freezing temperature. Further, for example, as shown in FIG. 17, all refrigerant lines are active, and the process for ice formation includes a mid-cycle plateau in temperature using both the refrigerant lines and the chill plate to improve efficiency. Further, for example as shown in FIG. 18, a subset of the refrigerant lines 122 is active (e.g., only the lines disposed in one or more sidewalls of the mold), and the process for ice formation includes an end cycle plateau in temperature using the one or more refrigerant lines to improve efficiency and/or help to reduce the overall temperature gradient in the ice which reduces internal stresses and the likelihood of cracking. Internal tension (which often results in cracking) may also be reduced over time, through the process of creep, without adjusting or reducing the temperature gradient. As another example, instead of, or in addition to, refrigerant lines, a mold may include a thermoelectric cooling apparatus coupled to or integrated into the mold. Additionally, or alternatively, a mold may include one or more heating elements opposite a cooling apparatus to control ice formation boundary that migrates up the mold as its formed.

FIGS. 21A-29B show various exemplary, non-limiting methods for forming clear ice using any ice mold structure described herein or known in the art. As one of skill in the art will appreciate, any of the parameters, temperature ranges, stages, rates, time periods, circulation, agitation, etc. of any of FIGS. 21A-29B may be exchanged with each other. Various parameters were adjusted in each of the figures. For example, temperature, time, end plateau (i.e., flow or temperature stays constant for a time period at the end of the method, mid-cycle plateau (i.e., flow or temperature stays constant for a time period during the recipe), flow paths (i.e., flow inlets that are located towards the outside of the mold are being controlled separately from flow inlets towards a center of the mold), flow direction (i.e., flow reversal; pump direction is switched such that the inlets become the outlets and the outlets become the inlets), circulation (e.g., maintain some degree of water flow at the ice formation boundary to prevent dissolved gasses from freezing in the water), initial cool down (i.e., an initial aggressive ramp down in temperature to bring the water in the molds close to freezing more quickly, for example an initial temperature drop to about 0° C. to about −15° C.), and annealing (i.e., period at the end of the method after the ice has been formed that allows for the temperature gradient in the ice to lessen or reduce internal stresses that can lead to cracking). For example, one or more temperature plateaus may be from about 3 minutes to about 100 minutes. Further for example, an annealing period may be characterized by a coolant source temperature between about −2° C. and about 15° C. and the percentage max flow of about 0% to about 5%. As shown below, each step in each method may include or comprise about 1 to about 20 minutes; about 2 minutes to about 15 minutes; about 5 minutes to about 10 minutes; substantially 5 minutes; substantially 6 minutes; substantially 8 minutes; about less than 10 minutes; etc. As shown in the following figures, the initial steps may vary in time from about 5 minutes to about 10 minutes and then the subsequent steps may vary in time from about 2.5 minutes to about 7.5 minutes. Although, as one of skill in the art will appreciate decreasing or increasing a step by about 1 minute to about 10 minutes will not depart substantially from the scope of this disclosure.

In some embodiments, a method for forming clear ice includes: providing a mold, for example, any of the mold embodiments (e.g., one piece, two pieces, multiple pieces, vertical split, horizontal split, etc.); optionally inserting a skewer or clip through the first or second mold portion, the skewer or clip being coupled to an item or configured to release a fluid into a cavity in the ice (e.g., skewer defines one or more apertures); circulating, using the fluid inlet and outlet valves, a fluid in the cavity defined by the first and second mold portions; optionally varying overtime one or both of: a temperature of the cooling apparatus or source or a fluid flow, through the fluid inlet valve, as a percentage of max flow; and optionally retracting the skewer or clip when the ice formation encases at least a portion of the item.

As shown above, in some embodiments, temperature is varied (e.g., 0° C. and about −25° C. or any of the ice making methods described elsewhere herein); in other embodiments, the flow rate is varied (e.g., percentage of max flow between about 5% and about 100% or any of the ice making methods described elsewhere herein). In some embodiments, both temperature and flow rate are varied. In some embodiments, neither temperature nor flow rate are varied.

In some embodiments, the mold is configured to receive a skewer or clip therethrough, such that the method includes inserting the skewer or clip and optionally retracting the skewer or clip at a predetermined time. The predetermined time is dependent on a type of item coupled to the skewer, dependent on a volume of the mold, a random predetermined time, or combination thereof. In some embodiments, ice formation is monitored via a sensorized mold and/or skewer/clip such that the skewer or clip is removed or retracted based on a progress of ice formation. The method may optionally include releasing the ice from the mold with the item encased therein, for example via gravity, manual removal, automatic removal (e.g., ejector pin, air, hydraulics, etc.). In some embodiments, the method optionally includes sealing a first mold portion to a second mold portion or sealing various mold pieces to one another, for example via a gasket, pressure seal, screw type seal, etc. The seal that is formed is positioned vertically between the first and second mold portions. Alternatively, the seal that is formed is positioned horizontally between the first and second mold portions, as shown and described elsewhere herein.

Figure 21B:
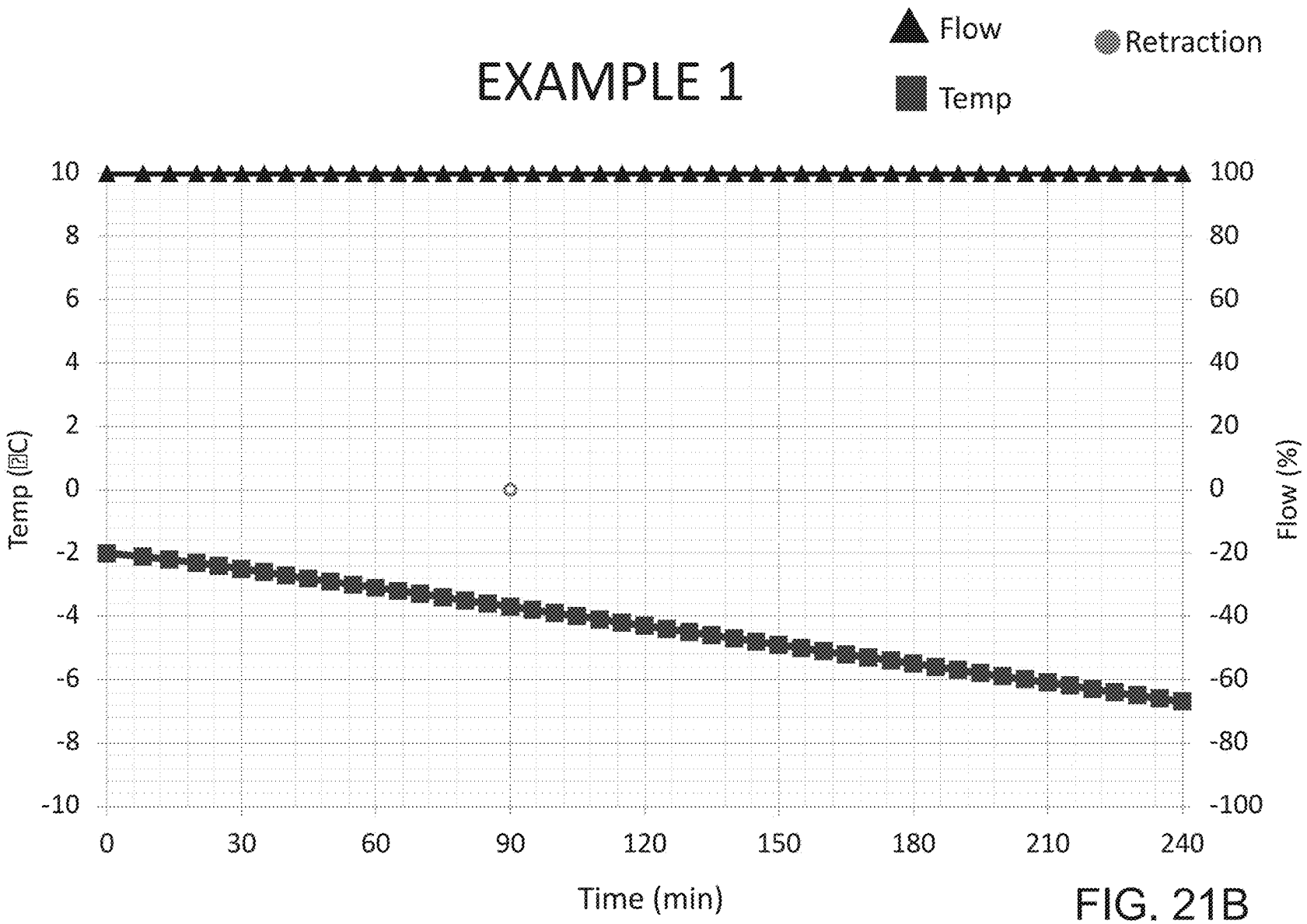

FIGS. 21A-21B show varied temperature over time at a constant flow. As shown in FIG. 21A, temperature is decreased incrementally over time. The size of the increments may vary over time; alternatively, the increments may not vary over time (i.e., are fixed), such that increment remains the same over time. In one exemplary embodiment, the increment is 0.1° C., such that the temperature decreases by an increment of about 0.1° C. over time. In other embodiments, the increment may be less than about 0.1° C. or more than about 0.1° C. In some embodiments, the increment may be from about 0.25° C. to about 5° C.; 0.5° C. to about 5° C.; about 1° C. to about 5° C.; about 0.5° C. to about 3° C.; about 0.5° C. to about 2.5° C.; etc.

Further, as shown in FIGS. 21A-21B, a temperature variation may be from about 0° C. to about −10° C.; about 0° C. to about −25° C.; about 0° C. to about −10° C.; about −2° C. to about −7° C.; about −1° C. to about −10° C.; etc. For example, the temperature may decrease gradually over time. In the example shown in FIGS. 21A-21B, the percent max flow remains at 100% through the duration of the ice making method. Alternatively, as one of skill in the art will appreciate, and as shown elsewhere herein, the percent max flow may vary over time.

Further, as shown in FIGS. 21A-21B, a skewer or clip may be retracted at one or more of: a predetermined time, based on a degree of ice formation, based on a volume of ice formation, based on a type of inclusion or item coupled to the skewer or clip, based on a sensor reading (e.g., temperature, clarity of ice, volume of ice, etc.) or a combination thereof. As shown in FIGS. 21A-21B and for any of the embodiments described herein, a skewer or clip may be retracted after about 30 minutes to about 180 minutes; about 45 minutes to about 165 minutes; about 30 minutes to about 140 minutes; about 45 minutes to about 125 minutes; about 60 minutes to about 110 minutes; about 75 minutes to about 90 minutes; at about 90 minutes; at about 120 minutes; etc. from or after the start time (time=0) of the method. Alternatively, or additionally, in any of the embodiments described herein, a skewer or clip, may include a heating means (e.g., heating element, heating coils, etc.) such that the skewer or clip may be heated and retracted at any time during or after the ice making process.

Figure 22B:
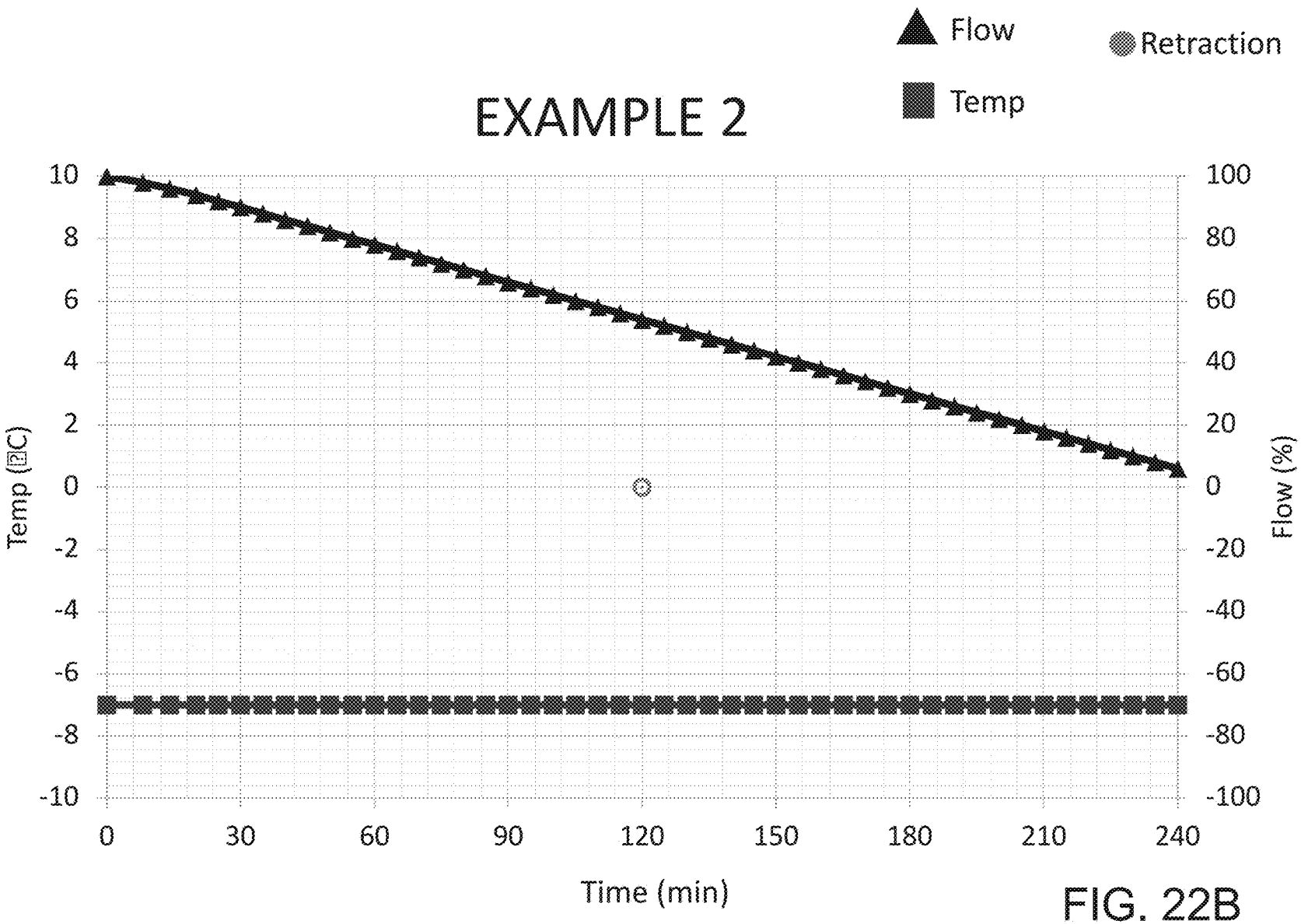

FIGS. 22A-22B show varied flow rate over time at a constant temperature. As shown in FIG. 22A, flow rate, as a percentage of max flow, is decreased incrementally over time. The size of the increments may vary over time; alternatively, the increments ma not vary over time, such that increment remains the same over time. In one exemplary embodiment, the increment is about 2%, such that the flow rate decreases by an increment of about 2% over time. In other embodiments, the increment may be less than about 2% or more than about 2%. In some embodiments, the increment may be from about 0.5% to about 95%; about 1% to about 95%; about 2% to about 10%; about 1% to about 5%; about 5% to about 10%; about 5% to about 95%; about 10% to about 90%; about 15% to about 85%; about 20% to about 80%; about 25% to about 75%; about 30% to about 70%; about 35% to about 65%; about 40% to about 60%; about 45% to about 55%; about 45% to about 50%; etc. For example, the percent max flow may decrease gradually over time. In the example shown in FIGS. 22A-22B, the temperature remains constant or fixed during the method. For example, the temperature may remain close to or at about −5° C. to about −10° C. For example, the temperature may remain at about or substantially −7° C. Alternatively, as one of skill in the art will appreciate, and as shown elsewhere herein, the temperature may vary over time. In this embodiment, the skewer or clip is retracted after about or substantially 120 minutes from the start (time=0) of the method.

Figure 23B:
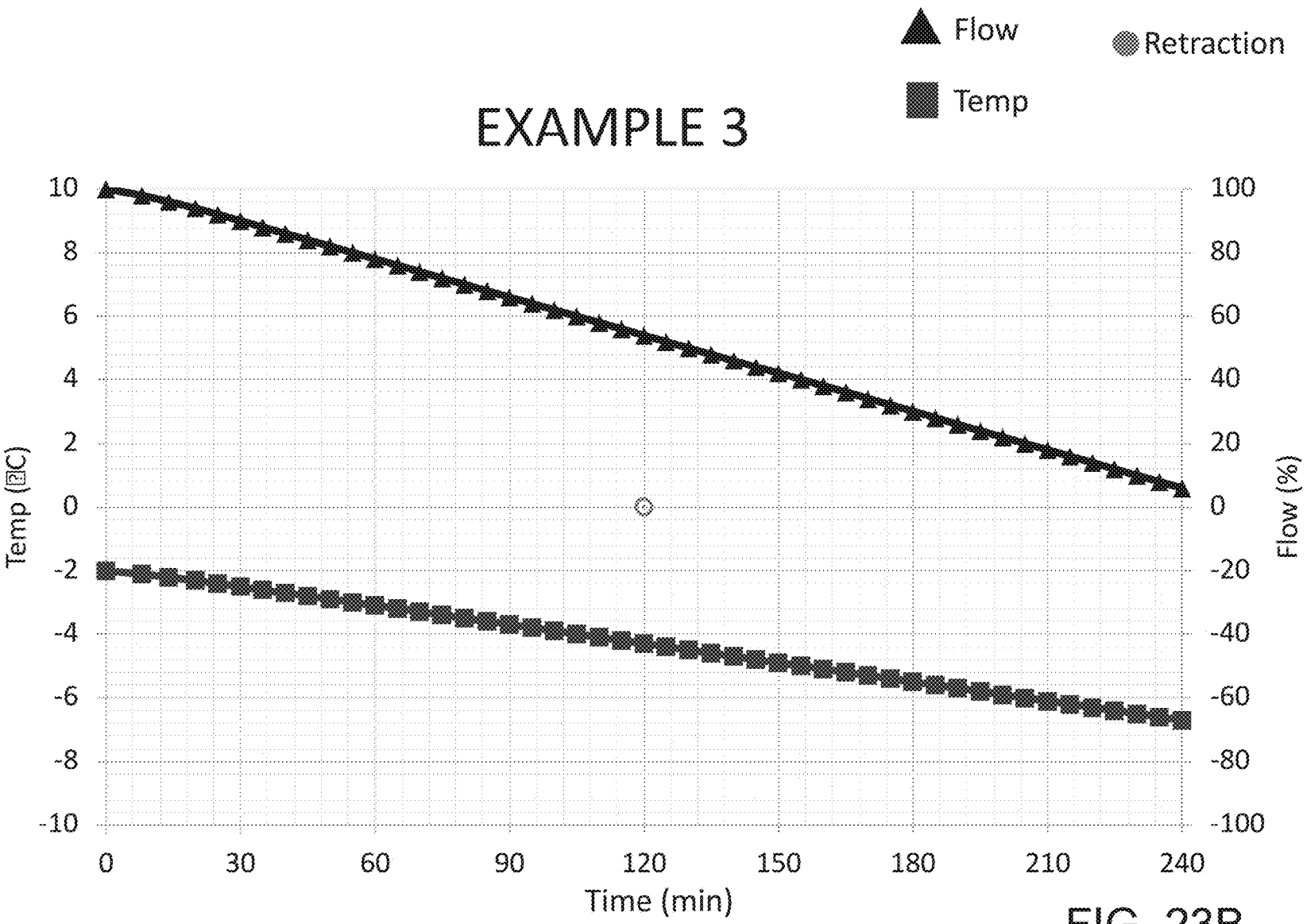

FIGS. 23A-23B show varied flow rate and temperature over time. As one can appreciate, FIGS. 23A-23B show a combination of the methods of FIGS. 21A-21B and FIGS. 22A-22B. In this embodiment, both the temperature and the flow rate are varied over time. The variation may be incremental, at a fixed interval, or variable, in a defined pattern or stochastic within a defined range.

Figure 24B:
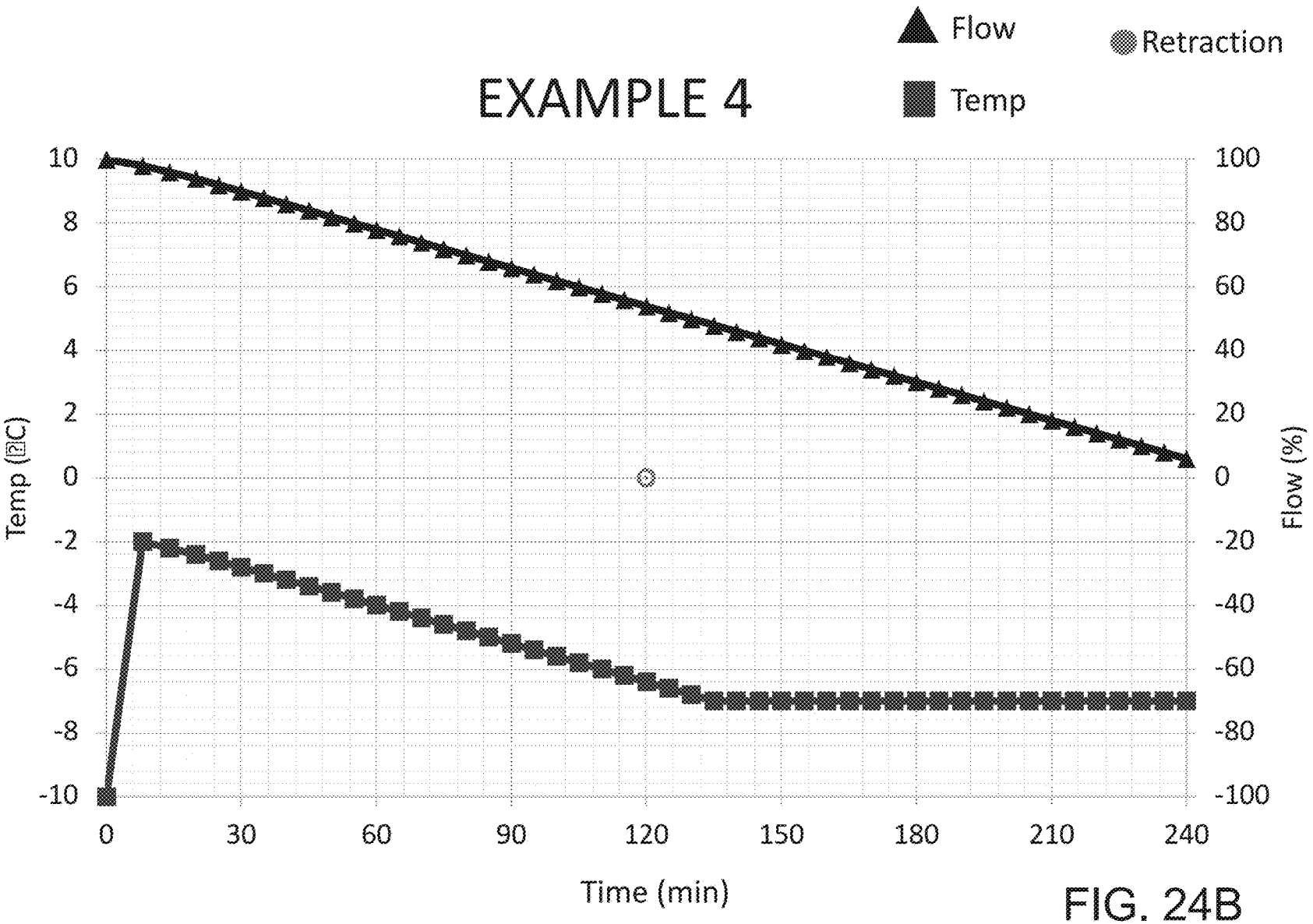

FIGS. 24A-24B show a method of making clear ice. The method includes an initial cool down cycle where the temperature remains fixed for a period of time. For example, the temperature may be set at or below about 0° C.; at or below about −2° C.; at or below about −4° C.; at or below about −6° C.; at or below about −8° C.; at or below about −10° C.; at or below about −12° C.; at or below about −14° C.; at or below about −16° C.; at or below about −18° C.; at or below about −20° C. The temperature may be set between about 0° C. and about −25° C.; about −5° C. and about −20° C.; about −10° C. and about −15° C.; or about or substantially −10° C. The period of time may range from about 1 minute to about 20 minutes about 1 minute to about 15 minutes; about 5 minutes to about 15 minutes; about 5 minutes to about 10 minutes; about 6 minutes to about 8 minutes; etc. This initial cool down cycle may also be referred to herein as a start plateau or beginning plateau. Further, as shown in FIGS. 24A-24B, the method may include an end plateau, such that the temperature is kept substantially constant for a period of time. For example, the temperature may be maintained between about 0° C. and about −15° C.; about −5° C. and about −15° C.; about −5° C. and about −10° C.; about −6° C. and about −8° C.; etc. for about 5 to about 150 minutes; about 10 minutes to about 145 minutes; about 20 minutes to about 140 minutes; about 75 minutes to about 115 minutes; about 90 minutes to about 110 minutes; about 100 minutes to about 110 minutes; etc. In between the initial plateau and the end plateau, the temperature may be incrementally decreased from about −2° C. to about −7° C. For example, the temperature may incrementally decrease by 0.2° C. between the beginning and end plateaus. Alternatively, the increment may be between about 0.1° C. and about 0.5° C.; about 0.1° C. and 1 oC; about 0.1° C. and about 0.3° C.; about 0.1° C. and about 0.4° C.; etc. For the embodiment shown in FIGS. 24A-24B, the flow rate may vary over time as shown and described for FIGS. 23A-23B. Further, in the embodiment of FIGS. 24A-24B, the skewer or clip is retracted at about or substantially 120 minutes from a start of the method, as described elsewhere herein.

Figure 25B:
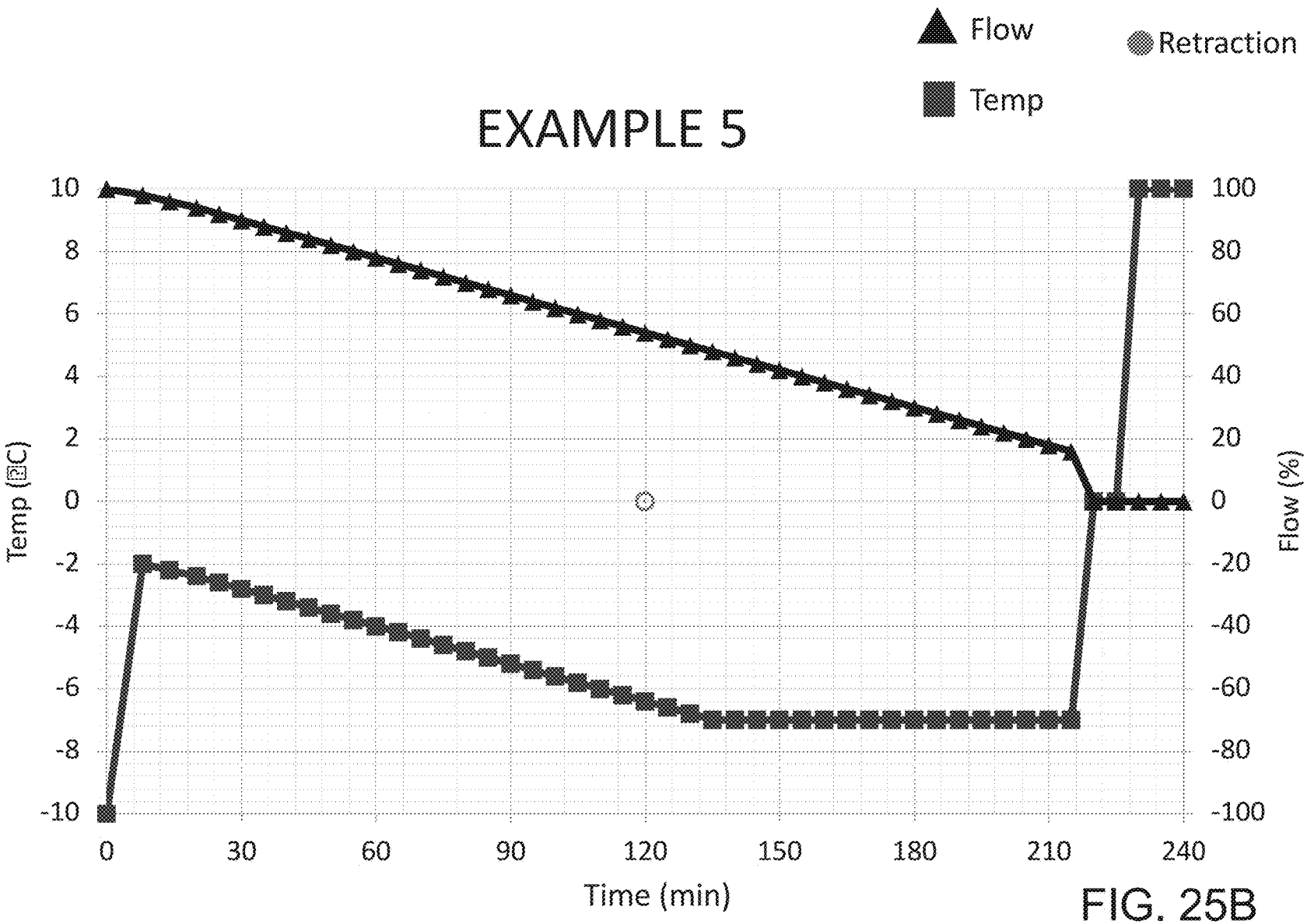

FIGS. 25A-25B show a method of making clear ice that is similar to that of FIGS. 24A-24B, except that the method of FIGS. 25A-25B further includes an annealing phase at or near the end of the method. For example, an annealing phase may comprise a period of warmer temperatures to lessen or reduce internal stress that may lead to cracking. In some embodiments, an annealing phase may be characterized by one or more temperature periods that range in temperature from about −5° C. to about 20° C.; about −2° C. to about 15° C.; about 0° C. to about 10° C., or any range or subrange therebetween. For example, an annealing phase may include a first period at a temperature between about −5° C. and about 5° C. and a second period at a temperature between about 5° C. and about 15° C. Alternatively, an annealing phase may be characterized by one period at a fixed temperature or a plurality of periods, each at a different temperature from a previous temperature and a future temperature. Each period of time may range from about 2 minutes to about 60 minutes; about 5 minutes to about 30 minutes; about 5 minutes to about 25 minutes; about 5 minutes to about 20 minutes; about 5 minutes to about 15 minutes; about 10 minutes to about 15 minutes; or any range or subrange therebetween. Further, in the embodiment of FIGS. 25A-25B, the skewer or clip is retracted at about or substantially 120 minutes from a start of the method, as described elsewhere herein.

Figure 26B:
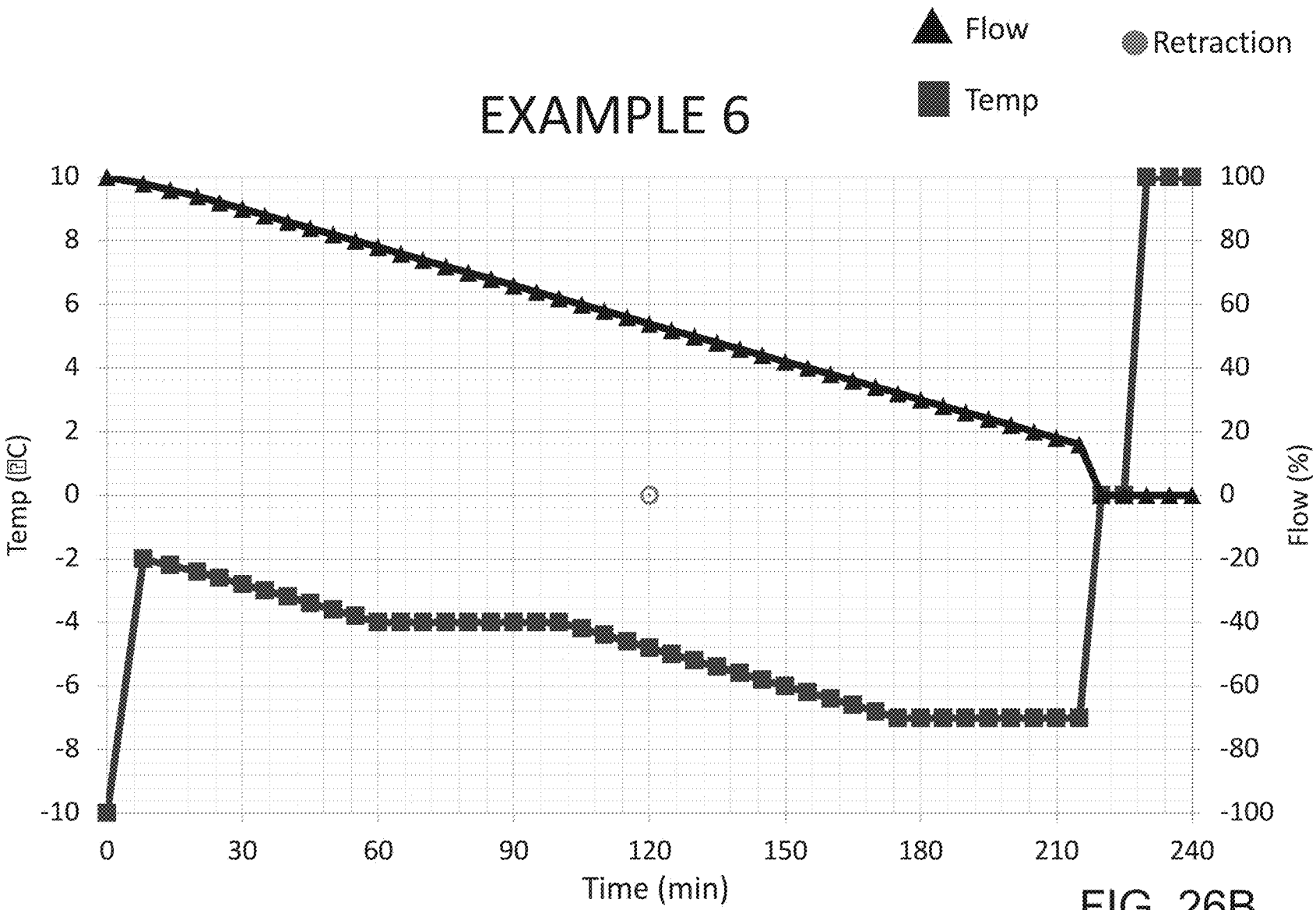

FIGS. 26-26B show a method of making clear ice that is similar to that of FIGS. 25A-25B, except that the method of FIGS. 26A-26B further includes a mid-method plateau, such that the temperature is kept substantially constant for a period of time. For example, the temperature may be maintained between about −10° C. and about 0° C.; about −8° C. and about 0° C.; about −6° C. and about 0° C.; about −6° C. and about −2° C.; about −5° C. and about −2° C.; about −5° C. and about −3° C.; or any range or subrange therebetween for about 5 to about 100 minutes; about 10 minutes to about 95 minutes; about 20 minutes to about 90 minutes; about 30 minutes to about 75 minutes; about 30 minutes to about 60 minutes; about 30 minutes to about 50 minutes; etc. In one example, a mid-cycle plateau may include a temperature of about −4° C. for about 45 minutes. In between the initial plateau and the end plateau, the temperature may be incrementally decreased from about −2° C. to about −7° C. For example, the temperature may incrementally decrease by 0.2° C. between the beginning and end plateaus. Alternatively, the increment may be between about 0.1° C. and about 0.5° C.; about 0.1° C. and 1° C.; about 0.1° C. and about 0.3° C.; about 0.1° C. and about 0.4° C.; etc. For the embodiment shown in FIGS. 24A-24B, the flow rate may vary over time as shown and described for FIGS. 23A-23B. Further, in the embodiment of FIGS. 24A-24B, the skewer or clip is retracted at about or substantially 120 minutes from a start of the method, as described elsewhere herein.

Figure 27B:
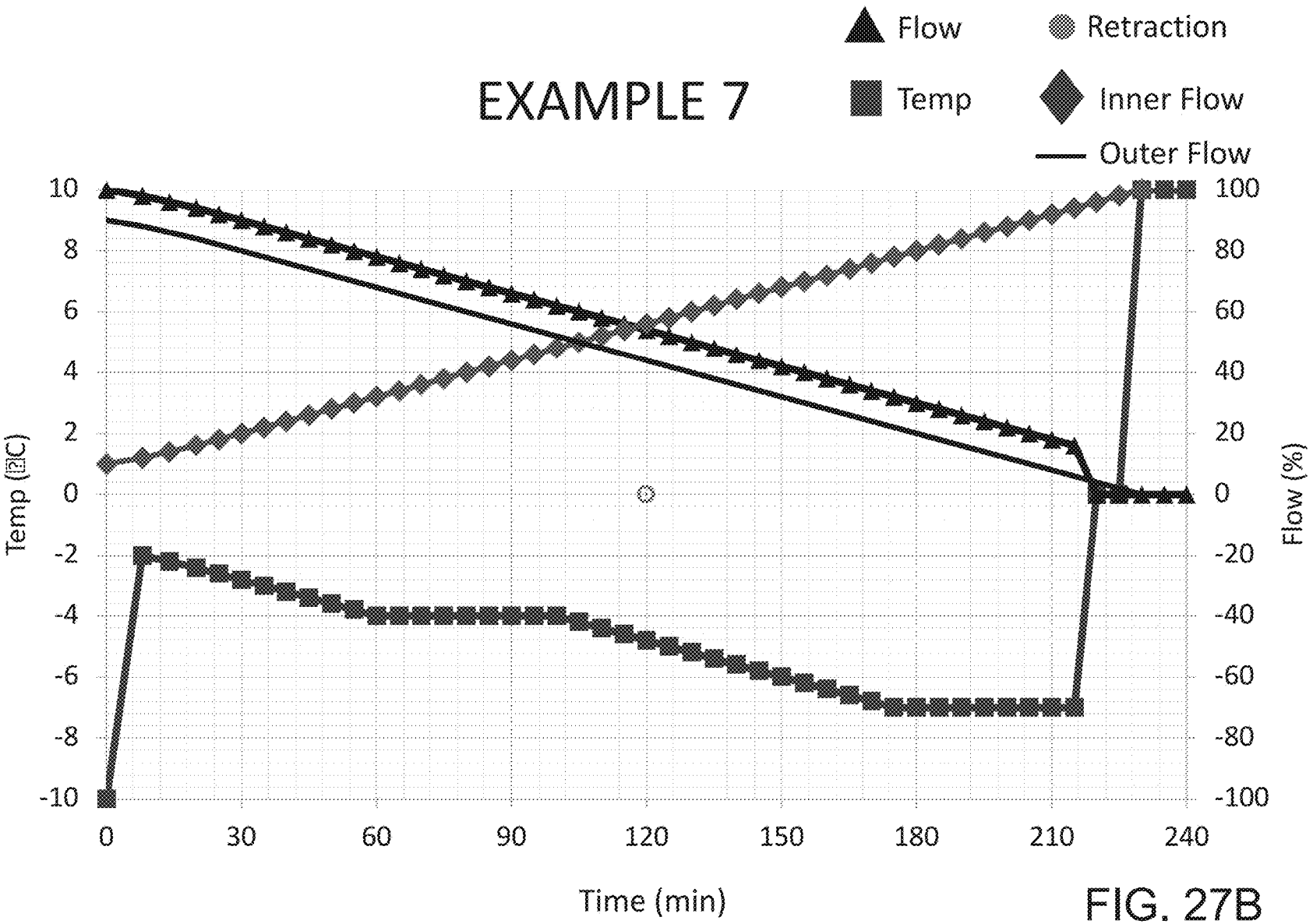

FIGS. 27A-27B show another method of making clear ice. The method is similar to that shown in FIGS. 26A-26B, except the method of FIGS. 27A-27B includes shifting or adjusting between fluid inlet valves positioned in an inner region and fluid inlet valves positioned in an outer region. In one exemplary embodiment, the inner and outer inlet valves are arranged similar to the embodiment shown in FIG. 12. As shown in FIGS. 27A-27B, the overall flow rate, as a percentage of max flow, decreases incrementally over time. The size of the increments may vary over time; alternatively, the increments may not vary over time, such that increment remains the same over time or is fixed. In one exemplary embodiment, the increment is about 2%, such that the flow rate decreases by an increment of about 2% over time. In other embodiments, the increment may be less than about 2% or more than about 2%. In some embodiments, the increment may be from about 0.5% to about 95%; about 1% to about 95%; about 2% to about 10%; about 1% to about 5%; about 5% to about 10%; about 5% to about 95%; about 10% to about 90%; about 15% to about 85%; about 20% to about 80%; about 25% to about 75%; about 30% to about 70%; about 35% to about 65%; about 40% to about 60%; about 45% to about 55%; about 45% to about 50%; etc. For example, the percent max flow may decrease gradually over time. However, as shown in FIGS. 27A-27B, the overall flow rate or percent may comprise a combination of flow from flow inlet valves in an inner region and flow inlet valves in an outer region. For example, as flow into the mold from the inner region inlet valves increases over time, flow into the mold from the outer region inlet valves decreases over time. This is exemplified in the graph of FIG. 27B, which shows the intersection between the decreasing outer region flow and the increasing inner region flow. For example, the intersection point may be characterized by equal or substantially equal flow from the inner region and outer region inlet valves (e.g., about 50% of max coming from inner region and about 50% of max coming from outer region). As shown in FIG. 27A, flow through the inlet valves in the inner region increases incrementally over time. For example, the increment may be about 0.25% to about 5%; about 0.5% to about 5%; about 0.75% to about 5%; about 0.5% to about 4%; about 0.5% to about 3%; about 1% to about 3%; about 1.5% to about 2.5%; about 1% to about 50%; about 2% to about 20%; etc. The flow through the inlet valves in the inner region may start or begin at a flow of about 0% to about 50%; about 0% to about 25%; about 5% to about 20%; about 10% to about 20%; about 5% to about 15%; about 8% to about 12%; etc. As shown in FIG. 27A, flow through the inlet valves in the outer region decreases incrementally over time. For example, the increment may be about 0.25% to about 5%; about 0.5% to about 5%; about 0.75% to about 5%; about 0.5% to about 4%; about 0.5% to about 3%; about 1% to about 3%; about 1.5% to about 2.5%; about 1% to about 50%; about 2% to about 20%; etc. The flow through the inlet valves in the outer region may start or begin at a flow of about 50% to about 100%; about 50% to about 95%; about 60% to about 95%; about 70% to about 95%; about 80% to about 95%; about 90% to about 95%; about 85% to about 95%; about 88% to about 93%; etc. Alternatively, flow through the inner region inlet valves may decrease over time and the flow through the outer region inlet valves may increase over time. Alternatively still, the flow through the inner region inlet valves may stay constant or fixed while the flow through the outer region inlet valves increases or decreases over time. Alternatively still, the flow through the outer region inlet valves may stay constant or fixed while the flow through the inner region inlet valves increases or decreases over time.

Figure 28B:
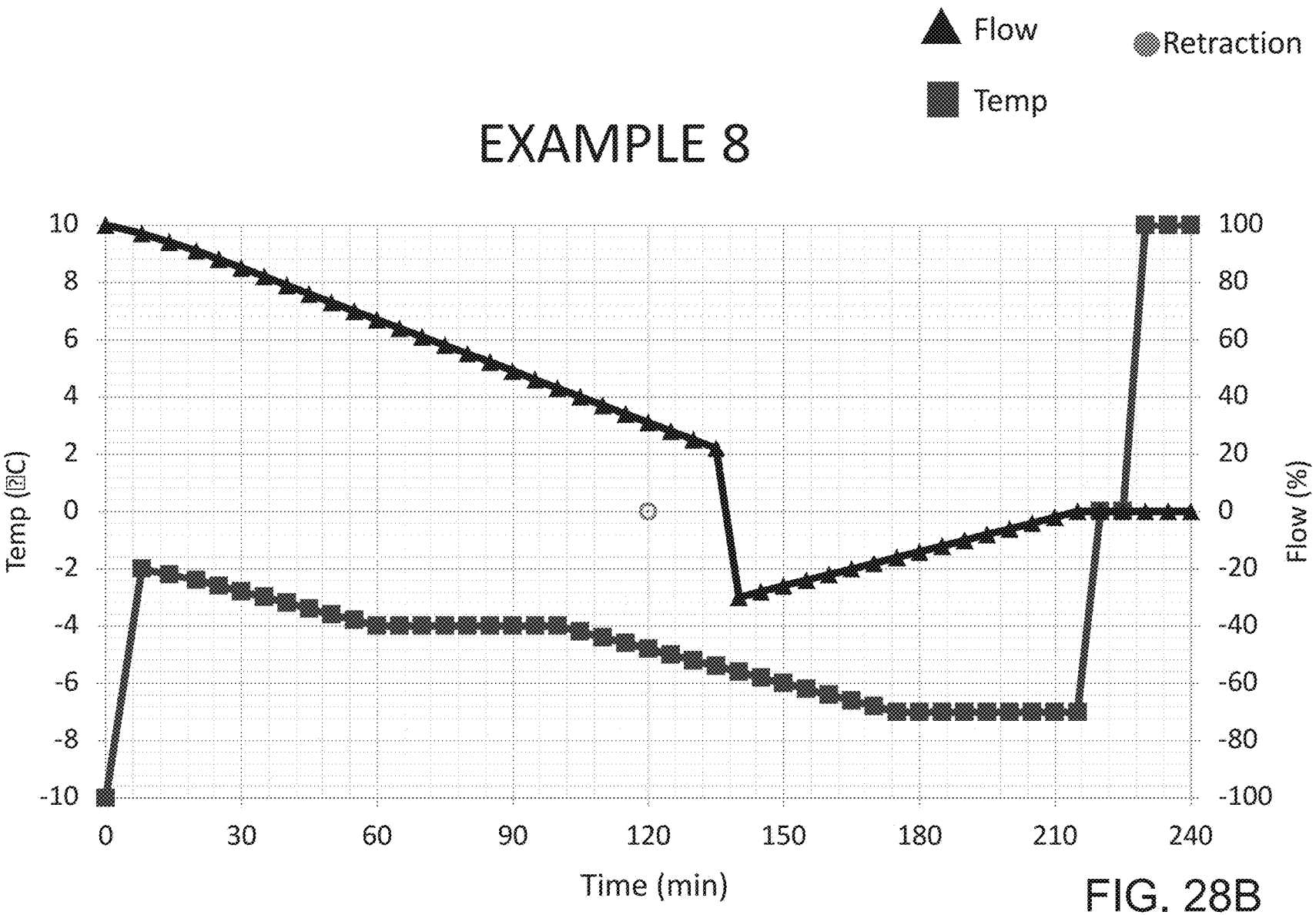

FIGS. 28A-28B show a method of making clear ice. The method of FIGS. 28A-28B are similar to that shown in FIGS. 26A-26B, except that instead of the percent max flow decreasing incrementally over time, the method of FIGS. 28A-28B include an incremental decrease in flow over time followed by a period of flow reversal. Flow reversal means that inlet valves switch to outlet valves and/or outlet valves switch to inlet valves. As shown in FIGS. 28A-28B, the percentage max flow incrementally decreases over time. For example, the increment may be between about 1% to about 10%; about 1% to about 8%; about 1% to about 6%; about 1% to about 4%; about 2% to about 4%; about 2% to about 5%; etc. for about 50 minutes to about 180 minutes; about 60 minutes to about 170 minutes; about 70 minutes to about 160 minutes; about 70 minutes to about 160 minutes; about 80 minutes to about 150 minutes; about 100 minutes to about 150 minutes; about 125 minutes to about 145 minutes; about 130 minutes to about 140 minutes; etc. A starting flow percent may be between about 100% to about 50%; about 90% to about 50%; about 80% to about 60%; about 100% to about 90%; etc. An end flow percent may be between about 0% to about 50%; about 5% to about 45%; about 10% to about 40%; about 15% to about 35%; about 20% to about 30%; about 20% to about 25%; etc. This period of positive flow may be followed by a period of flow reversal as described above. In this embodiment, flow may be reversed that the fluid inlet valve becomes a fluid outlet valve, such that the flow percent represents a flow of liquid out of the mold. For example, reversed flow may occur at between about 0% to about 50%; about 5% to about 45%; about 10% to about 40%; about 15% to about 35%; about 20% to about 35%; about 25% to about 35% about 28% to about 33% of max flow; etc. The period of flow reversal may be between about 5 minutes to about 100 minutes; about 15% minutes to about 90 minutes; about 25 minutes to about 80 minutes; about 30 minutes to about 80 minutes; about 40 minutes to about 80 minutes; about 50 minutes to about 80 minutes; about 60 minutes to about 80 minutes; about 65 minutes to about 75 minutes; about 70 minutes to about 80 minutes; etc. In some embodiments, as shown in FIGS. 27A-27B, the annealing period may be characterized by a period of about 0% flow such that no liquid is coming into or out of the mold. In other embodiments, the annealing period may be characterized by low flow, for example 1% to about 10%; about 5% to about 15%; about 5% to about 10%; etc.

Figure 29B:
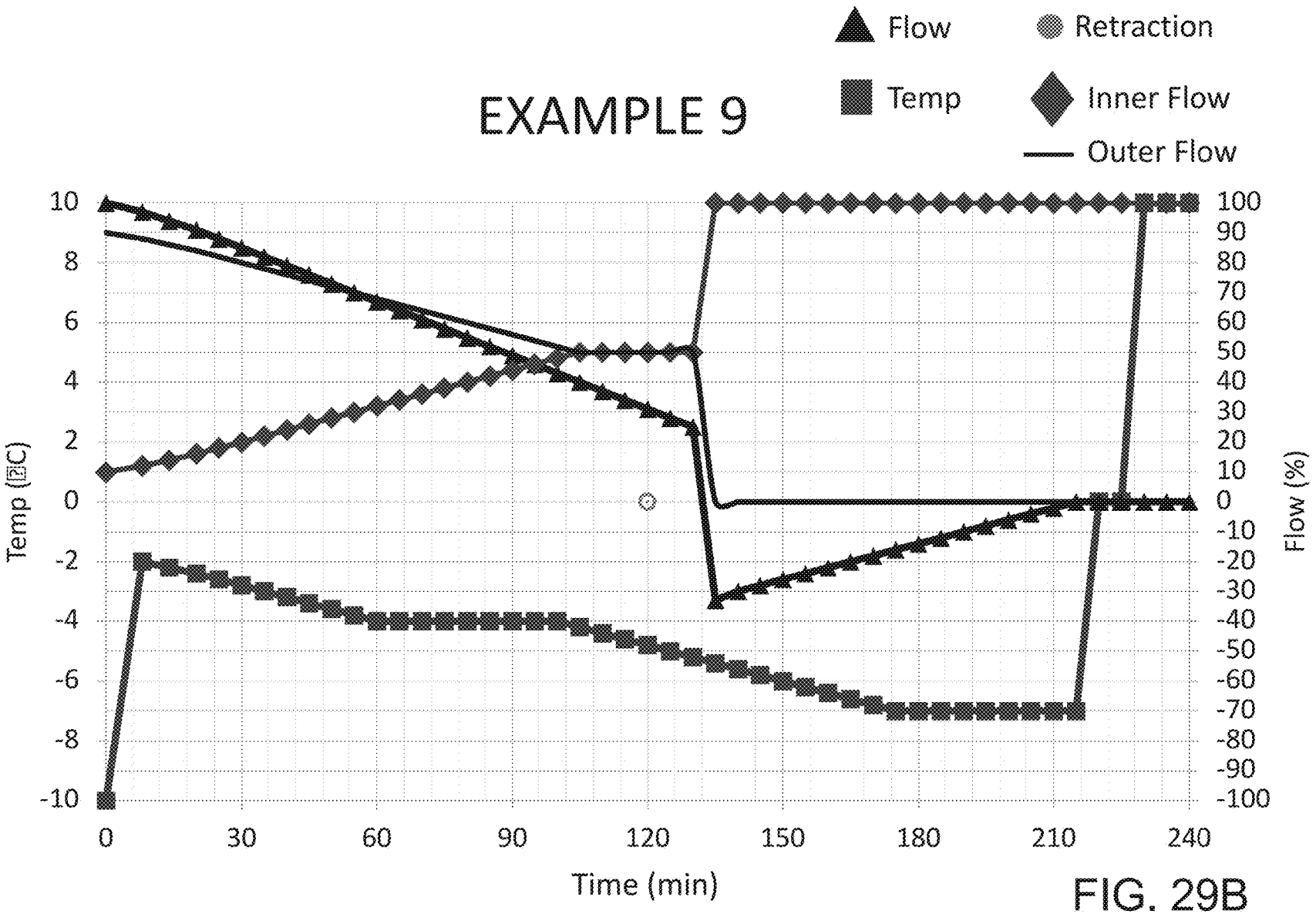

FIGS. 29A-29B show a method of making clear ice similar to a combination of the methods shown in FIGS. 27A-27B and FIGS. 28A-28B. In this embodiment, during the flow reversal period, end plateau, and annealing phases, the flow from the flow inlet valves has switch almost exclusively (i.e., 100%) to inner region flow from the inner region inlet valves. In other embodiments, flow may switch almost exclusively (i.e., 100%) to outer region flow from the outer region inlet valves. Further, as shown in FIGS. 29A-29B, the intersection period, in which about 50% of flow is from the inner region inlet valves and about 50% from the outer region inlet valves, has a time window of about 5 minutes to about 60 minutes; about 10 minutes to about 55 minutes; about 15 minutes to about 50 minutes; about 15 minutes to about 45 minutes; about 20 minutes to about 40 minutes; about 25 minutes to about 35 minutes; about 28 minutes to about 32 minutes; etc.

The systems and methods of the preferred embodiment and variations thereof can be embodied and/or implemented at least in part as a machine configured to receive a computer-readable medium storing computer-readable instructions. The instructions are preferably executed by computer-executable components preferably integrated with the system and one or more portions of the processor on the system, device, and/or computing device. The computer-readable medium can be stored on any suitable computer-readable media such as RAMs, ROMs, flash memory, EEPROMs, optical devices (e.g., CD or DVD), hard drives, floppy drives, a server, "the cloud," or any suitable device. The computer-executable component is preferably a general or application-specific processor, but any suitable dedicated hardware or hardware/firmware combination can alternatively or additionally execute the instructions.

As used in the description and claims, the singular form "a", "an" and "the" include both singular and plural references unless the context clearly dictates otherwise. For example, the term "cube" may include, and is contemplated to include, a plurality of cubes. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5%, 1% or 0.1%. All numerical ranges provided herein are inclusive of the stated start and end numbers. The term "substantially" indicates mostly (i.e., greater than 50%) or essentially all of a device, substance, or composition.

As used herein, the term "comprising" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a system or method consisting essentially of the elements as defined herein would not exclude other materials, features, or steps that do not materially affect the basic and novel characteristic(s) of the claimed disclosure. "Consisting of" shall mean that the devices, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A method making clear ice, comprising:
providing a mold comprising:
one or more sides defining a cavity,
a fluid inlet valve,
a fluid outlet valve, and
a coolant source in thermal communication with the one or more sides;
inserting a skewer through one or more apertures defined by the mold and into the cavity, the skewer being configured to be coupled to an item;
circulating, using the fluid inlet and outlet valves, a fluid in the cavity defined by the one or more sides;
varying over time one or both of: a temperature of the coolant source or a fluid flow rate, through the fluid inlet valve, as a percentage of max flow; and
retracting the skewer at a predetermined time.

2. The method of claim 1, wherein the predetermined time is dependent on a type of item, a volume of the mold, a sensor reading, or a combination thereof.

3. The method of claim 2, wherein the item is food, liquor, a flower, or a prize.

4. The method of claim 1, wherein the coolant source comprises a cold plate in thermal communication with the one or more sides.

5. The method of claim 1, wherein the coolant source comprises one or more coolant lines in the one or more sides of the mold.

6. The method of claim 1, wherein varying the temperature comprises varying the temperature between about 0° C.and about −25° C.

7. The method of claim 1, wherein varying the fluid flow rate comprises varying the percentage of max flow between about 5% and about 100%.

8. The method of claim 1, wherein varying the temperature comprises including one or more temperature plateaus for about 3 minutes to about 100 minutes.

9. The method of claim 1, wherein varying the temperature comprises including an initial temperature drop to about 0° C.to about −15° C.

10. The method of claim 1, wherein varying the temperature comprises including an annealing period characterized by a coolant source temperature between about −2° C.and about 15° C.and the percentage max flow of about 0% to about 5%.

11. The method of claim 1, wherein varying the fluid flow rate comprises including a period of flow reversal, wherein the fluid inlet valve becomes the fluid outlet valve and the fluid outlet valve becomes the fluid inlet valve.

12. The method of claim 1, further comprising releasing the ice from the mold with the item encased therein.

13. A method making clear ice, comprising:
providing a mold comprising:
one or more sides defining a cavity,
a fluid inlet valve,
a fluid outlet valve, and
a coolant source in thermal communication with the one or more sides;
circulating, using the fluid inlet and outlet valves, a fluid in the cavity defined by the one or more sidewalls; and
varying over time one or both of: a temperature of the coolant source or a fluid flow rate, through the fluid inlet valve, as a percentage of max flow.

14. The method of claim 13, further comprising inserting a skewer through one or more apertures defined by the mold and into the cavity, the skewer being coupled to an item.

15. The method of claim 14, further comprising retracting the skewer at a predetermined time.

16. The method of claim 15, wherein the predetermined time is dependent on a type of item, a volume of the mold, a sensor reading, or a combination thereof.

17. The method of claim 14, wherein the item is food, liquor, a flower, or a prize.

18. The method claims 13, wherein the coolant source comprises a cold plate in thermal communication with the one or more sidewalls.

19. The method of claims 13, wherein the coolant source comprises one or more coolant lines in the one or more sidewalls.

20. The method of claims 13, wherein varying the temperature comprises varying the temperature between about 0° C. and about −20° C.

21. The method of claims 13, wherein varying the fluid flow rate comprises varying the percentage of max flow between about 5% and about 100%.

22. The method of claims 13, wherein varying the temperature comprises including one or more temperature plateaus for about 3 minutes to about 100 minutes.

23. The method of claims 13, wherein varying the temperature comprises including an initial temperature drop to about 0° C.to about −15° C.

24. The method of claims 13, wherein varying the temperature comprises including an annealing period characterized by a coolant source temperature between about −2° C. and about 15° C. and the percentage max flow of about 0% to about 5%.

25. The method of claims 13, wherein varying the fluid flow rate comprises including a period of flow reversal, wherein the fluid inlet valve becomes the fluid outlet valve and the fluid outlet valve becomes the fluid inlet valve.

26. The method of claims 14, further comprising releasing the ice from the mold with the item encased therein.

* * * * *